US009206022B2

(12) United States Patent
Burneister et al.

(10) Patent No.: US 9,206,022 B2
(45) Date of Patent: Dec. 8, 2015

(54) WINCH ASSEMBLY

(71) Applicant: Cequent Performance Products, Inc., Plymouth, MI (US)

(72) Inventors: Victor Burneister, Weston, WI (US); Kawa-She-Quoen Wm. Okerlund, Wittenberg, WI (US); Frank Drake, Wausau, WI (US); Todd Walstrom, Weston, WI (US); Eric Anderson, Mishawaka, IN (US)

(73) Assignee: Cequent Performance Products, Inc., Plymouth, MI (US)

( * ) Notice: Subject to any disclaimer, the term of this patent is extended or adjusted under 35 U.S.C. 154(b) by 297 days.

(21) Appl. No.: 13/837,725

(22) Filed: Mar. 15, 2013

(65) Prior Publication Data

US 2013/0270498 A1 Oct. 17, 2013

Related U.S. Application Data

(63) Continuation-in-part of application No. 13/571,557, filed on Aug. 10, 2012, now Pat. No. 8,720,865, which is a continuation of application No. PCT/US2011/062869, filed on Dec. 1, 2011, (Continued)

(51) Int. Cl.

| | |
|---|---|
| ***B66D 1/28*** | (2006.01) |
| ***B66D 1/04*** | (2006.01) |
| ***B66D 1/34*** | (2006.01) |
| ***B66D 1/74*** | (2006.01) |

(52) U.S. Cl.

CPC .. *B66D 1/28* (2013.01); *B66D 1/04* (2013.01); *B66D 1/34* (2013.01); *B66D 1/7452* (2013.01); *B66D 1/7489* (2013.01)

(58) Field of Classification Search

USPC ..... 254/261, 262, 323, 380

See application file for complete search history.

(56) References Cited

U.S. PATENT DOCUMENTS

| | | | |
|---|---|---|---|
| 747,401 | A | 12/1903 | Foltz |
| 822,861 | A | 6/1906 | Mushatt |
| 1,453,559 | A | 5/1923 | Webb |
| 1,547,963 | A | 7/1925 | Seifert |
| 1,806,606 | A | 5/1931 | Booth |

(Continued)

FOREIGN PATENT DOCUMENTS

| | | |
|---|---|---|
| NZ | 228633 | 8/1991 |
| WO | WO2012/075270 | 6/2012 |

OTHER PUBLICATIONS

International Search Report and the Written Opinion (mailed Jun. 7, 2012) for PCT/US11/62869 filed Dec. 1, 2011, Cequent Performance Products, Inc.

(Continued)

*Primary Examiner* — Emmanuel M Marcelo

(74) *Attorney, Agent, or Firm* — McDonald Hopkins LLC

(57) ABSTRACT

Disclosed is a winch assembly that may include a first housing member having a first retaining member formed therein and a second housing member having a second retaining member formed therein, the second housing member secured to the first housing member forming a winch housing. The winch assembly may further include a drive system generally positioned within the winch housing, and a winch drum operatively coupled with the drive system and rotationally secured with the first and second retaining members.

20 Claims, 42 Drawing Sheets

Related U.S. Application Data application No. 13/837,725, which is a continuation-in-part of application No. 13/169,871, filed on Jun. 27, 2011, now Pat. No. 8,459,615, which is a continuation of application No. 12/558,252, filed on Sep. 11, 2009, now Pat. No. 7,967,278, application No. 13/837,725, which is a continuation-in-part of application No. 12/778,008, filed on May 11, 2010, now Pat. No. 8,579,259.

(60) Provisional application No. 61/418,809, filed on Dec. 1, 2010, provisional application No. 61/191,682, filed on Sep. 11, 2008.

(56) References Cited

U.S. PATENT DOCUMENTS 3,159,368 A * 12/1964 Ahlbin et al. ..... 248/222.41
3,520,515 A 7/1970 Pomalgalski et al.
3,606,193 A 9/1971 Alfred
3,900,214 A * 8/1975 Brockelsby ..... 280/414.1
3,910,558 A 10/1975 Brucker et al.
3,939,729 A 2/1976 Brockelsby
4,106,754 A 8/1978 Kucher
4,215,850 A * 8/1980 Haase et al. ..... 254/350
4,268,012 A * 5/1981 Ruehle et al. ..... 254/223
4,320,672 A 3/1982 Segawa
4,456,227 A 6/1984 Notenboom
4,566,674 A 1/1986 Ebey et al.
4,582,298 A 4/1986 Boome et al.
4,884,784 A 12/1989 Nix et al.
5,011,004 A 4/1991 D'Amato
5,320,398 A 6/1994 Popp et al.
5,346,153 A 9/1994 Ebey
5,368,280 A * 11/1994 Ng ..... 254/376
5,374,035 A 12/1994 Santos
5,392,109 A 2/1995 Acquaviva
D364,027 S * 11/1995 Hung ..... D34/33
5,509,639 A * 4/1996 Ellis ..... 254/380
5,573,091 A * 11/1996 Hung ..... 192/12 R
5,593,139 A 1/1997 Julian
5,947,450 A 9/1999 Grapes
6,021,692 A 2/2000 Norfolk et al.
6,116,580 A * 9/2000 Hull ..... 254/357
6,234,509 B1 5/2001 Lara
6,431,525 B1 8/2002 Roll
6,471,191 B1 10/2002 Rotzler et al.
6,505,849 B1 1/2003 Ebey
7,017,887 B1 * 3/2006 Verakis ..... 254/342
7,121,599 B2 10/2006 Demar et al.
7,159,852 B2 1/2007 Dow et al.
7,374,379 B2 5/2008 Booher
7,543,800 B2 6/2009 Grapes et al.
7,556,241 B2 7/2009 Geagan
7,686,282 B2 3/2010 Amoses et al.
7,806,386 B2 10/2010 Yang et al.
7,967,278 B2 6/2011 Anderson et al.
8,267,379 B2 * 9/2012 Yang et al. ..... 254/336
2007/0257243 A1 11/2007 Cofer
2008/0001131 A1 * 1/2008 Murphy ..... 254/323
2008/0164448 A1 * 7/2008 Duvall ..... 254/323
2009/0114892 A1 5/2009 Lesko
2012/0298938 A1 11/2012 Anderson et al.

OTHER PUBLICATIONS

International Preliminary Report on Patentability (mailed Mar. 24, 2011) for PCT/US11/62869 filed Dec. 1, 2011, Cequent Performance Products, Inc.

New Zealand Examination Report for Application No. 611475, Cequent Performance Products, Inc. Nov. 26, 2013.

* cited by examiner

WINCH ASSEMBLY

CROSS-REFERENCE TO RELATED APPLICATION

This application is a continuation-in-part of U.S. application Ser. No. 13/571,557, entitled "Winch Assembly" filed on Aug. 10, 2012, which is a continuation of International Application No.: PCT/US2011/62869U.S., entitled "Winch Assembly" filed on Dec. 1, 2011, which claims the benefit from U.S. Provisional Patent Application No. 61/418,809 entitled "Winch Assembly" filed on Dec. 1, 2010, which are all hereby incorporated in their entirety by reference.

This application is also a continuation-in-part of U.S. application Ser. No. 13/169,871, entitled "Winch Assembly" filed on Jun. 27, 2011, which is a continuation of prior U.S. patent application Ser. No. 12/558,252, filed on Sep. 11, 2009, now U.S. Pat. No. 7,967,278, which claims the benefit of U.S. Provisional Patent Application No. 61/191,682, entitled "Winch Assembly," filed on Sep. 11, 2008, which are all hereby incorporated by reference in their entirety.

This application is also a continuation-in-part of U.S. application Ser. No. 12/778,008, entitled "Two-Speed Winch Assembly" filed on May 11, 2010, which is hereby incorporated by reference in its entirety.

FIELD OF INVENTION

The present invention relates generally to winch assemblies, and more particularly, to winch assemblies with a winch housing.

BACKGROUND

Towing vehicles and towed vehicles secure and haul a wide variety of cargo. Towed vehicles can be arranged to haul various types of cargo, such as boats, automobiles, all-terrain vehicles, snowmobiles, consumer products, etc. Many such cargo items are large, heavy and difficult to move or maneuver onto the bed or frame of a towed vehicle, or the load bed of the towing vehicle. To assist in moving and/or maneuvering the cargo onto the towed or towing vehicle, such towed or towing vehicles may be equipped with a winch or winch assembly.

The winch assembly is often attached to a tongue of the towed vehicle or any appropriate position on the towing vehicle. The winch assembly may also be connected to a cargo item by, for example, a strap, cable, rope, chain or the like that may aid in pulling the cargo item onto the towed or towing vehicle, as applicable. The winch assembly may typically utilize a handle to rotate a drum to wind the strap or cable around the drum thereby pulling the cargo item towards the winch. The winch assembly may also be utilized to unload heavy items from the towed or towing vehicle by rotating the drum in the opposite direction thereby unwinding the strap or chain to assist with sliding the cargo item off of the towed or towing vehicle.

The winch assembly provides a mechanical advantage to the operator making it easier to move and/or maneuver heavy cargo items. It permits an operator to otherwise move and maneuver items that he or she would not otherwise be able to move and/or maneuver. For example, this makes it possible for an operator to load a boat onto a trailer wherein he or she would not otherwise be able to so.

Many prior art winch assemblies, however, do not possess a housing or body enclosing the moving parts thereof. As such, this may cause the moving parts to be exposed to the elements, dirt, etc., which may lead to increased wear on the moving parts and also may present an aesthetically less desirable appearance. Those winch assemblies that include a housing or body encasing, however, include many moving parts that are difficult to manufacture and/or assemble. Moreover, these types of winch assemblies require many additional parts such as fasteners, brackets, etc. These additional parts may be more difficult to assemble and/or more costly to produce. Therefore, there is a need for an improved winch/winch assembly.

In addition, prior art winch assemblies are often manufactured from a formed steel stamping. This material and process may severely limit the features and aesthetics that can be incorporated into such prior art winch assemblies. Therefore, there is a need for an improved winch/winch assembly.

In the prior art, a strap bolt may be used to pass through the drum assembly (outside of the drum hub) to assemble the winch strap to the drum. The strap bolt, however, may cause a "bump" where the strap wraps around the strap bolt as the strap is wound around the drum hub and strap bolt. This bump may cause the strap to rotate eccentrically, which may create a mechanical disadvantage and may put elliptical loading on the winch assembly, which may cause it to be less effective. Therefore, there is a need for a winch assembly that may generally avoid the creation of this "bump."

In a traditional mounting application, fasteners have to be installed through the inside of the winch assembly. This may be cumbersome due to several components being located on the inside of the winch assembly. Making matters more difficult to access the mounting holes may be when a winch line is fully wound onto the drum. With this limited inside access, being able to hold down the head of the bolts is sometimes a problem when trying to tighten the nuts from the bottom side. Occasionally, parts of the winch may need to be disassembled to complete the installation. Therefore, there is a need for an improved winch/winch assembly that may have improved attaching features.

SUMMARY

A winch assembly may include a winch housing having a bottom portion, and an installation system attached to the bottom portion of the winch housing. The installation system may include at least one aperture and at least one slot extending from the at least one aperture. The installation system may also include at least one fastener having a head, where the head of the fastener is capable of passing through the at least one aperture and where the fastener is selectively positionable along the slot while the head of the fastener is generally held within the slot.

A winch assembly may include a winch frame having a bottom portion, and an installation system formed with the bottom portion of the winch frame. The installation system may include at least one aperture, and a slot spaced from the at least one aperture. The installation system may also include first and second fasteners each having a head, where the first fastener is inserted into the at least one aperture until the head engages the at least one aperture and the second fastener is inserted into the slot until the head engages the slot, where the second fastener is selectively positionable along the slot.

A winch assembly may include a winch body, at least one aperture positioned through the winch body, and a slot spaced from the at least one aperture and positioned on the winch body. The winch assembly may also include first and second fasteners each including a head, where the first fastener is inserted into the at least one aperture with the head preventing further insertion through the aperture and the second fastener is inserted into the slot, the head preventing further insertion through the slot, where the second fastener is selectively positionable along the slot while the head of the fastener is engaged with the slot.

BRIEF DESCRIPTION OF THE DRAWINGS

Operation of the invention may be better understood by reference to the detailed description taken in connection with the following illustrations, wherein.

DETAILED DESCRIPTION

Figure 1:
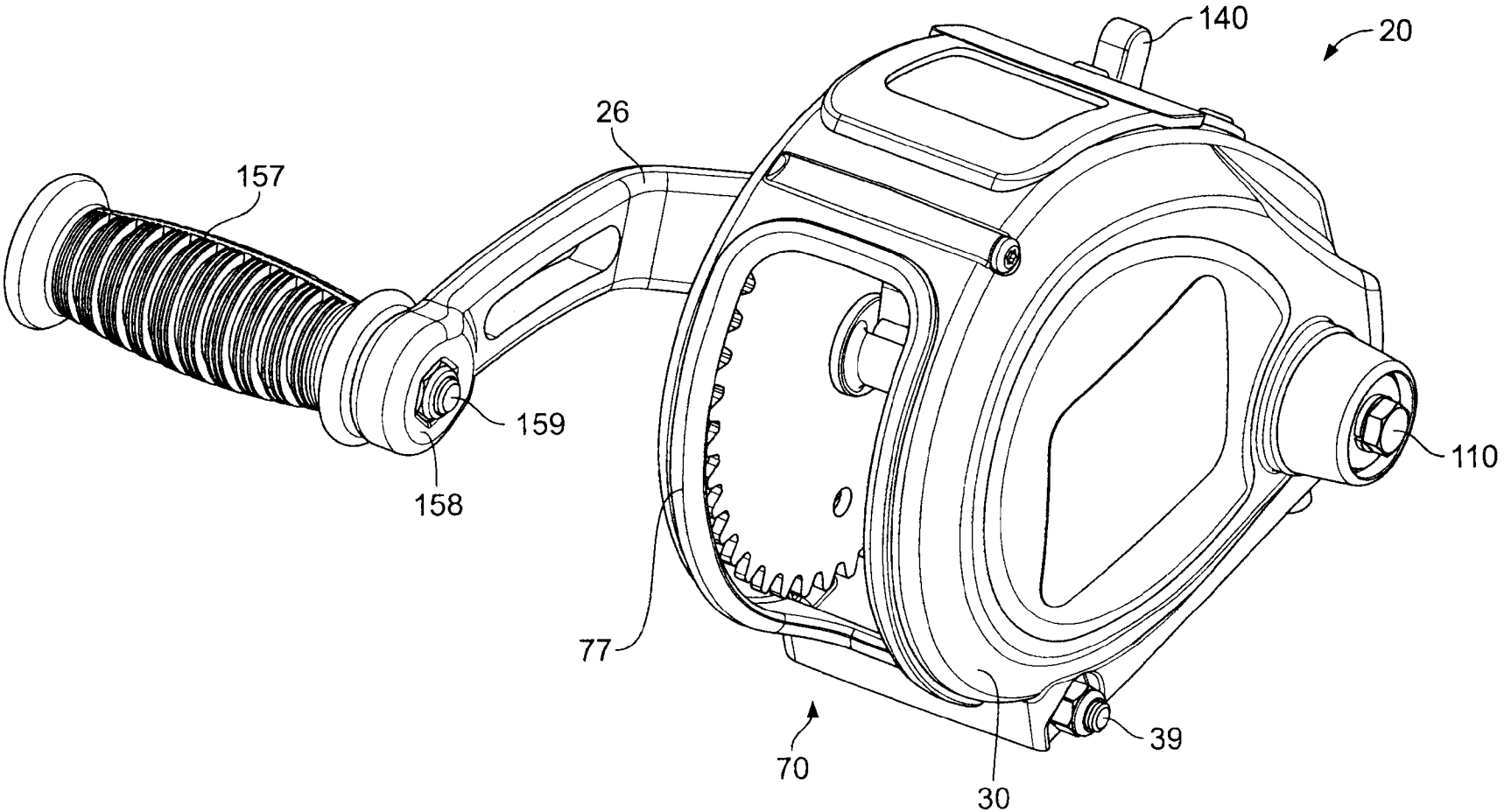
FIG. 1 is a perspective view of embodiments of a winch assembly.

Reference will now be made in detail to exemplary embodiments of the present invention, examples of which are illustrated in the accompanying drawings. It is to be understood that other embodiments may be utilized and structural and functional changes may be made without departing from the respective scope of the invention. Moreover, features of the various embodiments may be combined or altered without departing from the scope of the invention. As such, the following description is presented by way of illustration only and should not limit in any way the various alternatives and modifications that may be made to the illustrated embodiments and still be within the spirit and scope of the invention.

A single speed dual drive winch assembly 20 is shown in FIGS. 1-6. The winch assembly 20 may provide improved aesthetics and performance to towed or towing vehicles, as applicable, including, without limitation to marine trailers. When the winch assembly 20 is properly mounted to a towed or towing vehicle the winch assembly 20 may be utilized to assist in the loading and final positioning of an item onto the towed or towing vehicle, as applicable. By way of a non-limiting example, the winch assembly 20 may be utilized to assist in the loading and final positioning of a marine vehicle onto a marine trailer. This type of situation may commonly occur while using a marine trailer to remove a marine vehicle from a body of water. The winch assembly 20, however, is not limited to use with a marine trailer. It may operate with any kind of towed or towing vehicle in which an operator needs to load and/or unload cargo and requires some mechanical assistance. In addition, the winch assembly 20 may be used without the towed or towing vehicle when an operator needs to move cargo and requires mechanical assistance.

Although a single speed dual drive winch assembly 20 is shown in the drawings, it should be understood that the present teachings are not limited to such. In other embodiments, the winch assembly 20 may include any speed winch assembly, such as by way of a non-limiting example, a dual speed dual drive winch assembly, a single speed single drive assembly or the like.

In some embodiments, the winch assembly 20 may include a handle or crank 26 and a winch housing 30 that may house the internal components of the winch assembly 20, as further described below. The winch housing 30 may include first and second housing members 34, 38, respectively. The first and second housing members 34, 38 may be fabricated from any appropriate material and fabricated in any appropriate manner, e.g., they may be die cast aluminum. By way of a non-limiting example, high pressure die casting may be utilized to fabricate the first and second housing members 34, 38. This may allow complex and aesthetic shapes to be formed, may incorporate many desirable features and components into the winch assembly 20, may provide for a high strength construction, and may make manufacturing generally easier. Further, die casting may allow for precision control of dimensions of the housing 30, may allow for forming thicker sections to strengthen the housing 30, may require fewer components and pieces to assemble, and may allow for simplified parts to assemble. While these embodiments may be produced from die-cast aluminum, it should be understood that many other materials may be used such as steel, plastic, or other rigid material and the present teachings are not limited to such.

In some embodiments, the first and second housing members 34, 38 may be attached to each other in any appropriate manner. By way of a non-limiting example, the first and second housing members 34, 38 may be attached by a fastener 39 or a plurality of fasteners 39 extending through the first and second housing members 34, 38 securing them together. In some embodiments, the first and second housing members 34, 38 may be generally vertically aligned and positioned adjacent each other and then may be secured together to form the winch housing 30.

The winch assembly 20 may further optionally include a cover piece 40 that may be attached to the first and second housing member 34, 38. The cover piece 40 may further secure the first and second housing members 34, 38 together. In some embodiments, fasteners 41 may be used to attach the cover piece 40 to the first and second housing members 34, 38 in any appropriate manner. In other embodiments, the cover piece 40 may be integrally formed with either the first and second housing members 34, 38, or with both of the first and second housing members 34, 38. Still further, in other embodiments, the first and second housing members 34, 38 may be shaped and sized such that the cover piece 40 may not be utilized in the winch assembly 20.

The winch assembly 20 may further include a winch drum 42 and a ratchet and pawl system 44. The winch drum 42 and ratchet and pawl system 44 may be generally located within housing 30. The winch drum 42 and the ratchet and pawl system 44 may be operatively coupled such that the ratchet and pawl system 44 may selectively drive and lock the winch drum 42 as further described below.

The structure of the first and second housing members 34, 38 may allow the winch drum 42 to be operatively coupled between the first and second housing members 34, 38. This may generally eliminate the requirement of a strap bolt as described above, which is often required in the prior art. The winch drum 42 may include first and second drum gears 46, 48. Although two drum gears are shown, any number of drum gears may be used, e.g., one, three, four, etc. The winch drum 42 may further include a drum hub 50. The drum hub 50 may include a center section 52, a first gear mounting portion 54, and a second gear mounting portion 56. The first drum gear 46 may mount to the first gear mounting portion 54 and the second drum gear 48 may mount to the second gear mounting portion 56. The first and second mounting portions 54, 56 may act as a self-fixture for the first and second drum gears 46, 48. In particular, the first and second mounting portions 54, 56 may each include a lip 57, 59 that may act as a stop for mounting the drum gears 46, 48 to the drum hub 50. As the gears 46, 48 are mounted onto the first and second gear mounting portions 54, 56 the gears 46, 48 may be positioned until they abut against the lips 57, 59. This may ensure that the gears 46, 48 may be properly mounted to the drum hub 50. Additionally, this may eliminate the need for any kind of strap bolt.

Figure 2:
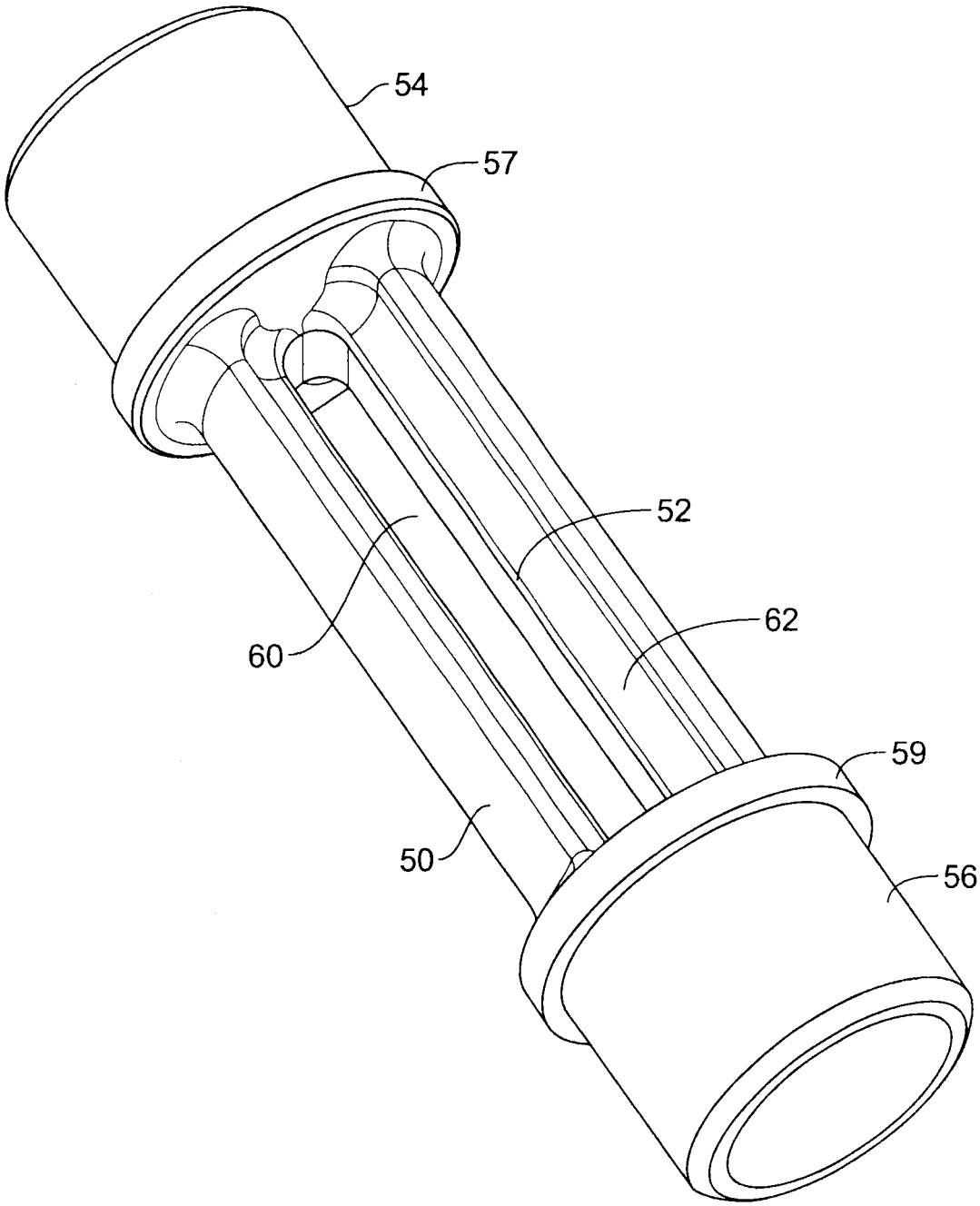
FIG. 2 is a perspective view of embodiments of a drum hub of the winch assembly.
Figure 6:
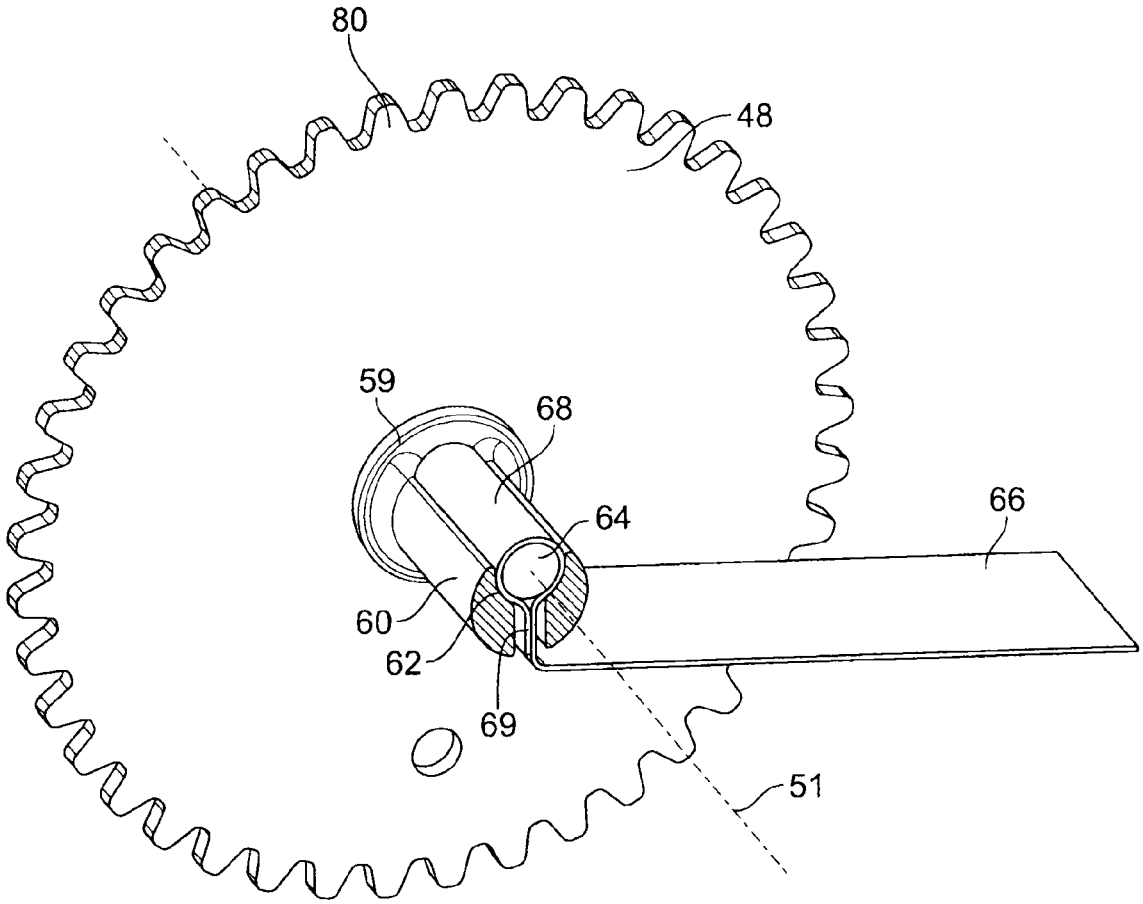
FIG. 6 is a perspective view of the drum gear and the strap engaged with the drum hub of the winch assembly in partial cross-section.
Figure 6A:
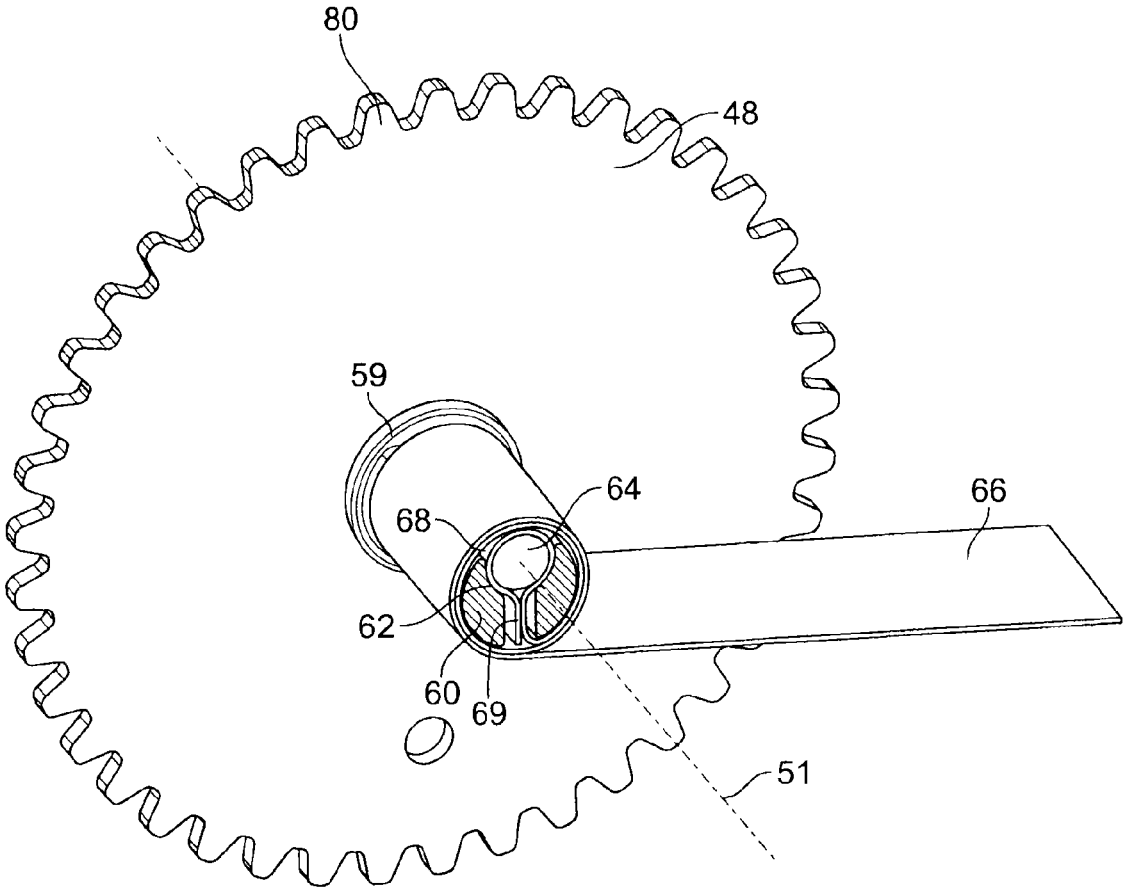
FIG. 6A is a perspective view of the drum gear and the strap engaged with the drum hub of the winch assembly in partial cross-section with a cargo connection member partially wound around the drum hub.

The center section 52 of the drum hub 50 may include a slot 60 that may generally extend through the center section 52. The center section 52 may further include a generally concave recess 62 that may be cutout from or integrally formed with the center section 52, as shown in FIG. 2. The recess 62 may be generally shaped and sized to receive a pin 64 on which a strap 66 may connect. In particular, the strap 66 may include a sewn loop 68 or any other appropriate fastening device, at an end 69 of the strap 66. The pin 64 may be shaped and sized to fit within the sewn loop 68 of the strap 66. The pin 64 and sewn loop 68 of the strap 66 may generally fit within the recess 62 such that during operation of the winch assembly 20, the strap 66 may generally concentrically wrap around the center section 52 of the drum hub 50 such that there are no "bumps." In some embodiments, pin 64—and in some embodiments the sewn loop portion 68 of the strap 66—may fit within recess 62 such that a portion of the exterior surface of pin 64—or the sewn loop 68 portion of the strap 66—may generally be an extension of the exterior surface of drum hub 50 as the exterior surfaces extend circumferentially around a central axis 51 of drum hub 50; see FIG. 6A. These configurations may generally eliminate the eccentric rotation of the strap 66 that may be otherwise caused by the drum bolt being present and protruding beyond the exterior surface of drum hub 50. These embodiments show the strap 66, however, any appropriate cargo connection member may be used, including without of limitation a cable, rope, chain or the like without departing from the present teachings.

To mount the strap 66 to the winch drum 42, the pin 64 may be inserted into the sewn loop 68 of the strap 66. The combination of the pin 68 and strap 66 may be inserted into the recess 62 such that the pin 64 may generally float freely within the recess 62. This may eliminate the need for an additional bolt to attach the strap 66 to the drum hub 50, which may also result in the drum hub 50 having a smaller diameter than prior art drum hubs. The remaining portion of the strap 66 may be pushed through the slot 60—which may acts as a strap guide—in the center section 52 of the drum hub 50 and may be fed through an integrated strap guide 70 to the outside of the winch assembly 20 for attachment to cargo (not shown). The end 69 of the strap 66 may attach to the winch drum 42 and a second end (not shown) of the strap 66 may appropriately attach to the cargo. The winch drum 42 and strap 66 may pull cargo onto the towed or towing vehicle when the winch drum 42 is rotated in a first direction and may release cargo to be removed from the towed or towing vehicle when the winch drum 42 is rotated in a second generally opposite direction.

In some embodiments, the strap 66 may be capable of attaching to the winch drum 42 without additional hardware. This may also allow the strap 66 to rotate generally concentrically, which may create a mechanical advantage and may potentially extend the life of the winch assembly 20. The absence of the strap bolt may allow the winch drum 42 to be generally "bumpless."

The first and second housing members 34, 38 may have integrally formed therewith the integrated strap guide 70. The integrated strap guide 70 may include a cut-out portion 72 in the first housing member 34 and a cut-out portion 76 in the second housing member 38, which may form an opening 77. In other embodiments, the integrated strap guide 70 may be formed in just one of the first and second housing members 34, 38 as appropriate, forming the opening 77. In those embodiments in which the first side and second housing members 34, 38 are formed together the cut-out sections 72, 76 may form the integrated strap guide 70. The integrated strap guide 70 may allow the opening 77 in the winch assembly 20 from which the strap 66 may extend may be narrower than the internal components of the winch assembly 20. This may generally protect the strap 66 from wear and grease contamination. In particular, the integrated strap guide 70 may be sized to be narrower then the winch drum 42, which may protect the strap 66 from teeth 80 on the first and second drum gears 46, 48. Generally protecting the strap 66 from the teeth 80 may prevent damage to the strap 66 and may increase the useful life of the strap 66 and the winch assembly 20.

Additionally, the strap guide 70 may provide the strap 66 with a smooth clean port of entry and exit from the winch assembly 20. This likewise may limit damage to the strap 66, which may extend the useful life of the strap 66 and the winch assembly 20. The integrated strap guide 70 may create an enclosed integrated winch housing 30 that may otherwise be devoid of mechanical clutter allowing for an aesthetically pleasing exterior design of the winch assembly 20.

Figure 3:
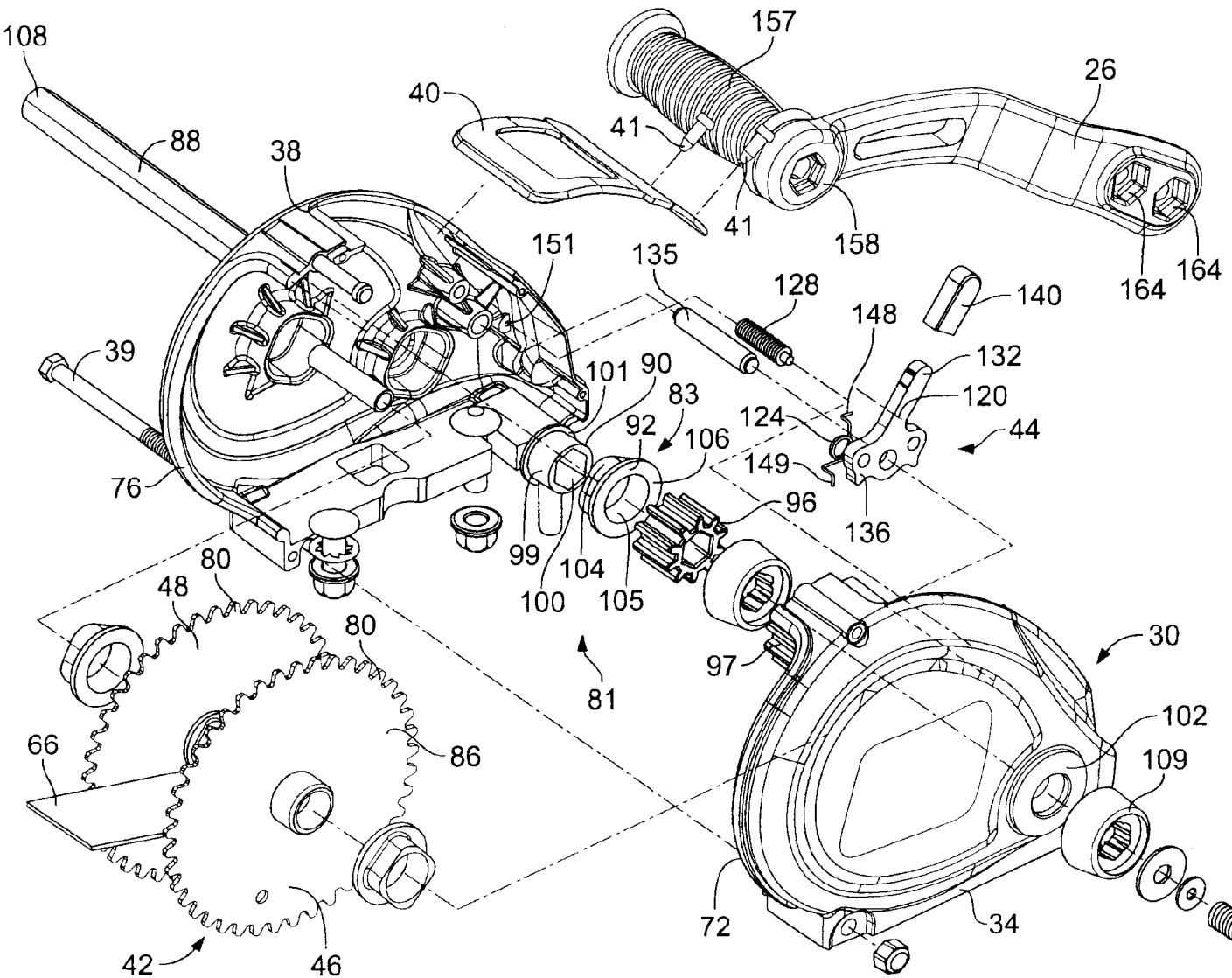
FIG. 3 is an exploded view of the winch assembly of FIG. 1.
Figure 4:
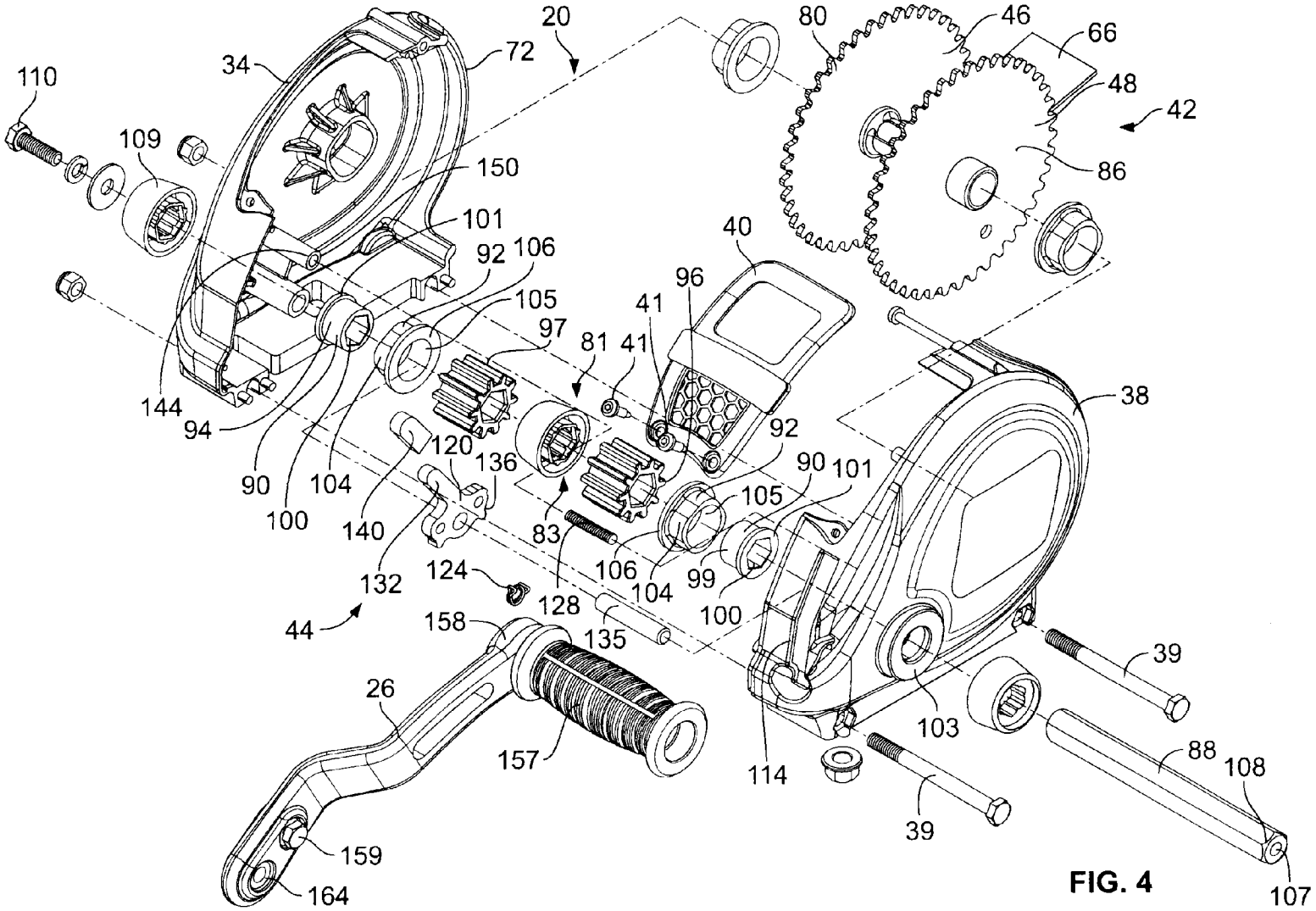
FIG. 4 is an exploded view of the winch assembly of FIG. 1.
Figure 5:
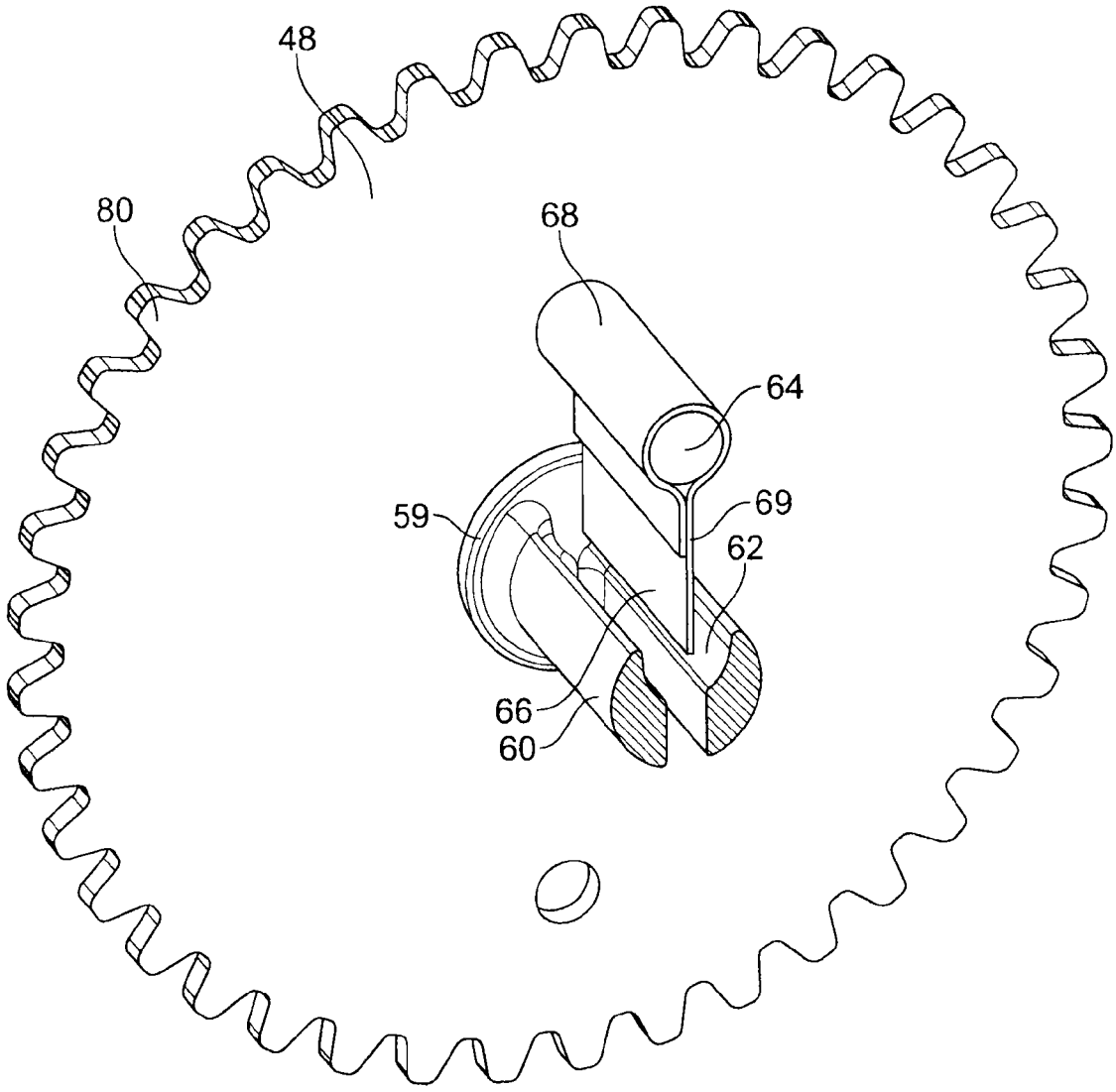
FIG. 5 is a perspective view of a drum gear and a strap disengaged from the drum hub of the winch assembly in partial cross-section.

As shown in FIGS. 3 and 4, the first and second drum gears 46, 48 may have generally straight sides 86. Prior art gears, on the other hand, typically include a sump protruding from the inner side of each gear. The sumps are typically used to encourage the strap away from the teeth of the gears. However, the construction of the winch assembly 20 may make the sump unnecessary as the first and second housing members 34, 38 may generally prevent the strap 66 from engaging the teeth 80 of the winch drum 42. Specifically, the strap guide 70 may generally prevent the strap 66 from engaging the teeth 80, which may make the sump unnecessary in the first and second drum gears 46, 48.

In some embodiments, the winch assembly 20 may include a dual drive system 81, which may be generally positioned within the winch housing 30. The dual drive system 81 of the winch assembly 20 may drive the winch drum 42 to load and unload cargo. The dual drive system 81 may include an adjustable floating winch system 83 that may be driven by the hand operated adjustable crank handle 26. The dual drive system 81 may include a drive shaft 88, a pair of first bushings 90, a pair of second bushings 92, and two drive gears 96, 97. In other embodiments, however, the winch assembly 20 may be a single drive system. The single drive system may only include a single drive gear (not shown).

In some embodiments, the first and second bushings 90, 92 may be slip bushings and may be positioned to hold the drive shaft 88 on both ends thereof. The drive shaft 88 may be of any appropriate cross-sectional shape, such as by way of a non-limiting example, a generally hexagonal cross-sectional shape. The two drive gears 96, 97 may be slip fit onto the hexagonal drive shaft 88, and each drive gear 96, 97 may operate generally independent of the other drive gear 96, 97, as applicable.

The first bushings 90 may have a generally circular outer surface 99, an appropriately shaped inner surface 100 and may include a flange 101. In some embodiments, the first bushings 90 may be slid into pockets 102, 103 within the first and second housing members 34, 38. The pockets 102, 103 may be arranged to generally match the shape of the outer surface 99 of the first bushings 90 so that the first bushings 90 may generally rotate when located in the pockets 102, 103. The first bushings 90 may be fabricated from any appropriate material, such as by way of a non-limiting example, oil impregnated self-lubricating bronze material. Such an arrangement may provide for an extended service life of the winch assembly 20.

The second bushings 92 may include a generally square outer surface 104, a generally circular inner surface 105, and may include a flange 106. The second bushings 92 may be positioned around the first bushings 90 where the circular inner surface 105 of the second bushings 92 may generally match the circular outer surface 99 of the first bushings 90. The inner surface 100 of the first bushings 90 may also be of an appropriate shape to accommodate the shape of the drive shaft 88. By way of a non-limiting example, the inner surface 100 of the first bushings 90 may be generally hexagonal in shape to accommodate the generally hexagonal shape of the drive shaft 88. In other embodiments, the drive shaft 88 may have a cross-sectional shape that may be generally circular, oval, polygonal, pentagonal, square, rectangular and the like. In these embodiments, the inner surface 100 of the first bushings 90 may generally have a similar shape as the drive shaft, i.e., generally circular, oval, polygonal, pentagonal, square, rectangular and the like as applicable. The second bushings 92 may be fabricated from any appropriate material, such as by way of a non-limiting example, a polymeric material such as nylon.

The first and second bushings 90, 92 may support the drive shaft 88 on both sides within the winch housing 30. The combination of the first and second bushings 90, 92 may functionally transform the generally hexagonal outer surface of the drive shaft 88 to a generally circular outer surface, which may facilitate smooth and efficient rotation of the drive shaft 88 within the pockets 102, 103 of the first and second housing members 34, 38. Such an arrangement may provide for a dual drive system 81 that may function smoothly even when encountering irregularities in drum gears 46, 48 due to manufacturing and assembly processes.

In some embodiments, the two drive gears 96, 97 may be positioned on the drive shaft 88 and may be arranged to drive the winch drum 42. The drive gears 96, 97 may be positioned within the first and second housing members 34, 38 and between the bushings 90, 92. The drive gears 96, 97 may engage the winch drum 42 to drive the winch drum 42 with a generally even and balanced force. These gears 96, 97 may be slip fit over the drive shaft 88 and may function or operate generally independent of each other; or in the alternative the gears 96, 97 may function generally contemporaneously.

The symmetric positioning of the drum gears 46, 48 with respect to the winch drum 42, along with the drive gears 96, 97 of the dual drive system 81 may encourage even loading and balancing of forces when the winch drum 42 is wound and unwound. Such even loading may reduce or eliminate side load conditions that may generally limit the life of the winch drum 42. Such balanced forces may increase the service life of the winch drum 42 and the drum gears 46, 48.

The drive shaft 88 may be fabricated as a one-piece steel drive shaft with apertures 107 drilled and tapped on each end 108 of the drive shaft 88. A retaining cap 109 may be engaged with an end 108 of the drive shaft 88 by use of fasteners 110.

Typical ratchet pawl systems may only be located on one side or the other of a winch assembly, thereby limiting access if the operator is on the opposite side. The present winch assembly 20, however, may permit the ratchet and pawl system 44 to be located more centrally on the winch housing 30 making it easily accessible from either side of the winch assembly 20. Moreover, most ratchet pawl systems are made of several loose components that may be cumbersome to assemble and replace if needed. The ratchet and pawl system 44 of the winch assembly 20 may be located in the middle of the winch assembly 20 and located within the winch housing 30. This may allow fewer components to be used and may generally protect the ratchet and pawl system 44 from adverse environmental exposure.

In some embodiments, the housing 30 may include an opening 114 such as the slot shown in FIG. 4. The slot 114 may be integrally formed with the winch housing 30 and may allow for the ratchet and pawl system 44 to be mounted directly to the housing 30. More specifically as shown in FIG. 4, the second housing member 38 may be integrally formed to include the slot 114. Although, it should be understood that the slot 114 is not limited to being integrally formed in the second housing member 38. In other embodiments, the slot 114 may be located in the first housing member 34 and integrally formed therewith. In other embodiments, the slot 114 may be formed through an additional operation to the first or second housing members 34, 38. The slot 114 may allow the ratchet and pawl system 44 to be mounted in an efficient manner as further described below to generally create a clean look.

The ratchet and pawl system 44 may include a ratchet pawl 120, a ratchet spring 124, and a resilient member 128. The ratchet pawl 120 may include a lever portion 132 and a gear engaging portion 136. The lever portion 132 may fit through the slot 114 formed within the housing 30. This may allow the lever portion 132 to be accessed by the operator to operate the ratchet pawl system 44. The lever portion 132 may also include a grip 140 that may be attached thereto to make it easier for the operator to grip.

As shown in FIGS. 3 and 4, the ratchet pawl 120 may attach to the first housing member 34. In other embodiments, the ratchet pawl 120 may be attached to the second housing member 38 instead of the first housing member 34. In these embodiments, the ratchet pawl 120 may attach to the housing member 34, 38—as applicable—that may not contain the slot 114. In yet other embodiments, the ratchet pawl 120 may attach to both the first and second housing member 34, 38. By way of a non-limiting example, the first housing member 34 may include a boss 144 that may be integrally formed with the first housing member 34 on which the ratchet pawl 120 may attach. This may generally eliminate the necessity for additional fasteners and parts. Although a boss 144 is shown any integrally formed fastening mechanism that may attach the ratchet pawl 120 may be utilized. In other embodiments, a pin member 135 may be utilized to secure the ratchet pawl 110 to the appropriate housing member, i.e., the first housing member 34, second housing member 38 or both the first and second housing members 134, 138.

The ratchet spring 124 may include a first end 148 and a second end 149. The first end 148 of the spring 124 may attach the ratchet pawl 120; the second end 149 may attach to the second housing member 38 or in other embodiments it may attach to the first housing member 34. As shown in FIG. 3, the second housing member 38 may include a spring connecting portion 151, which may be integrally formed with the second housing member 38. In these embodiments, the second end 149 may attach to the spring connecting portion 151 of the second housing member 38. This may eliminate the need for additional fasteners and may reduce the number of parts required for the winch assembly 20.

The first housing member 34 may include a second boss 150 that may be integrally formed therewith. The resilient member 128 may attach to the second boss 150 such that it may engage the gear engaging portion 136 of the ratchet pawl 120, which may generally eliminate additional fasteners that may be required in other prior art winch assemblies. As shown in FIGS. 3 and 4, the resilient member 128 may be a coil spring. It should be understood that the resilient member 128 is not limited to a coil spring. It may also comprise a rubber slug, a flexible plastic slug, or the like. In operation, the resilient member 128 may retain the ratchet pawl 120 in a neutral position and may be rigid enough to retain the ratchet pawl 120 in position and resilient enough to deform to allow for operation of the ratchet and pawl system 44.

The handle 26 of the winch assembly 20 may include a grip 157. The grip 157 may be of any appropriate shape or size and be located at any appropriate position on the handle 26. By way of a non-limiting example, the grip 157 may be secured to an end 158 of the handle 26 by a fastener 159. The grip 157 may help facilitate the manual rotation of the handle 26 and may make the handle 26 easier to grip. The handle 26 may be mounted on any appropriate side of the winch housing 30, such as the left or right hand side of the winch housing 30. In some embodiments, the handle 26 may be mounted on an end of the drive shaft 88 to permit manual rotation of the handle 26 in a variety of length positions. By way of a non-limiting example, the handle 26 may be fitted with a plurality of mounting locations or apertures 164 located along the handle 26. The handle 26 may thereby be positioned at a number of different positions via the adjustment apertures 164 to either shorten or lengthen the lever arm portion of the handle 26. The handle 26 may be assembled in a variety of positions depending on need and circumstances. In some embodiments, a fastener 165 may pass through the apertures 164, which may operatively secure the handle 26 to the shaft 88. Cap screws, washers, etc., as shown in the figures, may secure the handle 26 and retaining cap 106 to the winch assembly 20. All components may be assembled with a toleranced slip fit and may be universal right to left for assembly purposes. In some embodiments, the handle 26 may be selectively positioned on the right side of the housing 30, i.e., on the first housing member 34, or may be selectively positioned on the left side of the housing 20, i.e., on the second housing member 38.

The winch assembly 20 may be arranged so that it may be secured to a towed or towing vehicle or a winch stand without accessing the inside of the winch housing 30. Such an arrangement may provide for easy and quick installation of the winch assembly 20 without concern for opening or accessing the winch housing 30, unwinding the strap, etc. The winch assembly 20 may be installed using fasteners, such as nuts, bolts and washers, from the bottom of the winch assembly 20 embodiments of which are described below.

Additional embodiments of a winch assembly according the present teachings are described below. In the descriptions, all of the details and components may not be fully described or shown. Rather, the features or components are described and, in some instances, differences with the above-described embodiments may be pointed out. Moreover, it should be appreciated that these additional embodiments may include elements or components utilized in the above-described embodiments although not shown or described. Thus, the descriptions of these additional embodiments are merely exemplary and not all-inclusive nor exclusive. Moreover, it should be appreciated that the features, components, elements and functionalities of the various embodiments may be combined or altered to achieve a desired winch assembly without departing from the spirit and scope of the present teachings.

A winch assembly 200 may include an easy installation system 210. In some embodiments, the easy installation system 210 may permit the winch assembly 200 be selectively attached to an appropriate device, such as by way of a non-limiting example, a towed or towing vehicle, a winch, stand or the like. The easy installation system 210 may be located on a bottom portion 212 of the winch assembly 200.

In some embodiments, the bottom portion 212 of the easy installation system 210 may be formed from the first and second housing members 234, 238. In some embodiments, the easy installation system 210 may be attached to the bottom portion 212 of the winch assembly 200 in any appropriate manner, such as by way of a non-limiting example, by fasteners, welding, adhesives or the like. In these embodiments, the easy installation system 210 may be secured to a plate (not shown) that may be attached to the bottom portion 212 of the winch housing 300 in any appropriate manner. In other embodiments, the easy installation system 210 may be integrally formed with the winch assembly 200, or more specifically it may be integrally formed with the winch housing 230, i.e., the bottom portion 212 of the winch assembly 200. By way of a non-limiting example, the easy installation system 210 may be die cast with the winch housing 230. In other embodiments, the easy installation system may be formed with the winch housing 230 through injection mold, gravity casting, or any other appropriate process.

In some embodiments, the first and second housing members 234, 238 may each include a portion of the easy installation system 210. In these embodiments, the easy installation system 210 may be integrally formed with the first and second housing members 234, 238, such as through die casting, injection mold, gravity casting, or any other appropriate process. In other embodiments, the easy installation system 210 may be attached to the first and second housing members 234, 238, such as by way of a non-limiting example, by fasteners, welding, adhesives or the like. In still other embodiments, the easy installation system 210 may be formed in the bottom portion 212 of the winch assembly 200 or may be formed in each of the first and second housing members 234, 238 through a subsequent process, such as by machining or the like.

The easy installation system 210 may include at least one slot 242 and at least one aperture 244. Any appropriate number of slots 242 and apertures 244 may be included, however. In some embodiments, the easy installation system 210 may include a longitudinally extending slot 242*a* and a transverse slot 242*b*. At least one of the slots 242 may include the aperture 244. In some embodiments, both slots 242 may include the aperture 244. In other embodiments, only one of the slots 242*a* or 242*b* may include the aperture 244. In some embodiments, the longitudinally extending slot 242*a* may intersect the transverse slot 242*b*, or in the alternative, the longitudinally extending slot 242*a* may not intersect the transverse slot 242*b*. The slots 242, however, may take any appropriate shape and are not limited to the general T-shaped slots 242 shown.

The easy installation system 210 may include a plurality of fasteners 250 that may selectively secure the winch assembly 200 to an appropriate device. In some embodiments, the fasteners 250 may be capable of being inserted into the apertures 244—the apertures 244 may be sized to have the heads 255 of the fasteners 250 pass through and enter the apertures 244. The slots 242 may be shaped and sized to engage and generally hold the heads 255 of the fasteners 250 such that the fasteners 250 may be selectively positionable in any appropriate position along the slots 242. The slots 242 may further allow the fasteners 250 to be held in place until a nut 265 may be threaded onto the fasteners 250. In addition, the fasteners 250 may include a generally square neck 260 such that the slots 242 along with square necks 260 of the fasteners 250 may prevent these fasteners 250 from spinning while tightening. This may simplify installation and require fewer tools. In some embodiments, keeper washers 262 may be used along with the nuts 265 to appropriately secure the fasteners 250.

Figure 7:
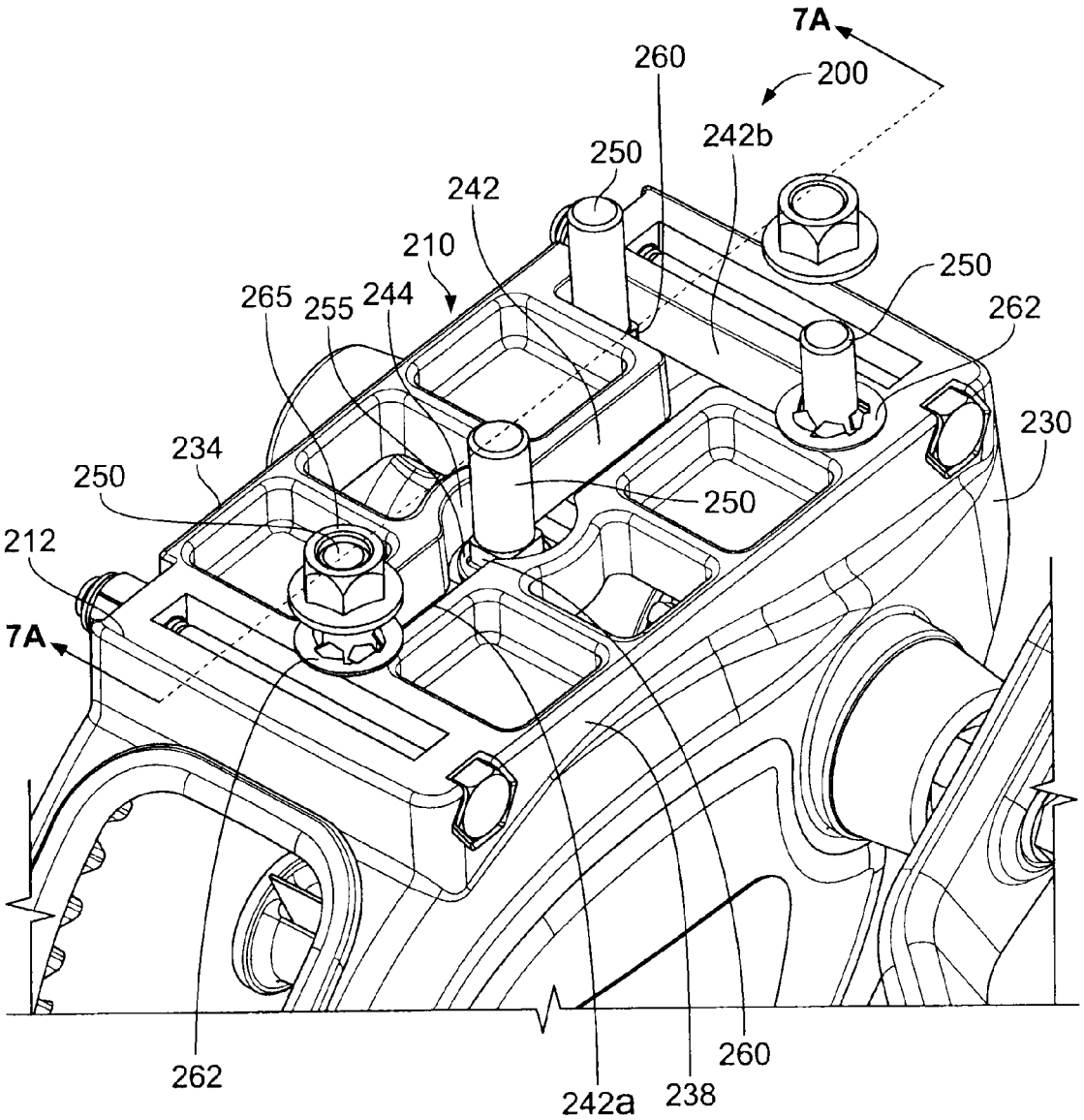
FIG. 7 is an underside perspective view of embodiments of the winch assembly.
Figure 7A:
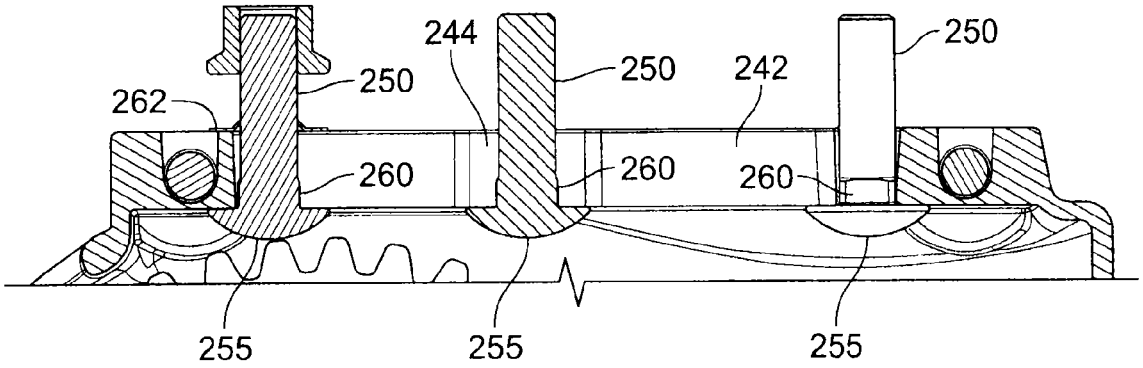
FIG. 7A is a cross-sectional view taken along line 7A-7A of FIG. 7 of a portion of the winch assembly.
Figure 8:
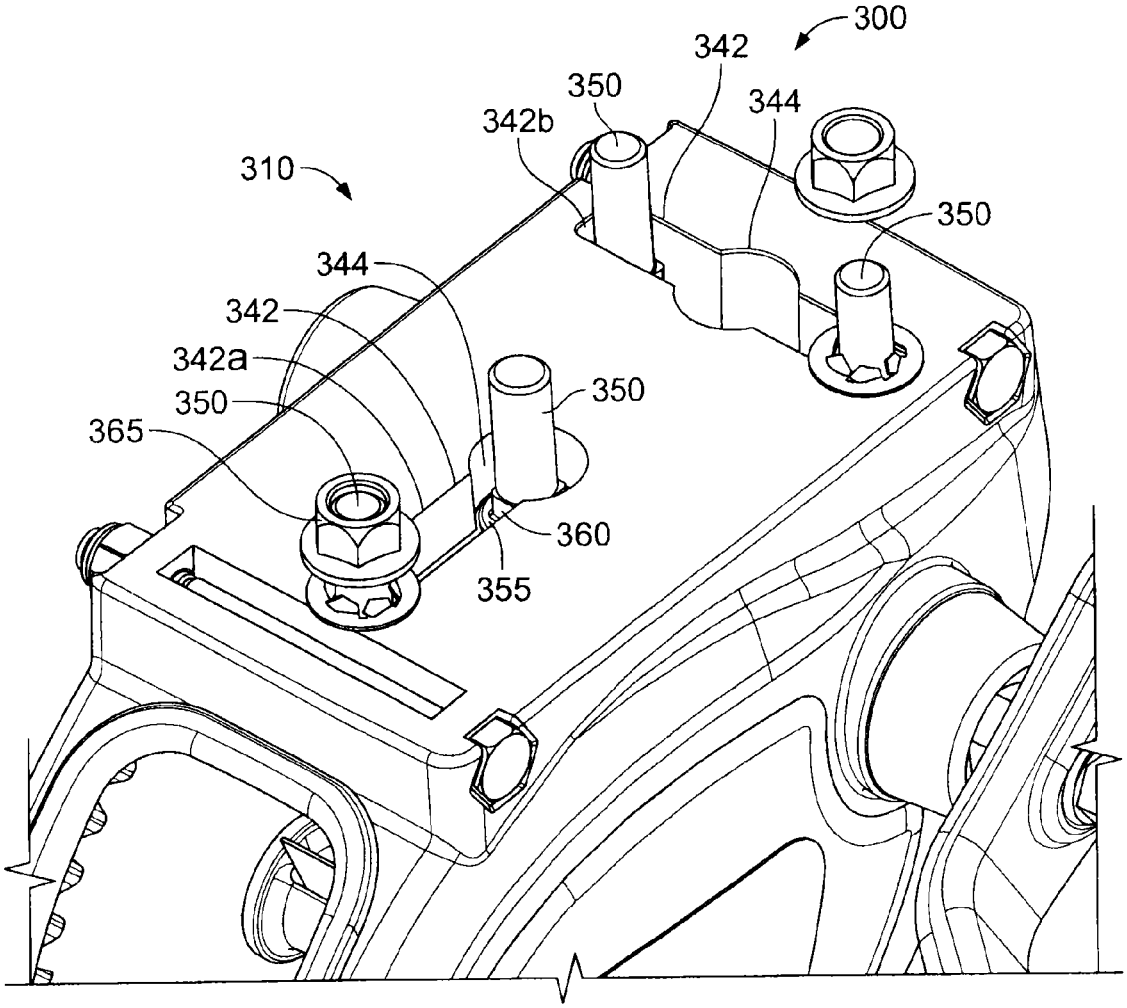
FIG. 8 is an underside perspective view of other embodiments of a winch assembly.
Figure 9:
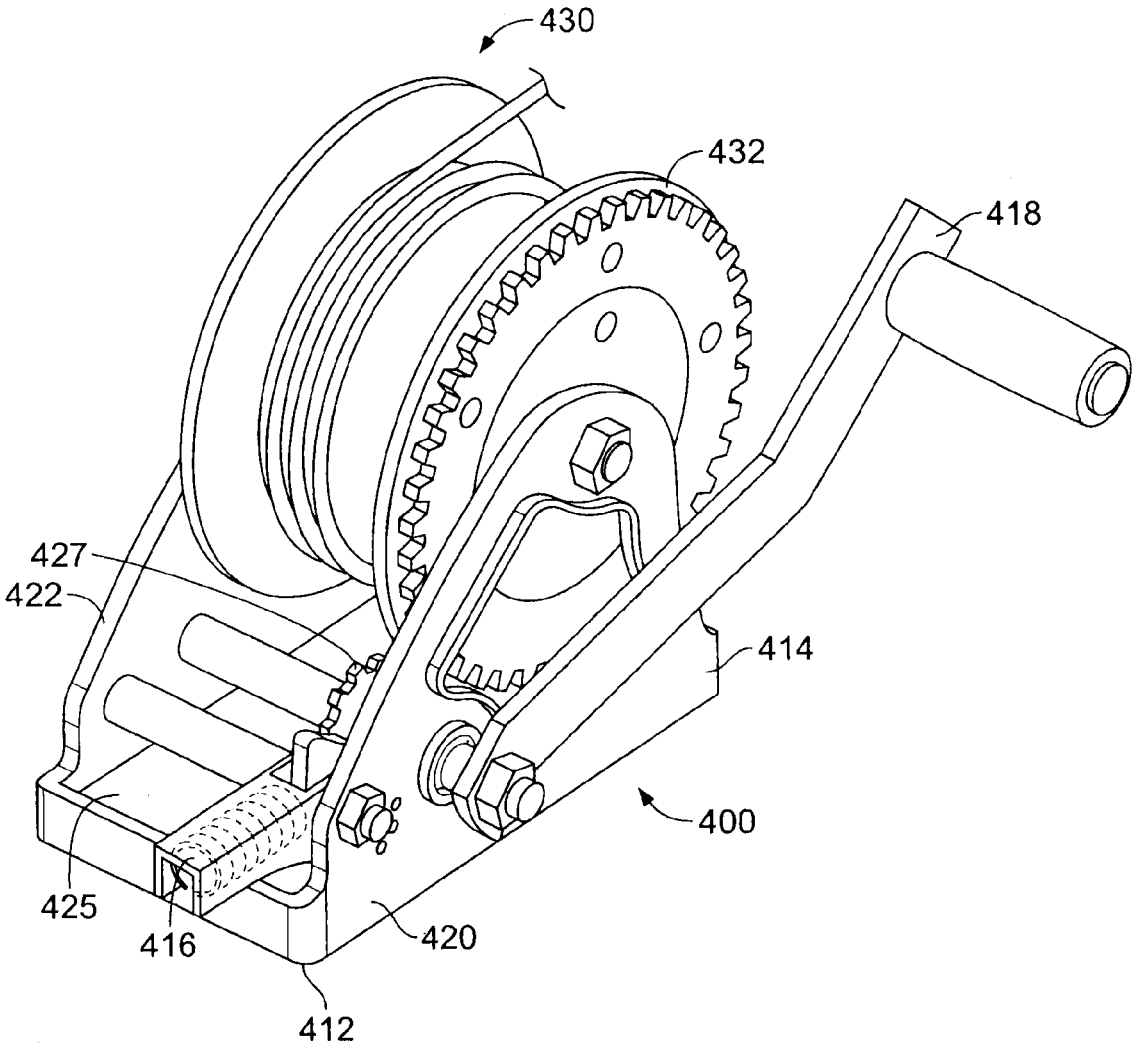
FIG. 9 is a perspective view of other embodiments of a winch assembly.

In some embodiments, the slots 242 may be substantially T-shaped and may allow for either two or three fasteners 250 to be used to selectively attach the winch assembly 200 to a winch or mounting stand. In these embodiments, three fasteners 250 may be used, two fasteners 250 may be located in the transverse slot 242*b* and one fastener 250 may be used with the longitudinal slot 242*b*, see FIG. 7. In these embodiments, a single aperture 244 may be used, but the present teachings are not limited to this configuration. Any appropriate configuration may be used. Alternatively, two fasteners 250 may be used to attach the winch assembly 200 to a winch or mounting stand. In these embodiments, one fastener 250 may be located in the transverse slot 242*b* and one fastener 250 may be used with the longitudinal slot 242*b*.

In operation, a consumer may insert the fasteners 250 from the bottom of the winch assembly 200, place the winch assembly 200 onto a winch or mounting stand, attach and tighten nuts 265 from the bottom side of the winch assembly 200. This arrangement may only require a single wrench to tighten the winch assembly 200 down. More specifically, the user may insert the heads 255 of the fasteners 250 through the aperture 244 and then selectively position the fastener 250 within the applicable slot 244 until it generally aligns with the appropriate position. Once the fasteners 250 are in the proper position within the slots 242, the nuts 265 may be used to tighten the fasteners 250 to securely attach the winch assembly 200 to the winch, mounting stand, or other applicable position.

In other embodiments, an easy installation system 310 of a winch assembly 300 may include a longitudinally extending slot 342*a* and a transverse slot 342*b*. In these embodiments, both slots 342 may include the aperture 344. Still further in these embodiments, the longitudinally extending slot 342*a* may not intersect the transverse slot 342*b*. The slots 342, however, may take any appropriate shape.

The easy installation system 310 may include a plurality of fasteners 350, which may selectively secure the winch assembly 300 to an appropriate device. In some embodiments, the fasteners 350 may be capable of being inserted into the apertures 344—the apertures 344 may be sized to have the heads 355 of the fasteners 350 pass through and enter the apertures 344. The slots 342 may be shaped and sized to engage and generally hold the heads 355 of the fasteners 350 such that the fasteners 350 may be selectively positionable in any appropriate position in the slots 342. The slots 342 may further allow the fasteners 350 to be held in place until a nut 365 may be threaded onto the fasteners 350. In addition, the fasteners 350 may include a generally square neck 360 such that the slots 342 along with square necks 360 of the fasteners 350 may prevent these fasteners 350 from spinning while the nut 365 is being tightened to the fastener 350.

Additional embodiments of a winch assembly 400 may include an easy installation system 410, such as shown in FIGS. 9-13. The easy installation system 410 may permit the winch assembly 400 to be selectively attached to an appropriate device, such as by way of a non-limiting example, a towed or towing vehicle, a winch, stand or the like. The easy installation system 410 may be located on a bottom portion 412 of the winch assembly 400 as shown.

In some prior art installation systems, hex-head fasteners may be used that require two sets of tools—one for the top and one for the bottom side. The top sides of winch assemblies often have limited access making it difficult to get the tool onto the mounting fasteners. This is especially true in winch assemblies that include a steel or stainless steel frame, including, without limitation a stamped steel frame. The winch assembly 400 may overcome some of these shortcomings.

The winch assembly 400 may include a frame 414, a ratchet 416, and a handle 418. The frame 414 may be formed from a one-piece unit and may include a pair of side walls 420, 422, which may surround a base 425. The frame 414 may be formed from steel, including, without limitation it may be formed from stamped steel. The winch assembly 400 may further include a pinion gear 427 to which the handle 418 may be operatively attached. The winch assembly 400 may also include a drum 430, which may have at least one drum gear 432. The present configuration of the winch assembly 400 is merely exemplary. The present teachings are not limited to the specific configuration shown and described. Any appropriate configuration of a winch assembly may be used without departing from the present teachings.

In some embodiments, the bottom portion 412 of the easy installation system 410 may be formed from the frame 414. By way of a non-limiting example, the easy installation system 410 may be attached to the bottom portion 412 of the winch assembly 400 in any appropriate manner, such as by fasteners, welding, adhesives or the like. In these embodiments, the easy installation system 410 may be secured to a plate (not shown) that may be attached to the bottom portion 412 of the frame 414 in any appropriate manner.

In some embodiments, the easy installation system 410 may be integrally formed with the winch assembly 400, or more specifically it may be integrally formed with frame 414, i.e., the bottom portion 412 of the winch assembly 400. By way of a non-limiting example, the easy installation system 410 may be die cast with the frame 414. In other embodiments, the easy installation system may be formed with the frame 414 through injection mold, gravity casting, or any other appropriate process. Further, the easy installation system 410 may be formed in the bottom portion 412 of the winch assembly 400 through a subsequent process, such as by machining or the like. The present easy installation system 410 may be used with the frame 414 that is formed of stamped steel.

The easy installation system 410 may include at least one slot 442 and a plurality of apertures 444—all of which may be positioned on the bottom portion 412 in a predetermined configuration. Any appropriate number of slots 442 and apertures 444 may be included without departing from the present teachings. The slot 442 may be positioned on the frame 414 in any appropriate configuration. By way of a non-limiting example, the slot 442 may extend longitudinally along the frame 414, or may extend transversely along the frame 414. Further, while a single slot 442 is shown and described any number of slots may be utilized—such slots being positioned on the frame 414 in any appropriate location.

Further, by way of a non-limiting example, the plurality of apertures 444 may include three apertures 444*a*, 444*b*, 444*c* positioned generally adjacent one another. While three apertures 444*a*, 444*b*, 444*c* are shown and described, any number of apertures may be utilized. In some embodiments, the apertures 444*a*, 444*b*, 444*c* may be adjacent one another, generally aligned and positioned transversely across the frame 414. The apertures 444*a*, 444*b*, 444*c* may also be positioned generally longitudinally across frame 414. Any appropriate configuration of the apertures 444*a*, 444*b*, 444*c* may be utilized. The present teachings are not limited to a specific configuration.

In some embodiments, the apertures 444*a*, 444*b*, 444*c* may extend generally transversely across the frame 414 and the slot 442 may extend generally longitudinally across the frame 414. In other embodiments, the apertures 444*a*, 444*b*, 444*c* may extend generally longitudinally across the frame 414 and the slot 442 may extend generally transversely across the frame 414.

The easy installation system 410 may include a plurality of fasteners 450 that may selectively secure the winch assembly 400 to an appropriate device or surface. In some embodiments, the fasteners 450 may be capable of being inserted into the apertures 444*a*, 444*b*, 444*c* and the slot 442. In such embodiments, the fasteners 450 may inserted from the interior of the winch assembly 400, e.g., through the base 425 of the frame 414, into and through the apertures 444*a*, 444*b*, 444*c* and slot 442. The fasteners 450 may include heads 455 that prevent the fasteners 450 from being inserted all the way through any one of the apertures 444*a*, 444*b*, 444*c* and slot 442, as applicable. Any appropriate number of fasteners 450 may be used without departing from the present teachings.

Figure 10:
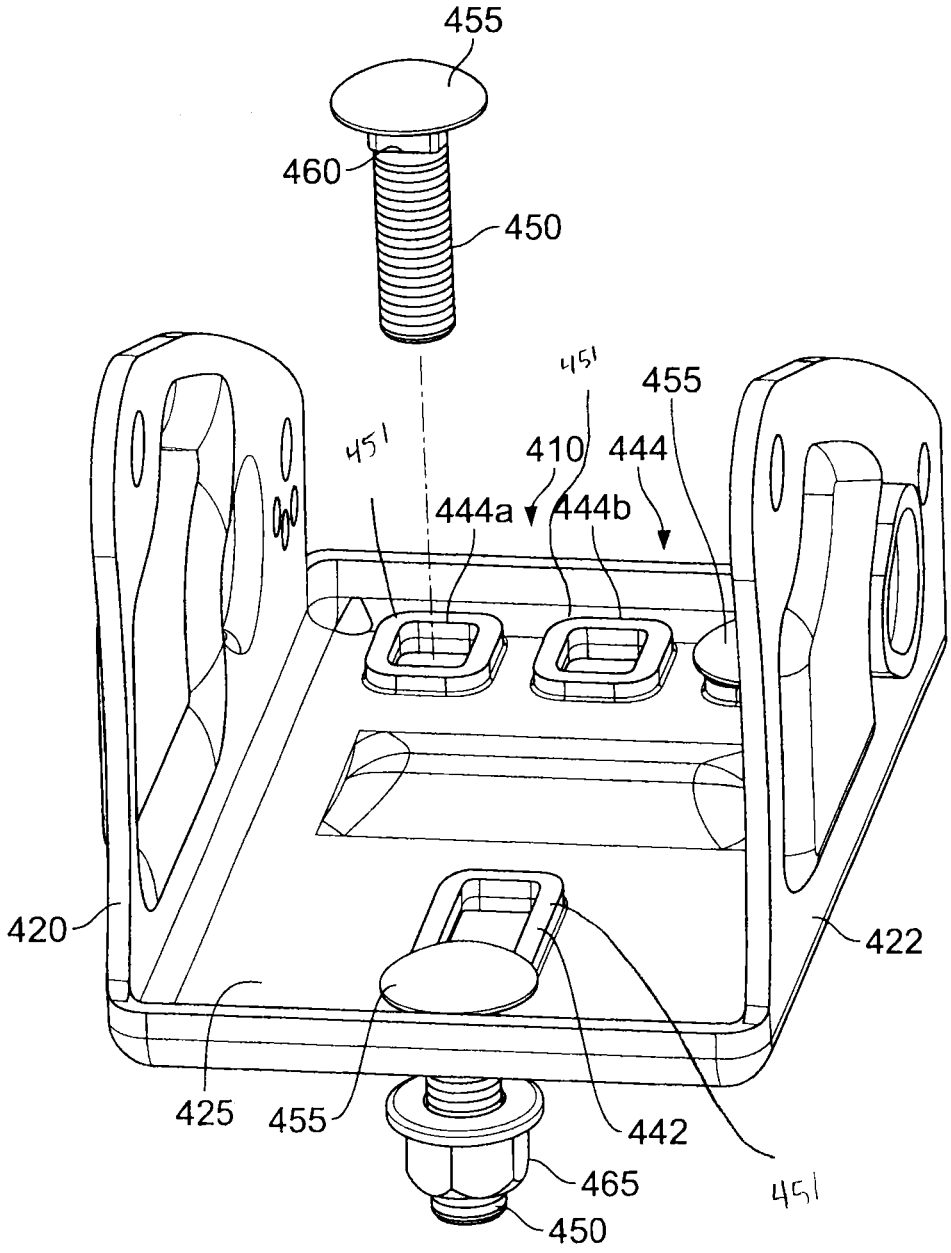
FIG. 10 is a perspective view of a portion of the winch assembly of FIG. 9.
Figure 11:
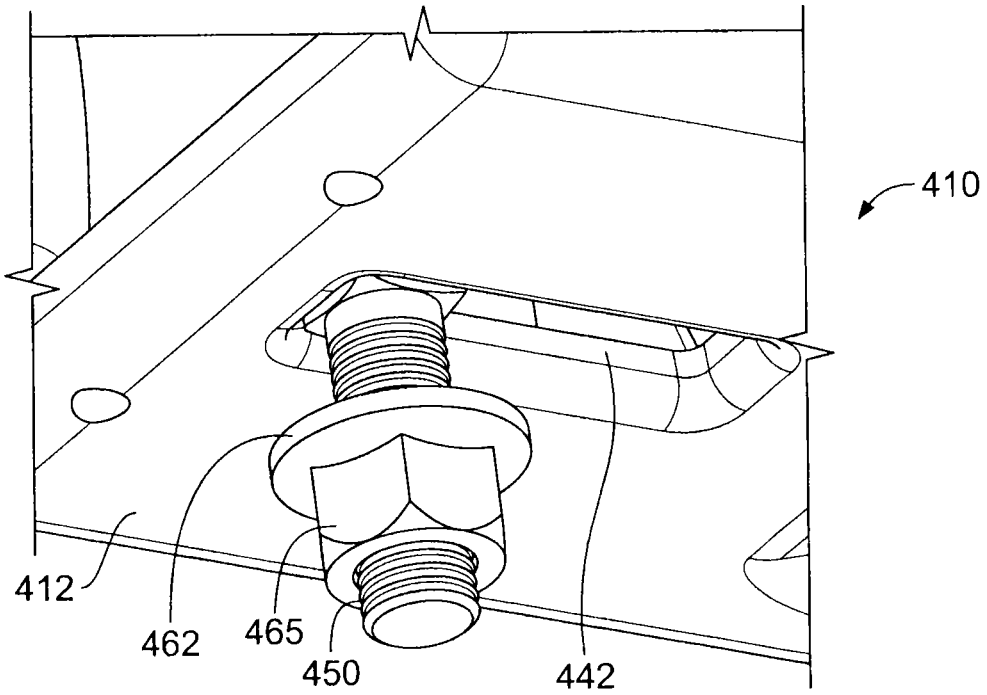
FIG. 11 is a perspective view of an underside of a portion of the winch assembly.
Figure 12:
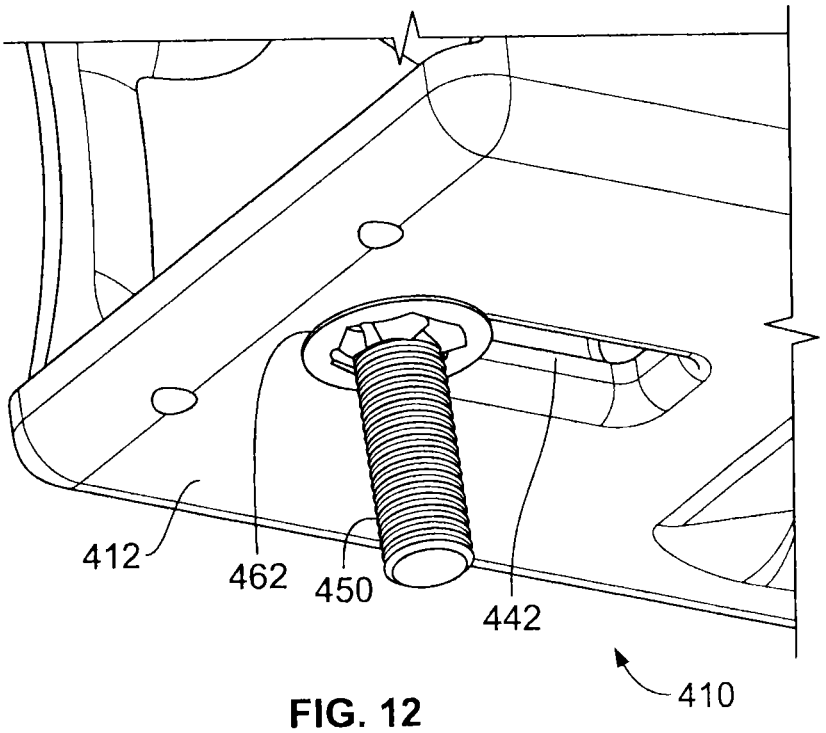
FIG. 12 is a perspective view of an underside of a portion of the winch assembly.
Figure 13:
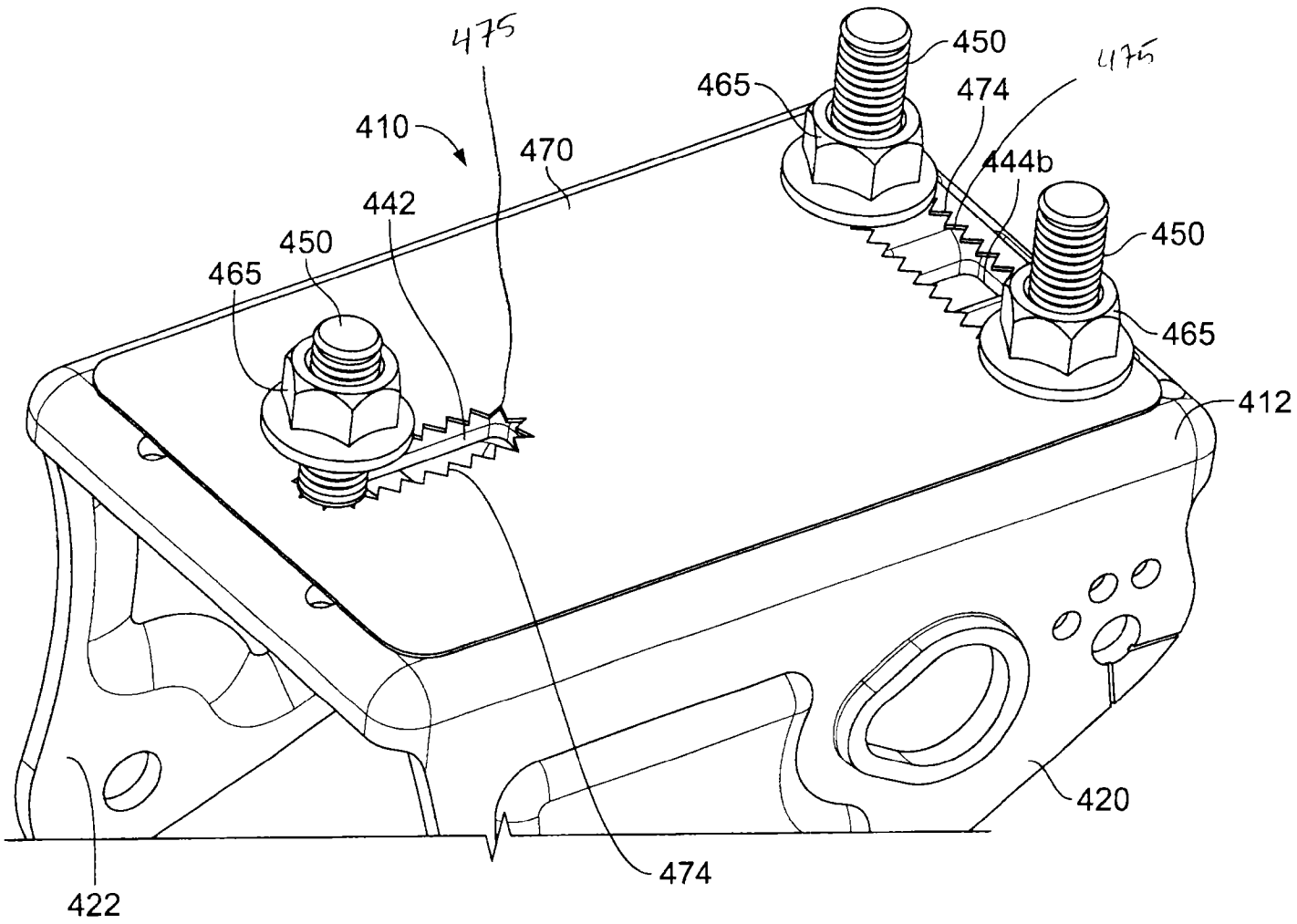
FIG. 13 is a perspective of an underside of the winch assembly.

As shown in FIG. 10, the apertures 444 and the slot 442 may each include a generally raised portion 451. The raised portions 451 may extend from the base 425. The raised portions 451 may be formed in any appropriate manner. By way of a non-limiting example, the raised portions 451 may be formed through extruding of the apertures 444 and the slot 442. The raised portions 451 provide additional clearance such that the fasteners 451 may be carriage bolts typically used with winch assemblies. Special fasteners, therefore, may not be required. The raised portions 451 provide enough space from the head 455 of the carriage bolt 450 such that the appropriate spacing for attaching the carriage bolt 450 may be maintained.

As shown in FIG. 10, three apertures 444 may be utilized with the easy installation system 410. In such embodiments, a pair of fasteners 450 may be inserted into and through two of the apertures 444*a*, 444*c*. Further, in some embodiments only a single fasteners 450 may be inserted into any one of the apertures 444*a*, 444*b*, 444*c*, or in some embodiments three fasteners 450 may be inserted into each of the three apertures 444*a*, 444*b*, 444*c*. The number and position of the fasteners 450 may depend upon the use of the winch assembly 400 and the device or surface to which the user is attaching the winch assembly 400. By way of a non-limiting example, the plurality of apertures 444 may allow the fasteners 450 to be inserted at a plurality of predetermined locations on the easy installation system 410 providing additional flexibility for securing the winch assembly 400 to a particular device or surface.

The slot 442 may be shaped and sized to engage and generally hold the heads 455 of the fastener 450 within the frame 414, i.e., the heads 455 generally prevent the fastener 450 from passing through the slot 442. Further, the fastener 450 may be of a shape and size such that it may be selectively positionable in any appropriate position along the slot 442. The user may select the appropriate location for the fastener 450 within the slot 442 by sliding the fastener 450 along the slot 442. The fastener 450 may be inserted into the slot 442 from within the winch assembly 400, i.e., through the base 425 of the frame 414.

The slot 442 and apertures 444 may permit the fasteners 450 to be held in place until a nut 465 is threaded onto the fasteners 450. The fasteners 450 may include a generally square neck 460 such that the square neck 460 may engage the slot 442 and apertures 444, as applicable. The shape of the slot 442 and apertures 444 along with square necks 460 of the fasteners 450 may generally prevent these fasteners 450 from spinning while being tightened, i.e., while the nut 465 is being tightened on the fastener 450. This may simplify installation and require fewer tools to complete the installation. In some embodiments, keeper washers 462 may be used along with the nuts 465 to assist with appropriately securing the fasteners 450. Further, the slot 442 and apertures 444 may be extruded or sumped in height to allow clearance for a height of the square neck 460 of the fasteners 450 to that the square neck 460 does not bottom out on the base 425 prior to tightening the frame 414 effectively.

In operation, a consumer may insert the fasteners 450 from the interior of the winch assembly 400, i.e., through the base 425 of the frame 414. The user may then place the winch assembly 400 onto a winch, mounting stand, or any other appropriate device or surface he or she wishes to attach the winch assembly 400. The user may then tighten nuts 465 from the bottom side of the winch assembly 400 onto the fasteners 450. This arrangement may only require a single wrench to tighten the winch assembly 400 down.

More specifically, the user may insert the fasteners 450 through any one of the plurality of the apertures 444, or a plurality of the apertures 444, and the fastener 450 may be inserted into the slot 442. The fasteners 450 may be inserted therein until the head 455 engages the base 425 generally preventing further insertion of the fasteners 450. The user may then selectively position the fastener 450 within the slot 442 until it generally aligns with the appropriately required position. Once the fasteners 450 are in the proper position within the slot 442 and apertures 444, the nuts 465 may be used to tighten the fasteners 450 to securely attach the winch assembly 400 to the winch, mounting stand, or other applicable device or surface. The slot 442 and plurality of apertures 444 may provide the necessary adjustability to attach the winch assembly 400 to its desired device. The nuts 465 being accessible from the bottom 412 of the winch assembly 400 and the square necks 465 of the fasteners may all result in the easy installation system 410 being simple to secure.

Further, to assist with installation of the winch assembly 400, the winch assembly or more precisely the easy installation system 410 may include a temporary sheeting 470. The temporary sheeting 470 may be of any appropriate shape and size. The temporary sheeting 470 may be of a shape that substantially matches that of the bottom 412 of the winch assembly 400 and may be attached to the bottom 412 in any appropriate manner, including, without limitation through adhesion. The temporary sheeting 470 may include a pair of slots 474 that when attached to the winch assembly 400 are generally aligned with the slot 442 and apertures 444, respectively. The temporary sheeting 470 may be made of any appropriate material, such as by way of a non-limiting example polymer or a more pliable material. The temporary sheeting 470 may assist the user in aligning the fasteners 450 and the winch assembly 400 with the applicable item to which the winch assembly is to be attached. The temporary sheeting 470 may keep the fasteners 450 in their predetermined position while positioning the winch assembly 400 to attach it. Specifically, the temporary sheeting 470 may frictionally engage with the fasteners 450 when inserted therethrough. The sheeting 470 may include a plurality of engaging members 475 such as the teeth shown positioned with the slots 474. The engaging members 475 may frictionally engage with the fasteners 450 as they are passed through the slots 474 to generally keep the fasteners 450 in an operative position.

Figure 14:
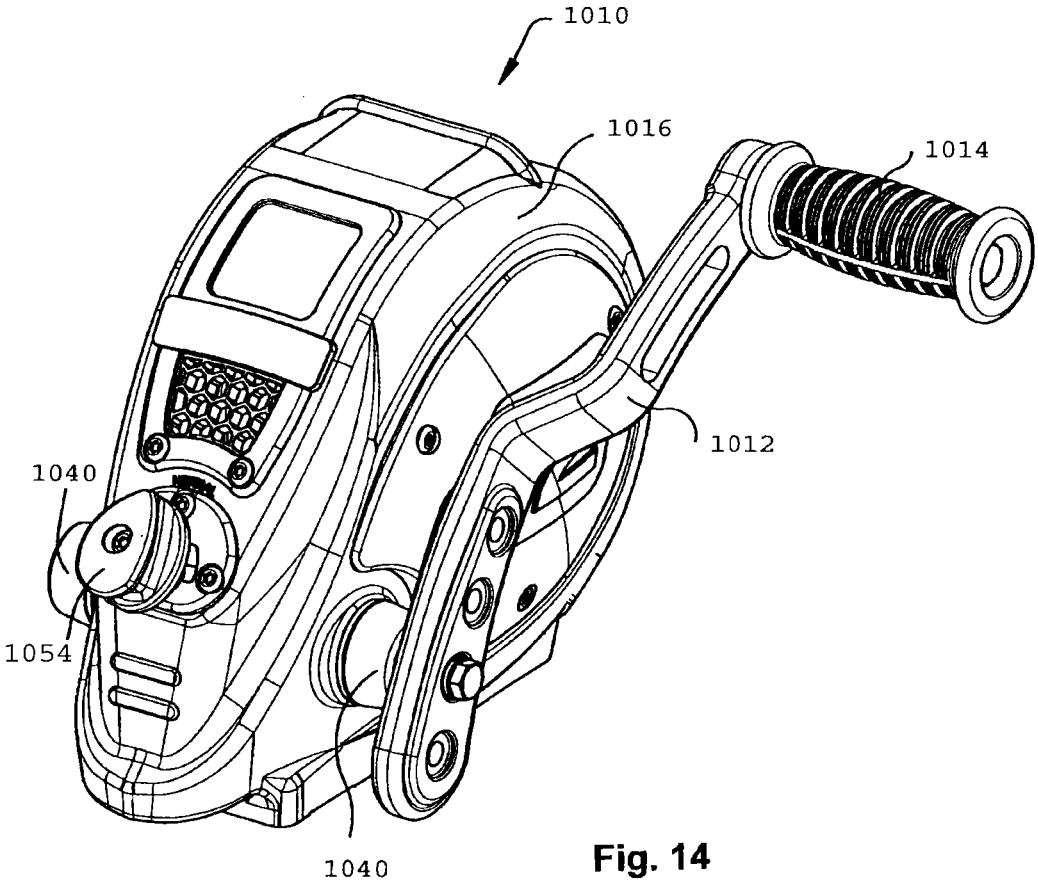
FIG. 14 is a perspective view of a winch assembly in an embodiment of the present invention.
Figure 20:
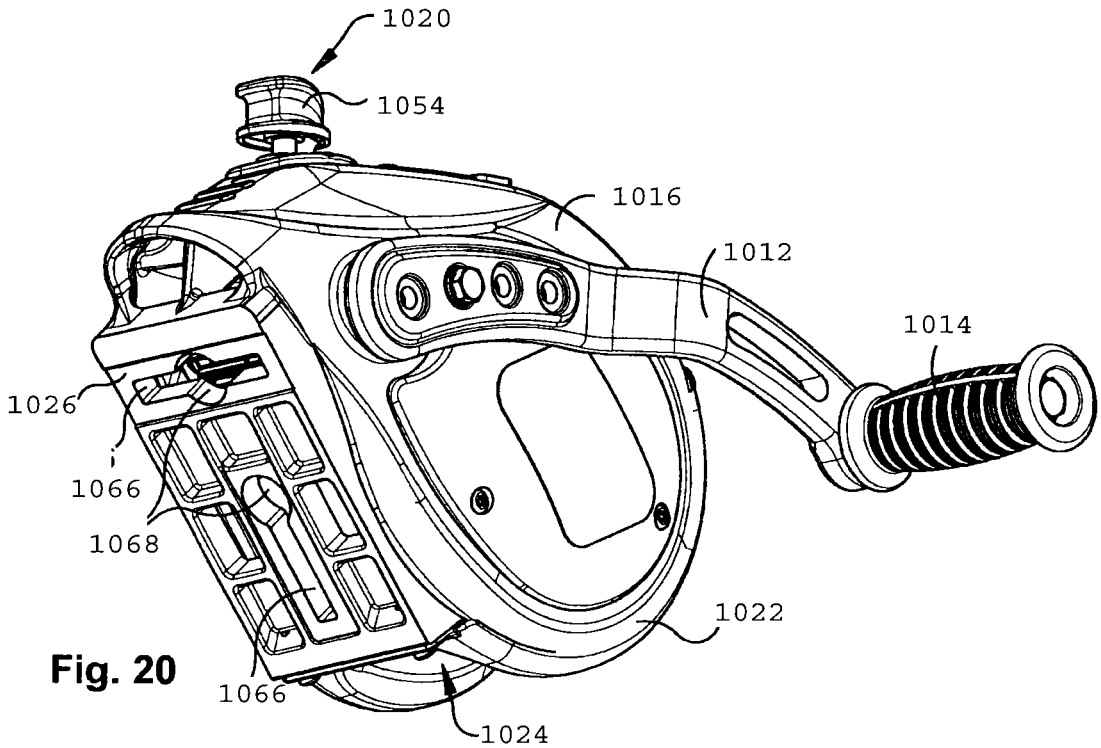
FIG. 20 is a perspective view of a winch assembly.

A winch assembly 1010 is illustrated in FIG. 14. The winch assembly 1010 may include a handle or crank 1012, a grip 1014, and a winch housing or frame 1016 that may house the internal components of the winch assembly 1010. The grip 1014 may be secured to the handle 1012 to facilitate the manual rotation of the handle 1012. As best seen in FIG. 20, the winch frame 1016 may also include a base plate 1026 that may be configured to facilitate the securing or attaching of the winch assembly 1010 to a winch stand or directly to a towing trailer, for example.

Figure 21:
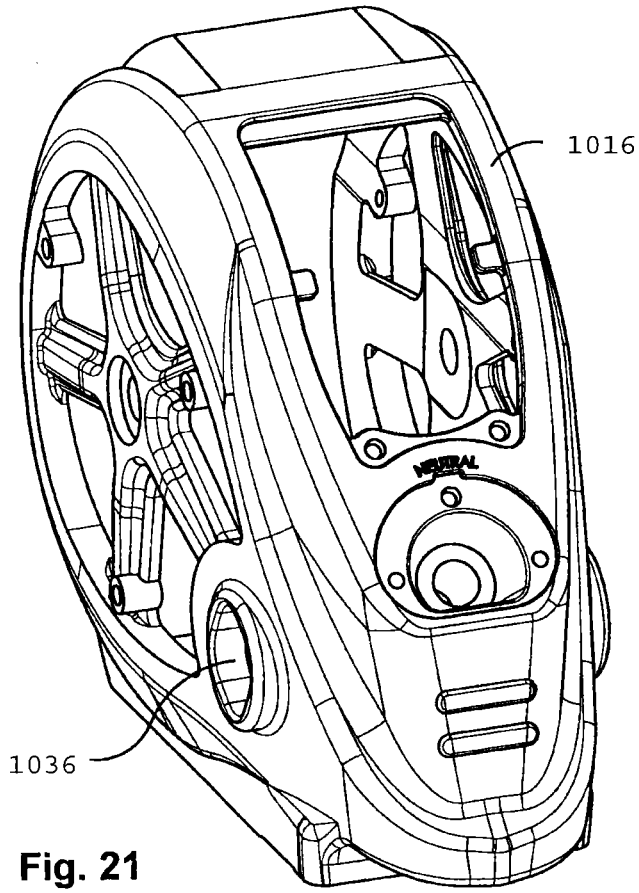
FIG. 21 is a perspective view of a frame for a winch assembly.

Most trailer winches are manufactured from a formed steel stamping. This material and process severely limits the features and aesthetics that can be incorporated into the design. As best seen in FIG. 21, the winch frame 1016 may be fabricated as a one-piece die cast aluminum component. Such an arrangement may incorporate many desirable features, allow for pleasant aesthetics, provide for a high strength construction, and may make manufacturing easier. Die casting allows for the grooves 1066 and apertures 1068 of the base plate 1026 to be incorporated into the frame 1016, allows for precision control of dimensions of the frame 1016, and allows for forming thicker sections to strengthen the frame 1016.

As shown in FIGS. 15 through 19, the winch assembly 1010 may also include a winch drum 1018 and a ratchet and pawl system 1020. The winch drum 1018 and ratchet and pawl system 1020 may be located within the winch frame 1016 for selectively driving and locking the winch drum 1020. The winch assembly 1010 may be arranged to load and unload cargo onto a towing trailer by securing a strap (not show) to the cargo.

The strap may be attached to the drum 1018 and pull cargo onto the trailer when the drum 1018 is rotated in a first direction and allow cargo to slide off the trailer when the drum 1018 is rotated in a second and opposite direction. The drum 1018 may be located within the frame 1016 and positioned on a shaft 1046, such as a pin, for example. The drum 1018 may be driven by the manual rotation of the handle 1012. Disclosed herein is a novel drive system for driving the drum 1018 to load and unload cargo. As will be described in detail, the winch drive system may be an adjustable floating winch system that may be driven by a hand operated adjustable crank handle 1012.

In an embodiment, the drive system may include a drive shaft 1028, a pair of outer bearings 1030, a pair of inner bearings 1032, and three drive gears 1034. The outer and inner bearings 1030, 1032 may be slip bearings and are positioned to hold the drive shaft 1028 to form a floating drive system. The bearings 1030, 1032 may be slip bushings that hold the drive shaft assembly in place creating a floating hex drive system. The drive shaft 1028 may be hexagonal in cross-sectional shape. The three drive gears 1034 may be slip fit onto the hexagonal drive shaft 1028, and each drive gear 1034 operates independent of the other two drive gears 1034.

The outer bushings 1030 may have a generally square outer surface, a generally circular inner surface, and include a flange. The outer bushings 1030 may slide into coaxial apertures 1036 in the winch frame 1016. The frame apertures 1036 may be arranged to match the generally square outer surface of the outer bushing 1030 so that the outer bushing 1030 will not rotate when located in the frame aperture 1036. In one embodiment, outer bushings 1030 may be fabricated from a polymeric material such as nylon.

The inner bushings 1032 may have a generally circular outer surface and include a flange. The inner bushings 1032 may be positioned within the outer bushings 1030, where the circular inner surface of the outer bushings 1030 matches the circular outer surfaces of the inner bushings 1032. The inner surface of the inner bushings 1032 may have a hexagonal shape to accommodate the hexagonal shape of the drive shaft 1028. In an embodiment, the inner bushing 1032 may be fabricated from an oil impregnated self-lubricating bronze material. Such an arrangement may provide for an extended service life.

As will be understood, the outer and inner bearings 1030, 1032 may support the drive shaft 1028 within the winch frame 1016. The combination of the bearings 1030, 1032 functionally transforms the hexagonal outer surface of the drive shaft 1028 to a circular outer surface to facilitate smooth and efficient rotation of the drive shaft 1028 within the apertures 1036 of the frame 1016. As will further described below, such an arrangement provides for a drive system that functions smoothly even when encountering irregularities in drum gears due to manufacturing and assembly processes such as stamping and welding.

The three drive gears 1034 positioned on the drive shaft 1028 may be arranged to drive the winch drum 1018 and to facilitate the locking of the drum 1018. The drive gears 1034 may be positioned within the frame 1016 and between the left and right bushings 1030, 1032. The two outer drive gears 1034*a*, 1034*c* may engage the drum 1018 to drive the drum 1018. The drum 1018 may be fabricated with an integral pair of drum gears 1038. The two outer drive gears 1034*a*, 1034*c* may engage the pair of drum gears 1038 to drive the drum 1018 with an even and balanced force. As will be further described below, the middle drive gear 1034*b* may function as a ratchet type plunger engagement device to control the locking and release of forward and reverse rotational motion of the winch drum 1018. These gears 1034 may be slip fit over the drive shaft 1028 and function or operate independent of each other.

Figure 23B:
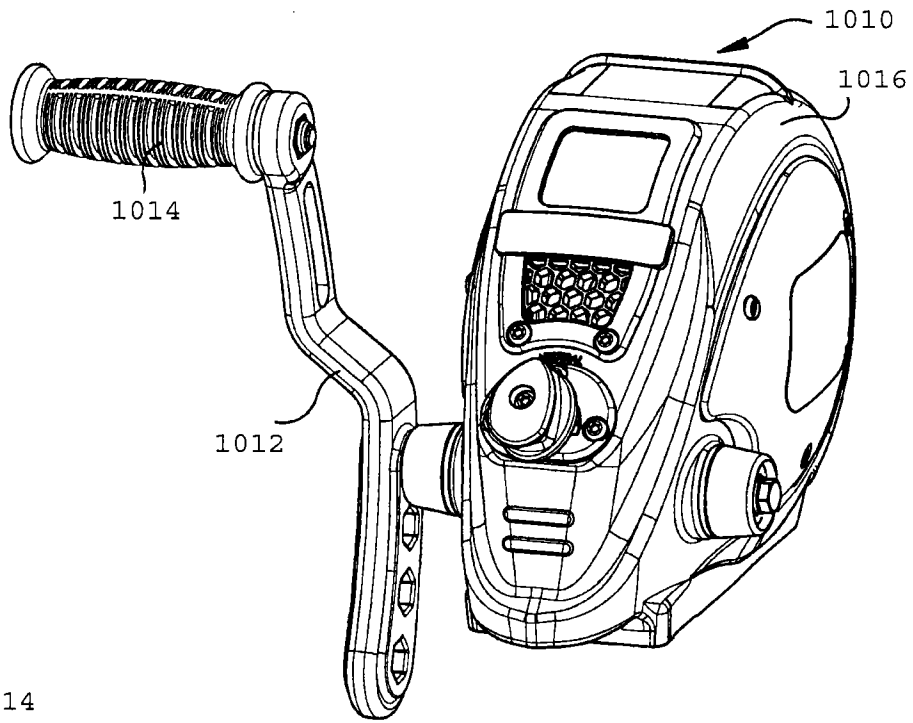
FIGS. 23A and 23B are perspective views of a handle attached for the left side and right side of a winch assembly.
Figure 23A:
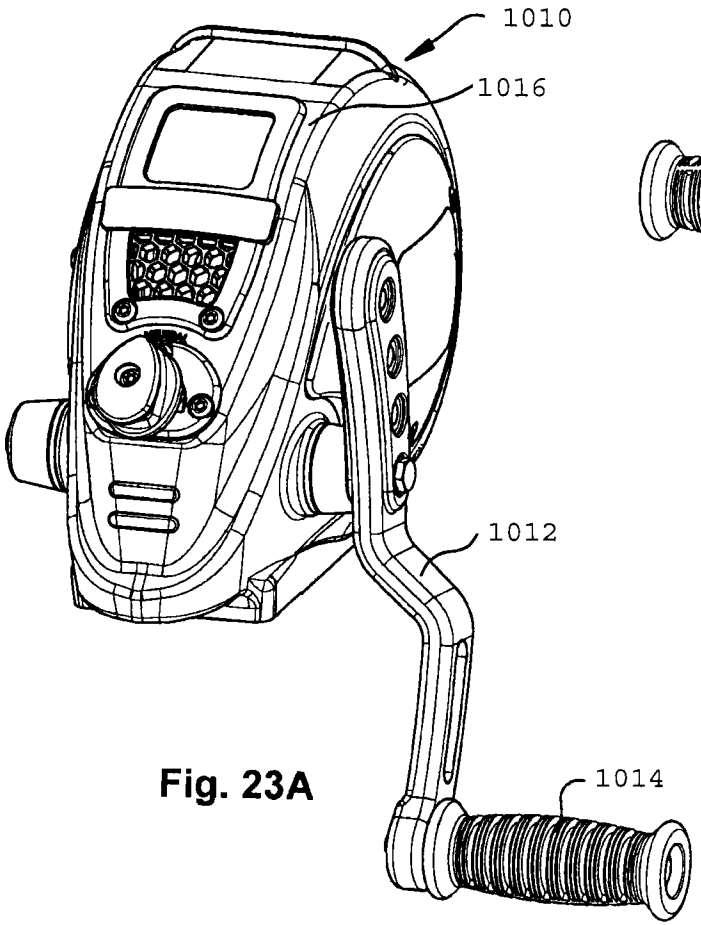

In an embodiment, the drive shaft 1028 may be fabricated as a one-piece steel drive shaft with apertures drilled and tapped on each end. Retaining caps 1040 may be engaged with each end of the drive shaft 1028 to hold the drive shaft 1028 within the frame 1016. Stainless steel washers 1042, such as shim washers, may also be used to prevent wear between bushing surfaces. As illustrated in FIGS. 23A and 23B, the handle 1012 may then be mounted on either end of the drive shaft 1028 to permit right hand or left hand manual rotation of the handle 1012 in a variety of possible length positions. The handle 1012 and retaining cap 1040 may be held in place by fasteners.

Figures 24A, 24B, 24C:
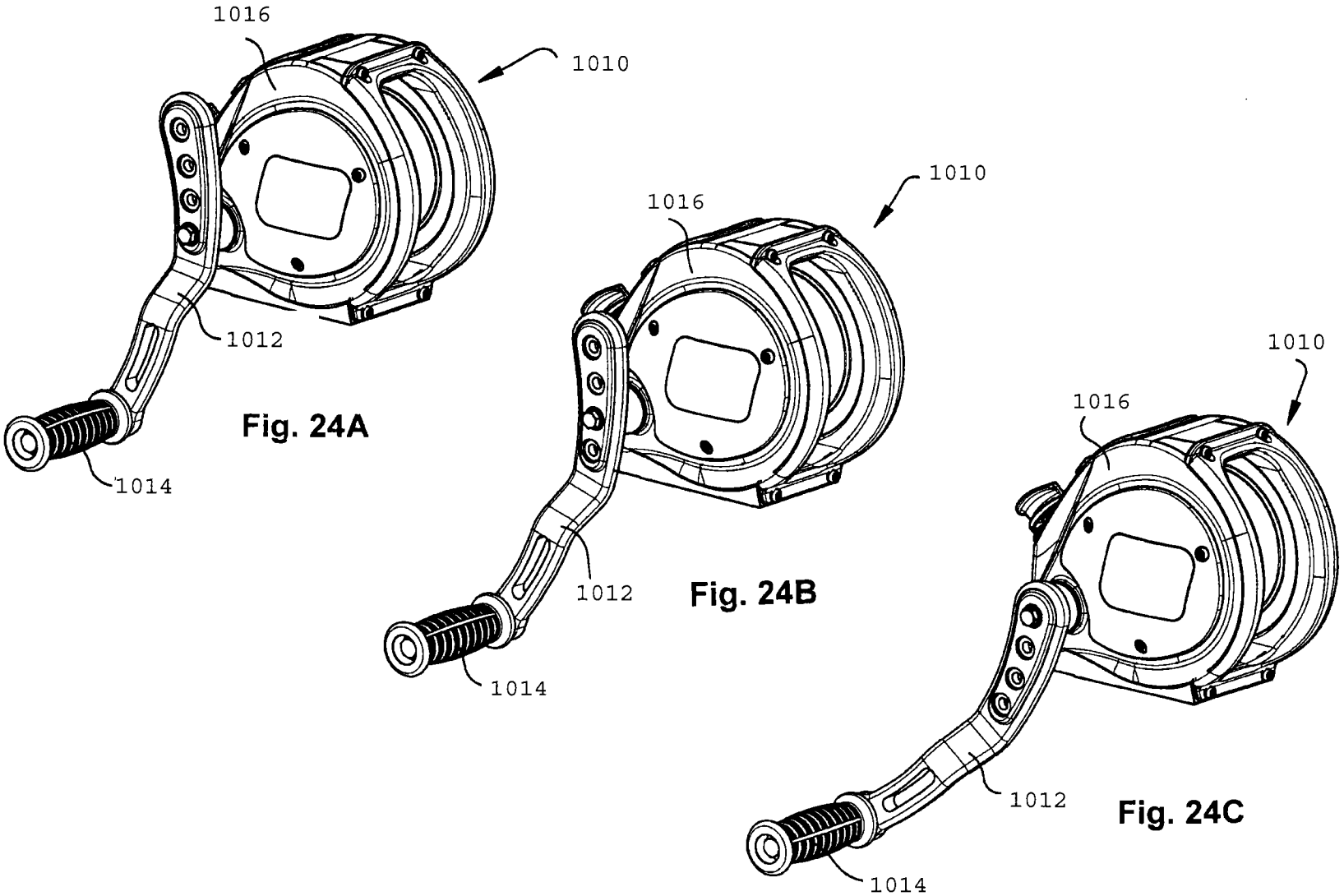
FIGS. 24A-24C are perspective views of a handle attached to a winch assembly at varying positions.

In addition, as illustrated in FIGS. 24A-24C, the handle 1012 may also include a number of adjustment apertures 1044 located along the handle 1012. The handle 1012 may thereby be positioned at a number of different positions via the adjustment apertures 1044 to either shorten or lengthen the lever arm portion of the handle 1012. As will be understood, between the varying lengths and attaching the handle 1012 on the left and right sides of the winch assembly 1010, the handle 1012 may be assembled in a variety of positions depending on need and circumstances. Cap screws, washers, etc., as shown in the figures, may secure the handle 1012 and retaining cap 1042 to the winch assembly 1010. In an embodiment, all components are assembled with a toleranced slip fit and are universal right to left for assembly purposes.

Typical ratchet pawl systems are only located on one side or the other of a winch thereby limiting the access if the operator is on the opposite side. In addition, most ratchet pawl systems are made of several loose components that may be cumbersome to assemble and replace if needed. The ratchet and pawl system 1020 of the present application is located in the middle of the winch 1010 thereby making it easily accessible from either side.

Figure 25C:
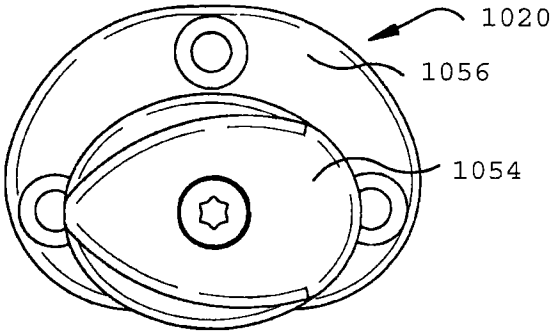
FIGS. 25A-25C are views of a ratchet system for a winch assembly.
Figure 25A:
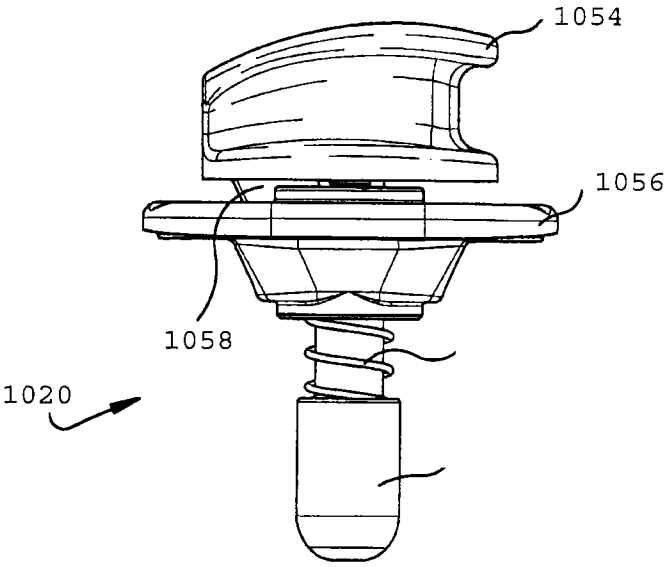
Figure 25B:
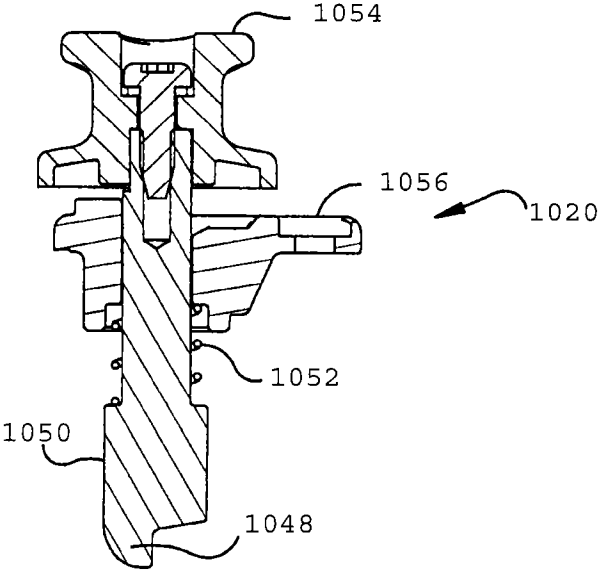

The ratchet and pawl system 1020 may be mounted in the center of a symmetrical winch frame 1016 as a separate and self-contained one piece assembly, as shown in FIGS. 25A-25C. Such positioning makes the ratchet and pawl system 1020 accessible from either side of the assembly 1010. The winch frame 1016 may be made such that the ratchet pawl assembly 1020 fits into the frame 1016 protecting it. This frame 1016 enclosure also enables strength characteristics allowing the pin 1050 to be captured as close to the gear 1034*b* as possible. The knob 1054 has a protrusion 1058, as best seen in FIGS. 17 and 25A, that works with the mating insert bushing 1056 that will seat the neutral position and if turned partially, will ramp down into the desired engaged or disengaged position, so that the knob 1054 may self align itself into place easily from the neutral position or if only turned partially.

Figure 18:
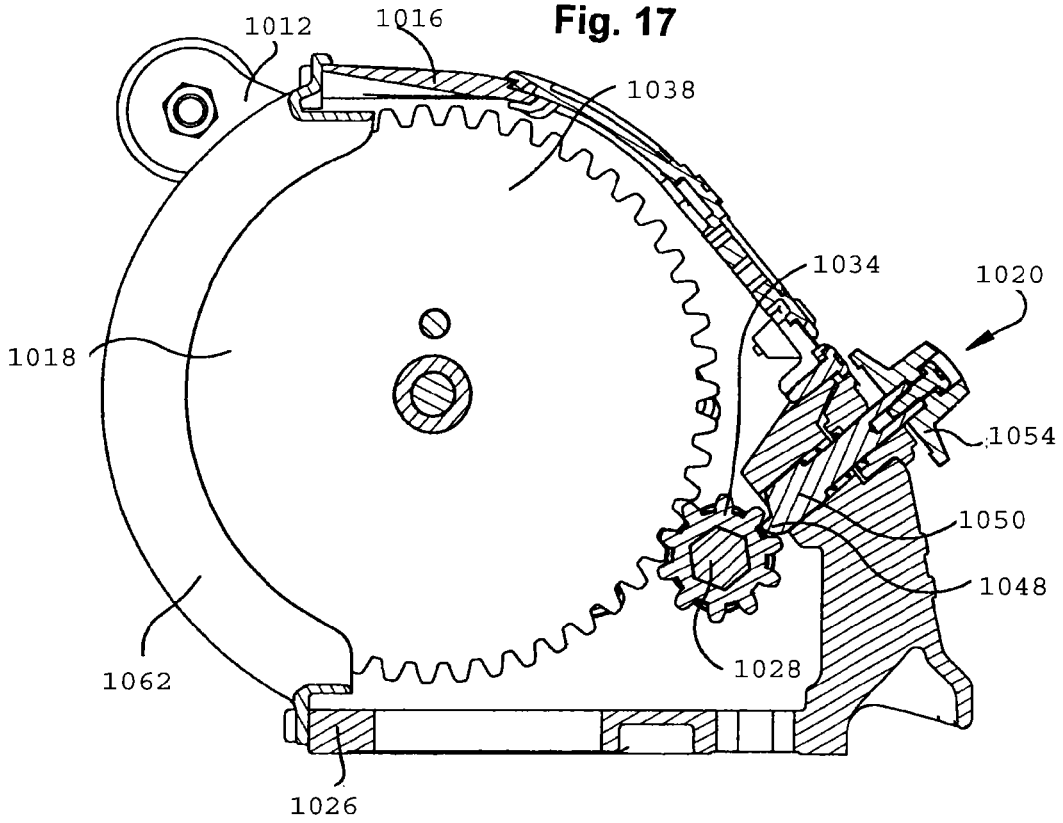
FIG. 18 is a cross-sectional view of the winch assembly taken along line 5-5 of FIG. 16.

As best shown in FIGS. 18 and 25B, the pin 1050 may include a lip 1048 located at one end. As will be understood, the lip 1048 of the pin 1050 may contact the middle drive gear or ratchet 1034*b* and not the outer drive gears 1034*a*, 1034*c*, thus, reducing wear by spreading the contact points over several gears. The pin 1050 may be in contact with a spring 1052 and a knob 1054. The pin 1050 may pass through a bushing 1056 such that the knob 1054 is accessible from the outside of the housing 1016; however, the pin 1050 is located within the housing 1016.

Figure 16:
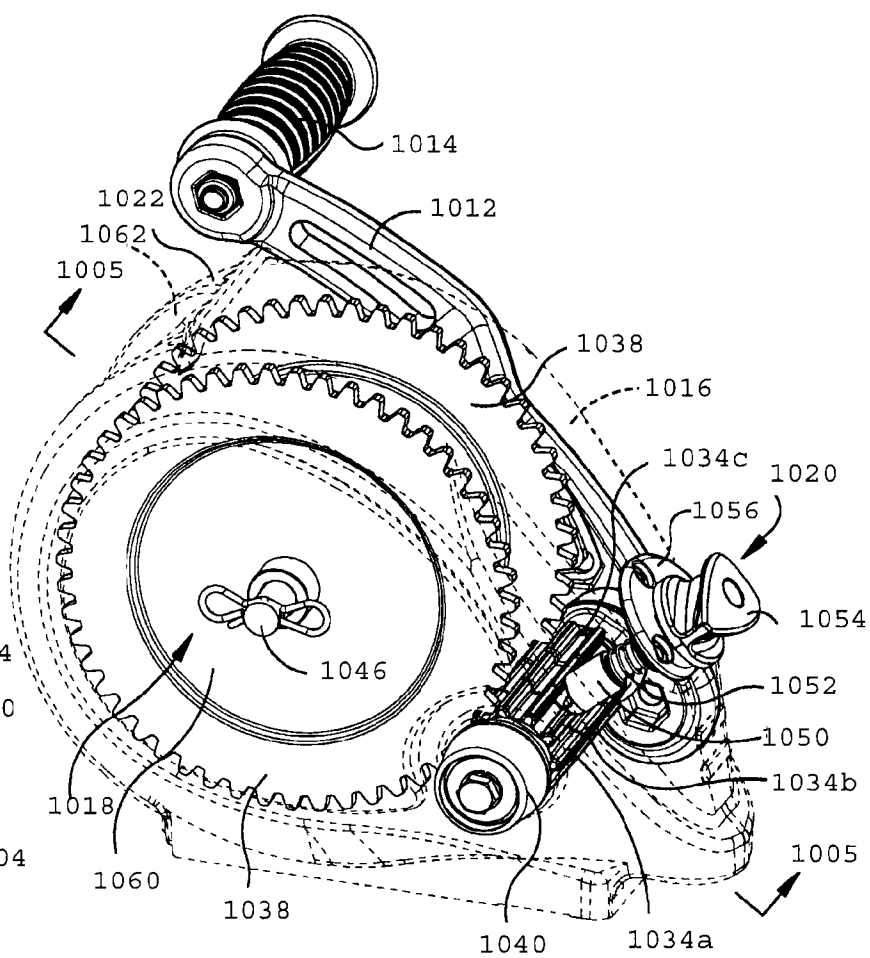
FIG. 16 is a perspective view of internal mechanisms of the winch assembly of FIG. 14.
Figure 15:
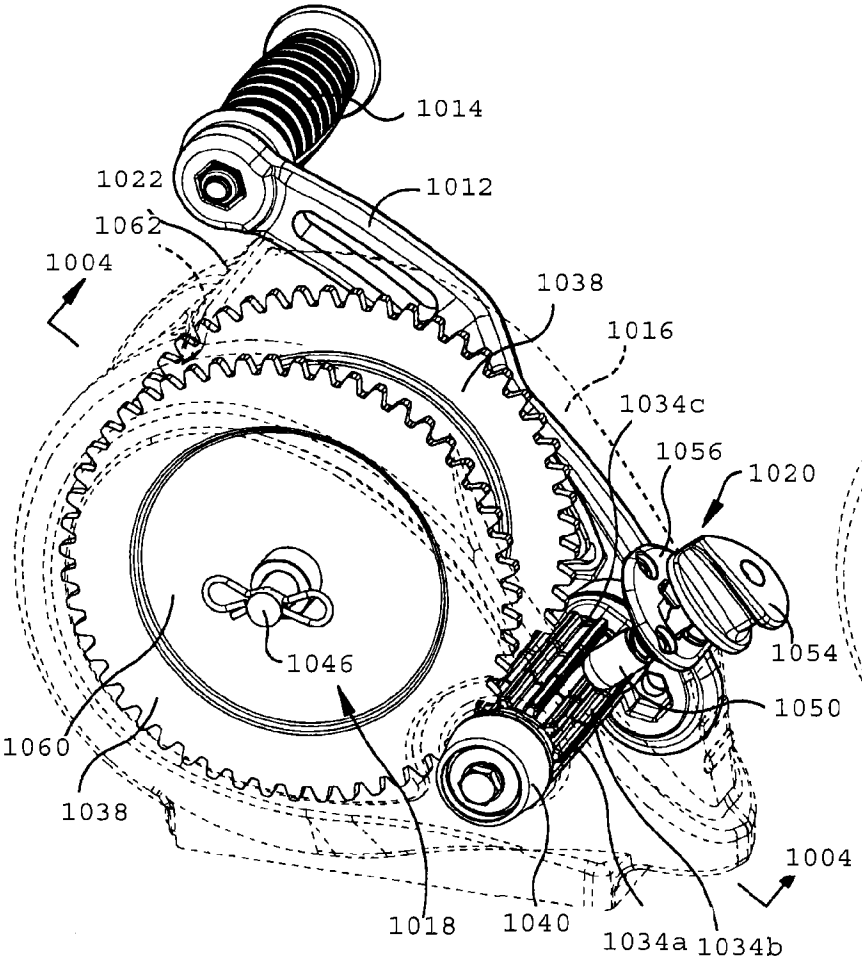
FIG. 15 is a perspective view of internal mechanisms of the winch assembly of FIG. 14.
Figure 17:
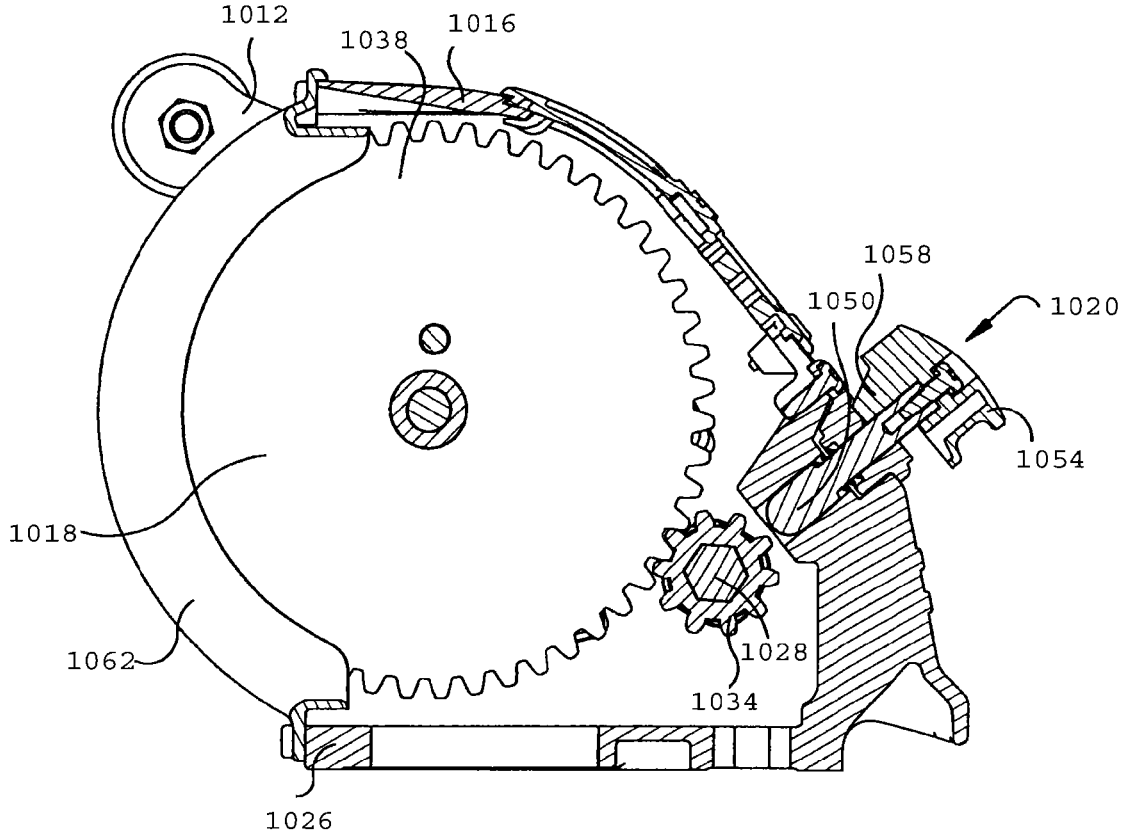
FIG. 17 is a cross-sectional view of the winch assembly taken along line 4-4 of FIG. 15.

The bushing 1056 and knob 1054 may be arranged such that features on the bushing 1056 and knob 1054 provide for the knob 1054 to be selectively positioned to engage the pin 1050 with the middle drive gear or ratchet 1034*b* (as seen in FIGS. 16 and 18) or be selectively positioned to disengage the pin 1050 from the ratchet 0134*b* (as seen in FIGS. 15 and 17). In one embodiment, the spring 1052 may bias the pin 1050 into engagement with the ratchet 1034*b*. The system 1020 may also be arranged to self align for easy placement of the pin 1050 in contact with the middle drive gear or ratchet 1034*b* when the knob 1054 is only partially turned.

In one embodiment, for example, the ratchet and pawl system 1020 may be positioned generally through the centerline of a symmetrical winch assembly 1010 and is a separate, self-contained assembly. The winch frame 1016 may be arranged such that the ratchet and pawl system 1020 may be housed within the frame 1016 to prevent unnecessary damage to components. Such positioning also allows for a shorter pin 1050 because of its proximity to the ratchet 1034*b*. Such an arrangement places less bending forces on the pin 1050 and increases the service life of the pin 1050.

Similar to the description above, the knob 1054 may have a protrusion that mates with recesses in an insert component (such as a bushing) to seat the knob 1054 in a neutral position, i.e., a position where the pin 1050 is disengaged from the ratchet 1034*b*. However, a partial turn of the knob 1054 would allow the spring 1052 to bias the pawl 1050 into contact and engagement with the ratchet 1034*b*.

As discussed above, the winch drum 1018 may include a pair of drum gears 1038 symmetrically positioned at the sides of the drum 1018. The drum 1018 may be manufactured or fabricated so that the drum gears 1038 are integrally formed with the drum 1018, i.e., the pair of drum gears 1038 and the drum 1018 are one singular, unitary component. Such fabrication eliminates the need for welding, riveting, or otherwise securing gears to a drum. The symmetric positioning of the drum gears 1038 with respect to the drum 1018, along with the dual drive gears 1034 of the drive system encourages even loading and balancing of forces when the drum 1018 is wound and unwound. Such even loading reduces or eliminates side load conditions that may damage the drum 1018. Such balanced forces may increase the service life of the drum 1018 and the drum gears 1038.

Figure 19:
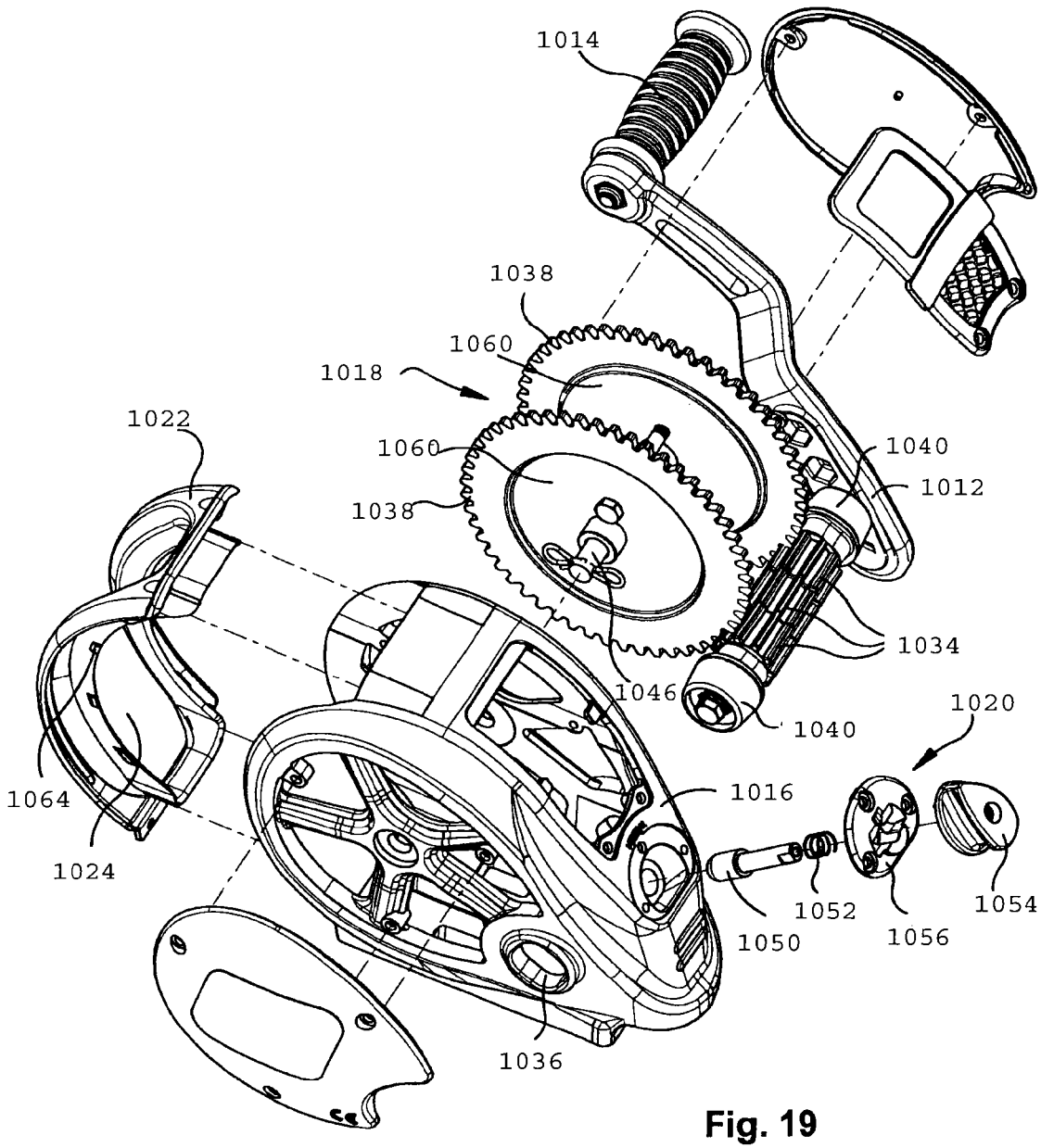
FIG. 19 is an exploded view of a winch assembly in an embodiment of the present invention.
Figure 22:
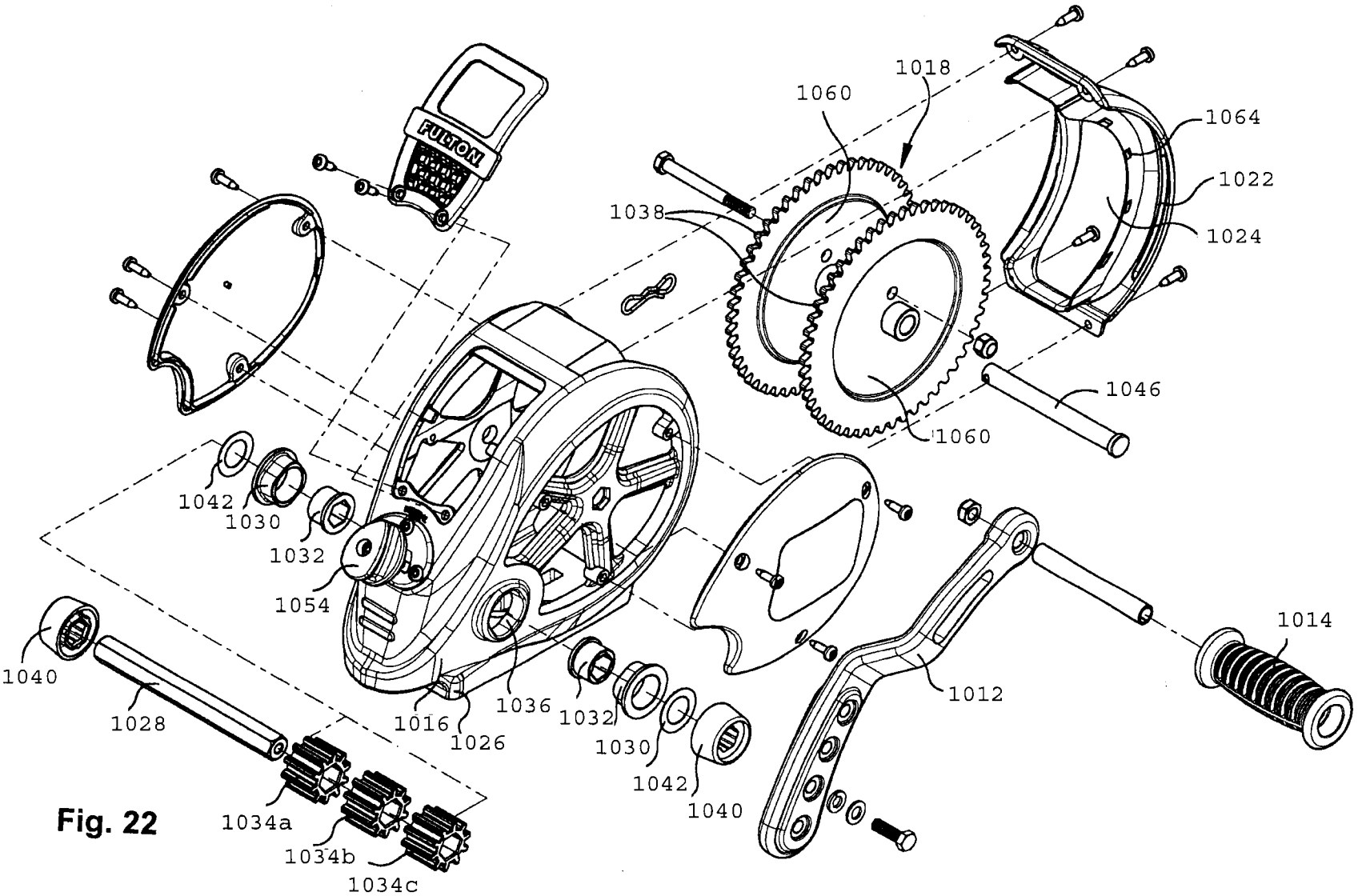
FIG. 22 is another exploded view of a winch assembly.

The drum 1018, along with the rear cover 1022, may guide the strap such that the strap experienced less wear and tear and is protected against grease from the gears and other contaminants. The drum 1018 may include a sump 1060 protruding from the inner side of each drum gear 1038 (as best seen in FIGS. 19 and 22). The sump 1060 may extend from the inner surface of the drum gears 1038 so as to encourage a retracting strap towards the center of the drum 1018 and away from the teeth of the drum gears 1038.

Such an arrangement results in a reduction or elimination of instances when the strap engaging or becoming entangled with the drum gears 1038, which would cause damage and other wear, along with potentially contaminating the strap with grease. In addition, as will be described in detail below, the sumped sides 1060 also encourage a strap guide to nest inside the rear cover 1022 further protecting the strap from wear and or contamination.

The winch assembly 1010 may also include a rear cover 1022 with an opening 1024 to accommodate the winding and unwinding of a strap or cable from the winch drum 1020. As best seen in cross-sectional views of FIGS. 17 and 18 and in FIG. 19, the opening 1024 may allow movement of the strap into and out of the winch assembly 1010. The rear opening 1024 may include material that wraps around the opening towards the drive gears 1038 to form a strap guide 1062.

The strap guide 1062 may extend into the housing 1016 sufficiently to protect the strap against contact with the drum gears 1038, specifically protection against contact with the teeth of the drum gears 1038. Thus, further protecting the strap from damage, wear, grease and contaminants. As will be understood, the strap guide 1062 may provide the strap with a smooth, clean port for entry and exit from the winch assembly 1010. The strap guide 1062 may include protrusions 1064 to protect the strap guide 1062 from contacting the teeth of the drum gears 1038. The protrusions 1064 run on the smooth portion of the drum gears 1038 and avoid contact with the gear teeth. In addition, the strap guides 1062 may enclose the potentially sharp edges of the winch frame 1016, further protecting the strap and uses of the winch assembly 1010 from potential damage and injury.

The winch assembly 1010 may be arranged so that it may be secured to a towing trailer or a winch stand without accessing the inside of the winch housing 1016. Such an arrangement provides for easy and quick installation of a winch assembly 1010 without concern for opening or accessing the housing 1016, unwinding the strap, etc. A winch assembly 1010 may be installed using fasteners such as bolts from the bottom of the winch assembly 1010.

Figure 26B:
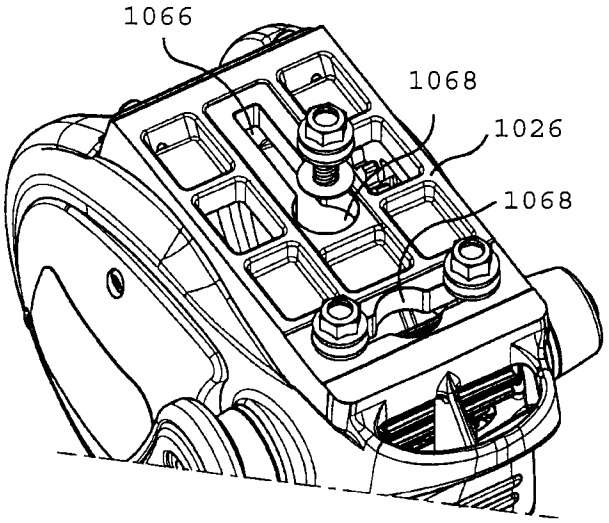
FIGS. 26A and 26B are perspective views of the bottom plate of a winch frame of a winch assembly.
Figure 26A:
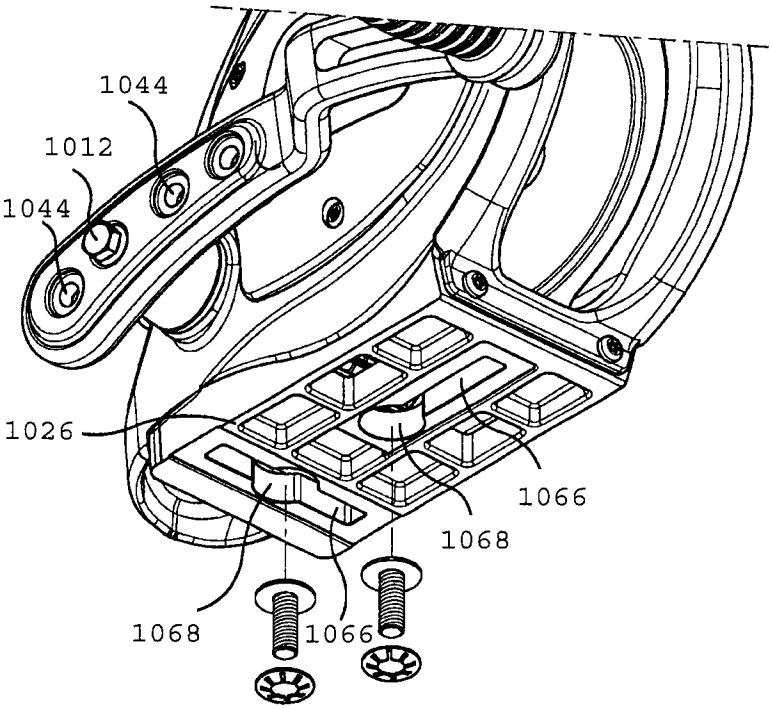
Figure 27A:
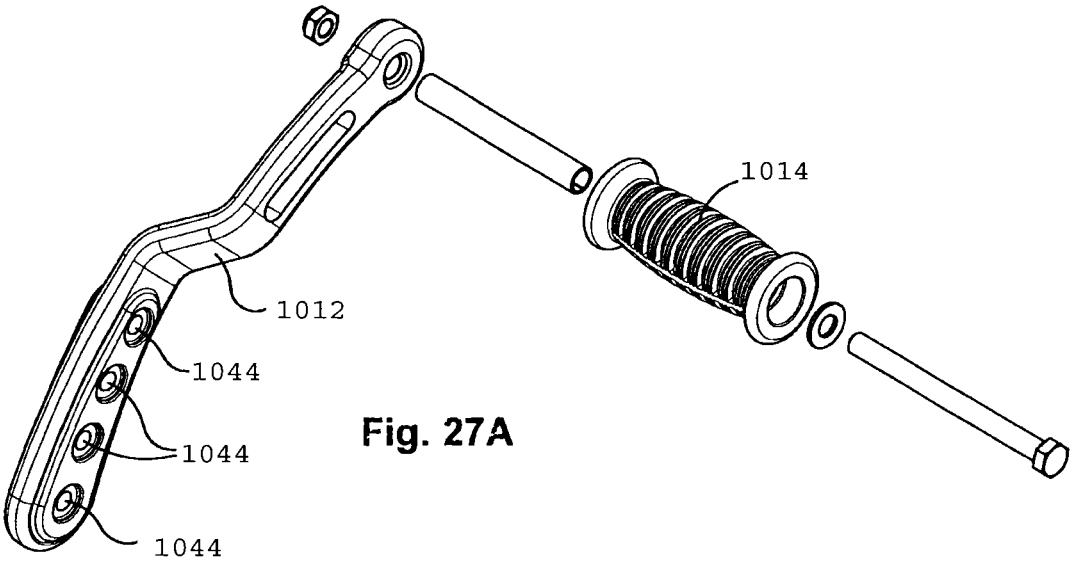
FIGS. 27A and 27B are perspective views of a handle for a winch assembly.
Figure 27B:
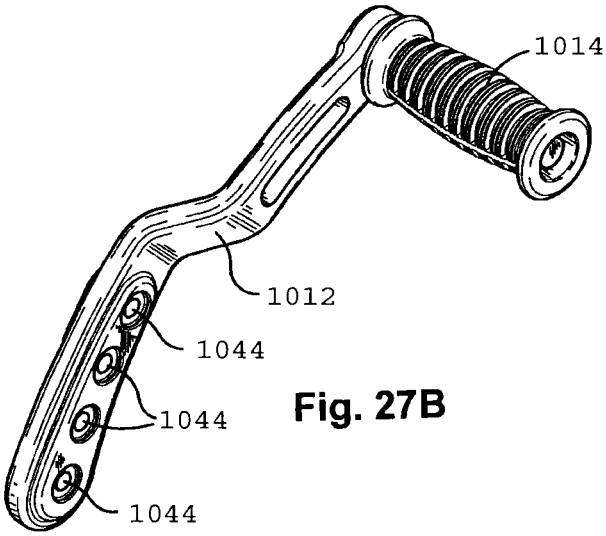
Figure 28:
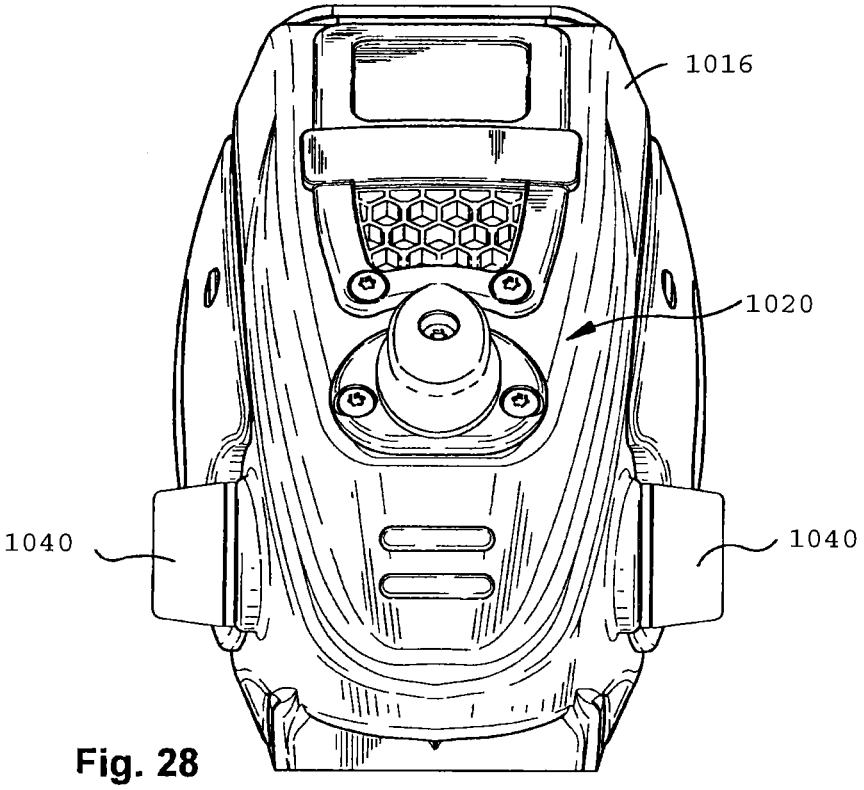
FIG. 28 is a front view of a partial winch assembly.
Figure 29:
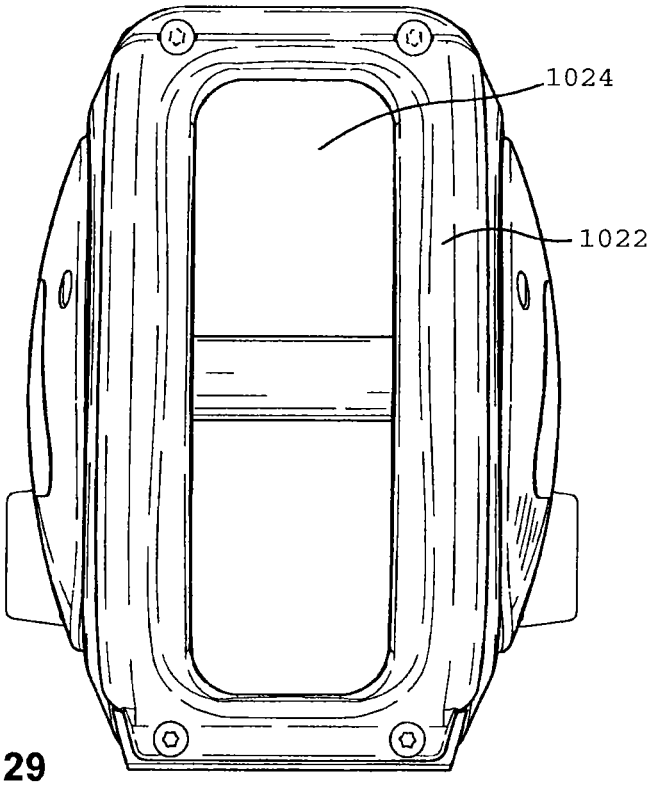
FIG. 29 is a rear view of a partial winch assembly.
Figure 30:
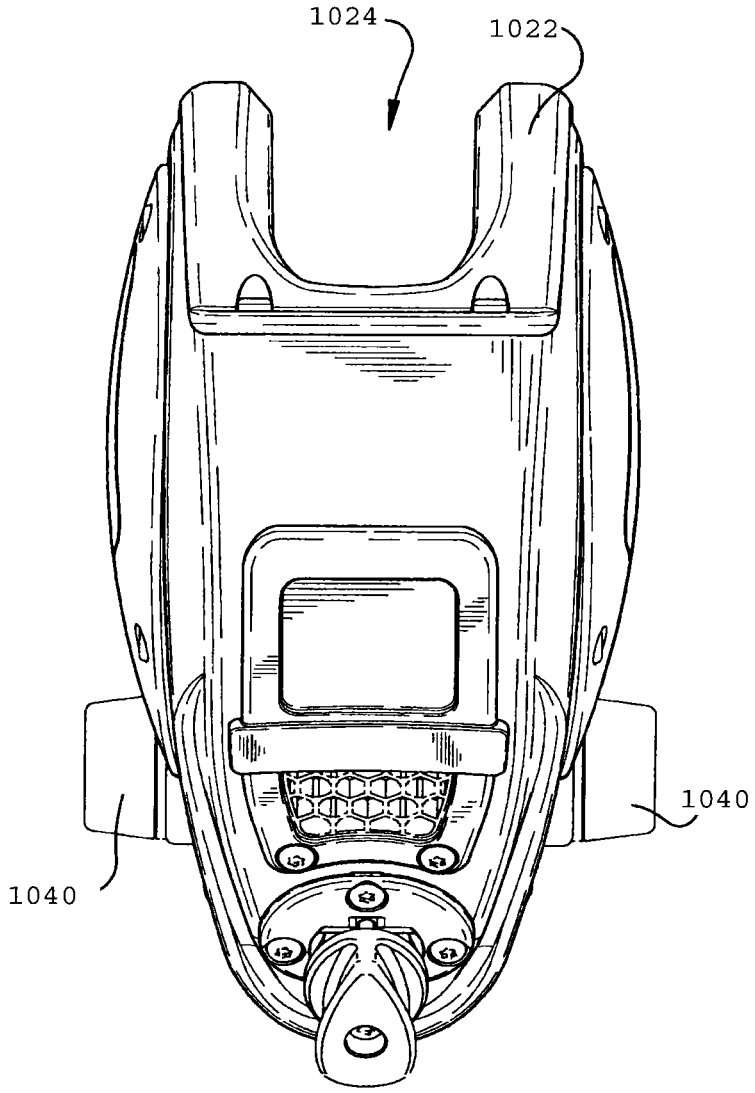
FIG. 30 is a top view of a partial winch assembly.

As is best seen in FIGS. 26A and 26B, the winch assembly 1010 may include an easy install system. In a traditional mounting application, the fasteners have to be installed in through the inside of the winch. This is sometimes cumbersome due to several components on the inside of the winch. Making matters more difficult to access the mounting holes is when a winch line is fully wound onto the drum. With this limited inside access, being able to hold down the head of the bolts is sometimes a problem when trying to tighten the nuts from the bottom side. Sometimes parts of the winch may need to be disassembled to complete the installation.

In the present invention, an installer may insert bolts from the bottom of the winch 1010, place the winch assembly 1010 onto a winch or mounting stand, and attach the nuts from the bottom side. The bottom plate 1026 of the frame 1016 may include a series of grooves 1066 and apertures 1068 that allow the bolts to be held in place until the nuts can be threaded onto the bolts. This is accomplished by the heads of bolts fitting through apertures 1068 and allowing for the shaft of the bolt to slide along the grooves 1066. The grooves 1066 along with the square necks of fasteners, such as carriage bolts, may prevent these bolts from spinning while tightening. Thus, simplifying installation and requiring fewer tools.

A two speed winch assembly 2010 is illustrated in FIGS. 31, 36, 37, 39-42C and 46-48. The two speed winch assembly 2010 may provide improved aesthetics and performance to towing vehicles, such as marine trailers. When the winch assembly 2010 is properly mounted to a boat trailer (not shown), the winch assembly 2010 may be utilized to assist in the loading and final positioning of the boat onto the trailer. This type of situation may commonly occur while using a boat trailer to remove a boat from a body of water.

Figure 36:
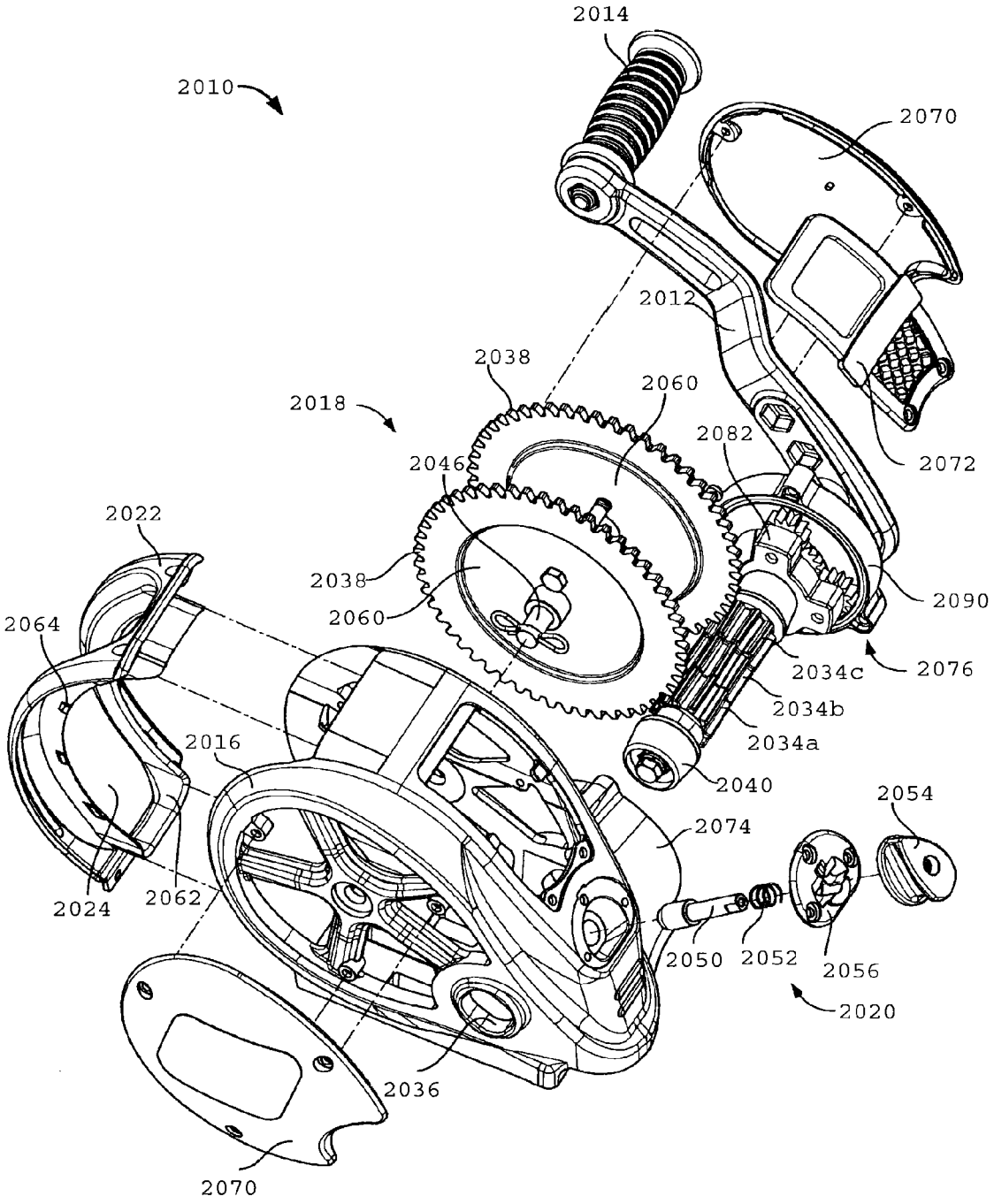
FIG. 36 illustrates a partial exploded view of a two speed winch assembly.
Figure 38:
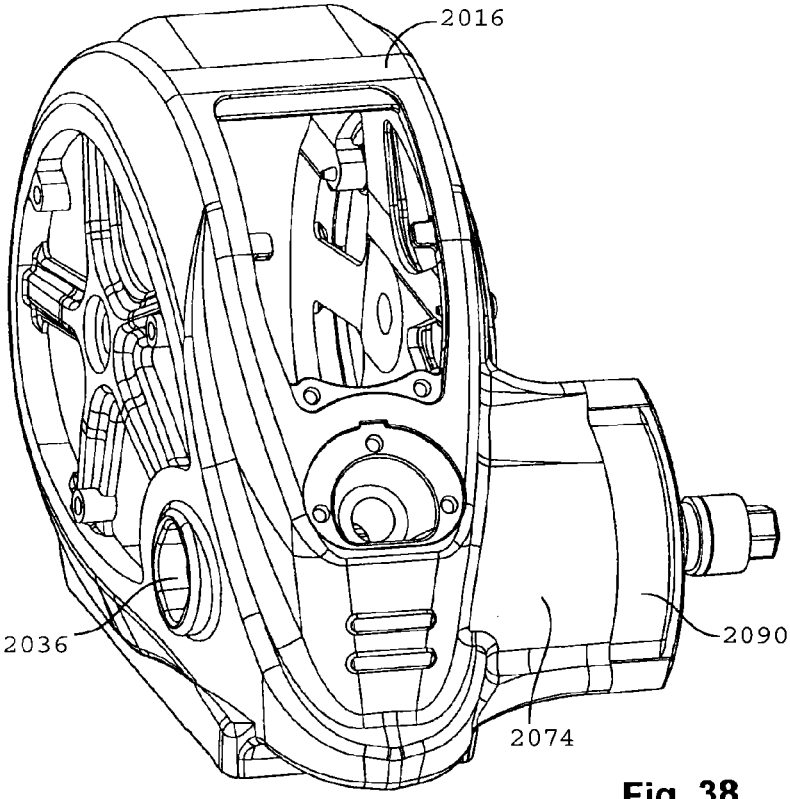
FIG. 38 illustrates a perspective view of a frame for a two speed winch assembly.
Figure 39:
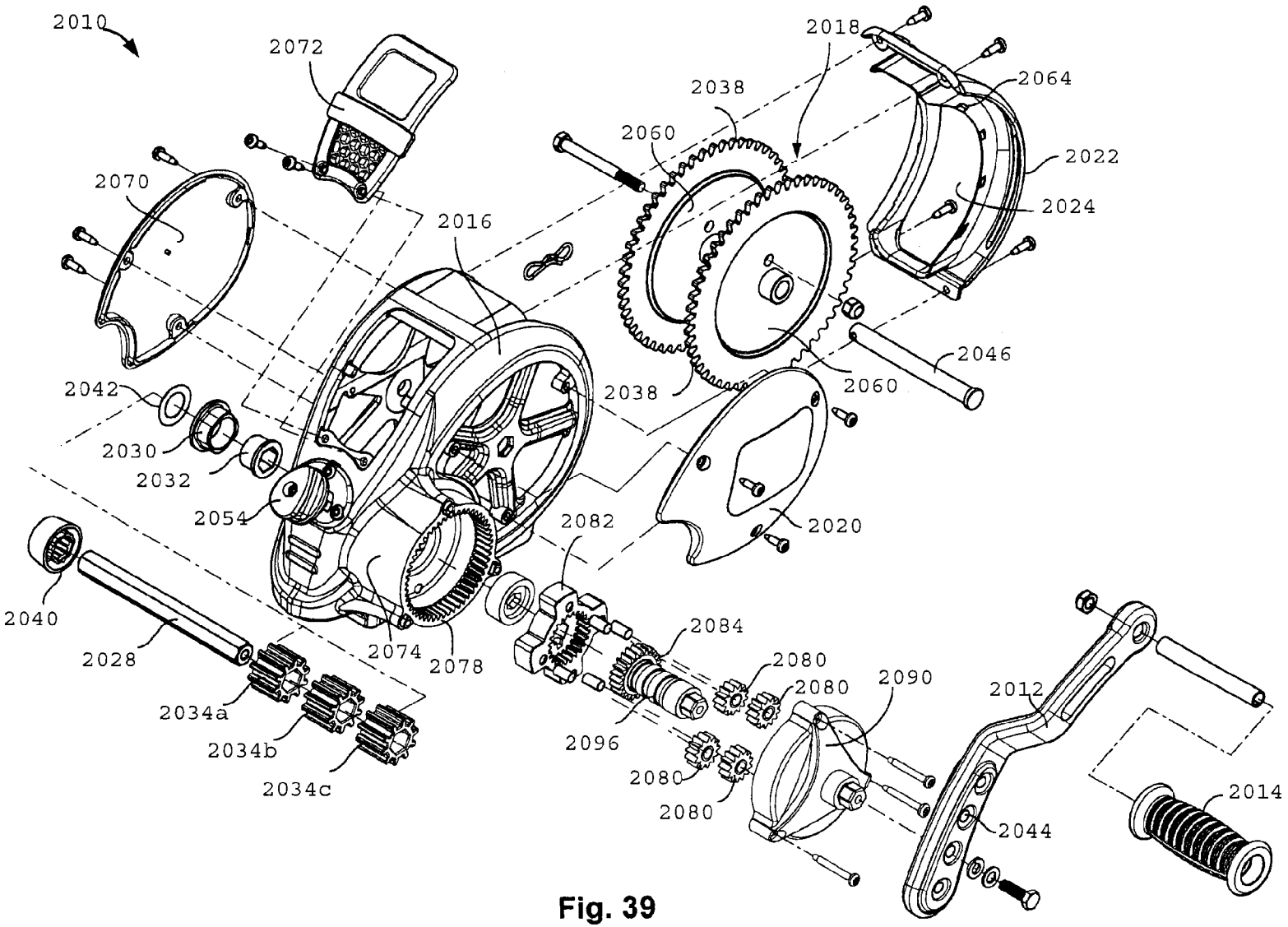
FIG. 39 illustrates an exploded view of a two speed winch assembly.

The winch assembly 2010 may include a handle or crank 2012, a winch housing or frame 2016 that may house the internal components of the winch assembly 2010, such as a two speed gearbox 2076, and a base plate 2026 (FIGS. 36 and 39). The base plate 2026 may be configured to facilitate the securing or attaching of the winch assembly 2010 to a winch stand (not shown) or directly to a towing trailer. The handle 2012 may include a grip 2014 (FIGS. 31-33, 36-39, 41-42C and 45). The grip 2014 may be of any appropriate shape or size and be located at any appropriate position on the handle 2012. For example, the grip 2014 may be secured to an end of the handle 2012 to facilitate the manual rotation of the handle 2012.

Most trailer winches are manufactured from a formed steel stamping. This material and process may severely limit the features and aesthetics that can be incorporated into the design. The winch frame 2016 may be fabricated as a one-piece, die-cast aluminum component (FIGS. 36 and 38). The use of high pressure die casting may allow for complex and aesthetic shapes, incorporate many desirable features, provide for a high strength construction, and may make manufacturing easier. Die casting allows for precision control of dimensions of the frame 2016, and allows for forming thicker sections to strengthen the frame 2016.

The winch assembly 2010 may also include a winch drum 2018 and a ratchet and pawl system 2020 (FIGS. 32-36 and 39). The winch drum 2018 and ratchet and pawl system 2020 may be located within the winch frame 2016 for selectively driving and locking the winch drum 2018. The winch assembly 2010 may be arranged to load and unload cargo onto a towing trailer by securing a strap (not show) to the cargo.

The strap may be attached to the drum 2018 to pull cargo onto the trailer when the drum 2018 is rotated in a first direction and allow cargo to slide off the trailer when the drum 2018 is rotated in a second and opposite direction. The drum 2018 may be located within the frame 2016 and positioned on a shaft 2046, such as a pin (FIGS. 32-36 and 39).

The winch assembly 2010 drive system may drive the drum 2018 to load and unload cargo. The winch assembly 2010 drive system may be an adjustable floating winch system that may be driven by a hand operated adjustable crank handle 2012. The drive system may include a drive shaft 2028, an outer bearing 2030, an inner bearing 2032, and three drive gears 2034*a*, 2034*b*, 2034*c* (FIG. 39).

The outer and inner bearings 2030, 2032 may be slip bearings and may be positioned to hold the drive shaft 2028 on one end (FIG. 39). The bearings 2030, 2032 may be slip bushings that hold the drive shaft assembly in place on one end. The drive shaft 2028 may be hexagonal in cross-sectional shape. The three drive gears 2034 may be slip fit onto the hexagonal drive shaft 2028, and each drive gear 2034 operates independent of the other two drive gears 2034.

The outer bushing 2030 may have a generally square outer surface, a generally circular inner surface, and include a flange (FIG. 39). The outer bushing 2030 may be slid into a coaxial aperture 2036 located in the winch frame 2016 (FIGS. 36 and 38). The frame aperture 2036 may be arranged to match the generally square outer surface of the outer bushing 2030 so that the outer bushing 2030 may not rotate when located in the frame aperture 2036. The outer bushing 2030 may be fabricated from a polymeric material such as nylon.

The inner bushing 2032 may have a generally circular outer surface and include a flange (FIG. 39). The inner bushing 2032 may be positioned within the outer bushing 2030, where the circular inner surface of the outer bushing 2030 may match the circular outer surface of the inner bushing 2032. The inner surface of the inner bushing 2032 may also have a hexagonal shape to accommodate the hexagonal shape of the drive shaft 2028. The inner bushing 2032 may be fabricated from an oil impregnated self-lubricating bronze material. Such an arrangement may provide for an extended service life.

The outer and inner bearings 2030, 2032 may support the drive shaft 2028 on one side within the winch frame 2016 (FIG. 39). The combination of the bearings 2030, 2032 may functionally transform the hexagonal outer surface of the drive shaft 2028 to a circular outer surface to facilitate smooth and efficient rotation of the drive shaft 2028 within the aperture 2036 of the frame 2016. Such an arrangement may provide for a drive system that functions smoothly even when encountering irregularities in drum gears 2038 due to manufacturing and assembly processes such as stamping and welding.

The three drive gears 2034 positioned on the drive shaft 2028 may be arranged to drive the winch drum 2018 and to facilitate the locking of the drum 2018 (FIGS. 36 and 39). The drive gears 2034 may be positioned within the frame 2016 and between the bushings 2030, 2032 and the gearbox 2076. The two outer drive gears 2034*a*, 2034*c* may engage the drum 2018 to drive the drum 2018. The drum 2018 may be fabricated with a pair of drum gears 2038 (FIGS. 36 and 39).

Figure 40A:
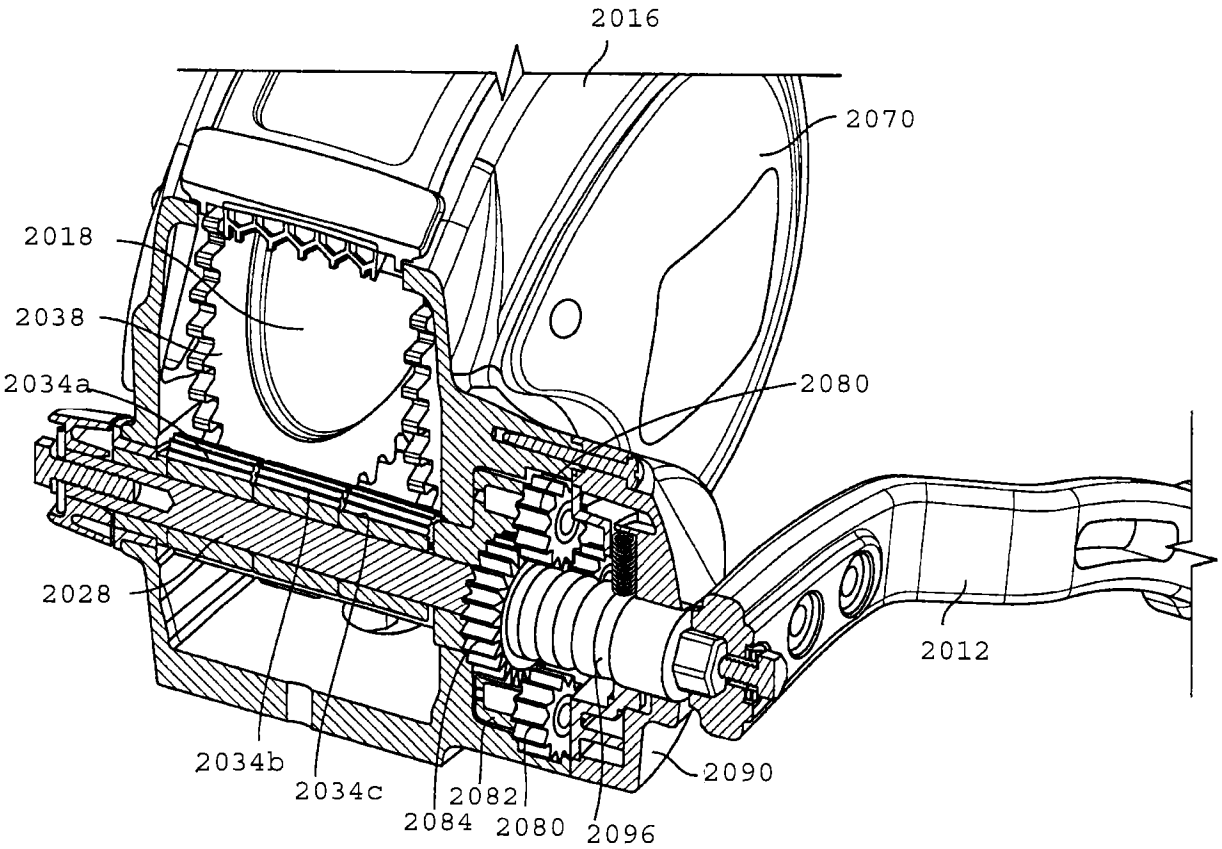
FIGS. 40A-40C illustrate perspective views of a gearbox of a two speed winch assembly in high, low and neutral positions.

The two outer drive gears 2034*a*, 2034*c* may engage the pair of drum gears 2038 to drive the drum 2018 with an even and balanced force (FIGS. 36 and 40A). The middle drive gear 2034*b* may function as a ratchet type plunger engagement device to control the locking and release of forward and reverse rotational motion of the winch drum 2018. These gears 2034 may be slip fit over the drive shaft 2028 and function or operate independent of each other.

The winch drum 2018 may include a pair of drum gears 2038 symmetrically positioned at the sides of the drum 2018. The drum 2018 may be manufactured or fabricated so that the drum gears 2038 may be integrally formed with the drum 2018, i.e., the drum gears 2038 and the drum 2018 are one singular, unitary component. Such fabrication may eliminate the need for welding, riveting, or otherwise securing gears to a drum.

The symmetric positioning of the drum gears 2038 with respect to the drum 2018, along with the dual drive gears 2034 of the drive system may encourage even loading and balancing of forces when the drum 2018 is wound and unwound. Such even loading may reduce or eliminate side load conditions that may damage the drum 2018. Such balanced forces may increase the service life of the drum 2018 and the drum gears 2038.

The drum 2018, along with a rear cover 2022, may guide the strap such that the strap experiences less wear and tear and is protected against grease from the gears and other contaminants. The drum 2018 may include a sump 2060 protruding from the inner side of each drum gear 2038 (FIGS. 32, 33, 36 and 39). The sump 2060 may extend from the inner surface of the drum gears 2038 so as to encourage a retracting strap towards the center of the drum 2018 and away from the teeth of the drum gears 2038.

Such an arrangement may result in a reduction or elimination of instances when the strap engages or becomes entangled with the drum gears 2038, which would cause damage and other wear, along with potentially contaminating the strap with grease. In addition, the sumped sides 2060 may also encourage a strap guide 2062 to nest inside the rear cover 2022 further protecting the strap from wear and or contamination.

The drive shaft 2028 may be fabricated as a one-piece steel drive shaft with apertures drilled and tapped on each end (FIG. 39). A retaining cap 2040 may be engaged with an end of the drive shaft 2028 to hold the drive shaft 2028 within the aperture 2036 of the frame 2016 (FIGS. 31, 36, 39, 41, 46 and 48). Stainless steel washers 2042, such as shim washers, may also be used to prevent wear between bushing 2030, 2032 surfaces (FIG. 39).

The handle 2012 of the two speed winch assembly 2010 may be mounted on any appropriate side of the frame 2016, such as the left hand side. If utilizing a single speed winch, the handle 2012 may be mounted on either side of the winch, such as the left or right hand side. U.S. patent application Ser. No. 12/558,252, which is herein incorporated by reference in its entirety, describes in further detail such a handle, its mode(s) of operation, and the operation of a single speed winch.

Figure 42A:
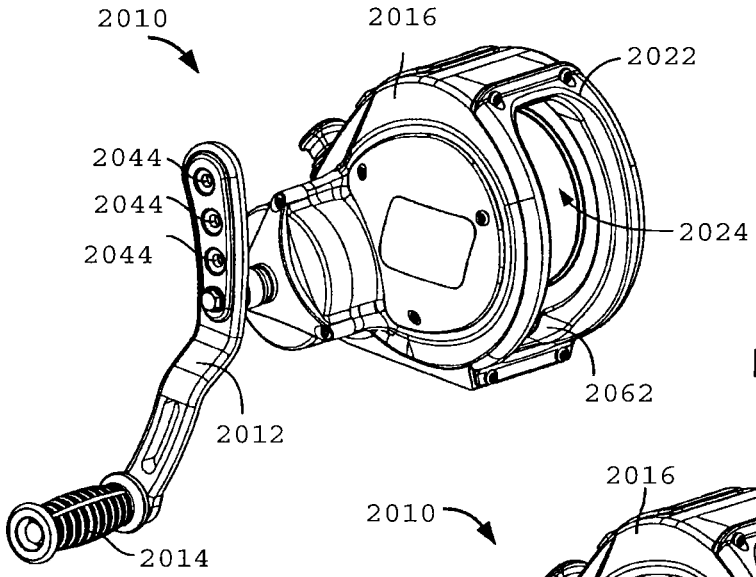
FIGS. 42A-42C illustrate perspective views of a handle attached to a two speed winch assembly at varying positions.
Figure 42B:
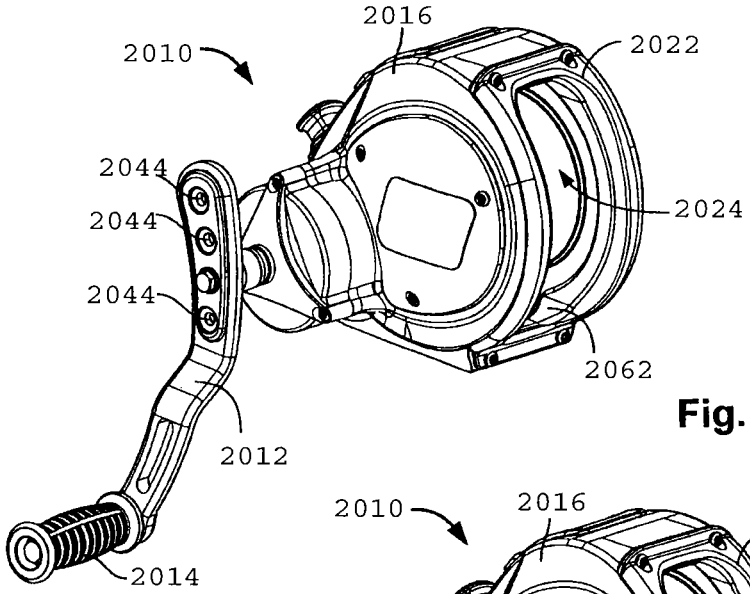
Figure 42C:
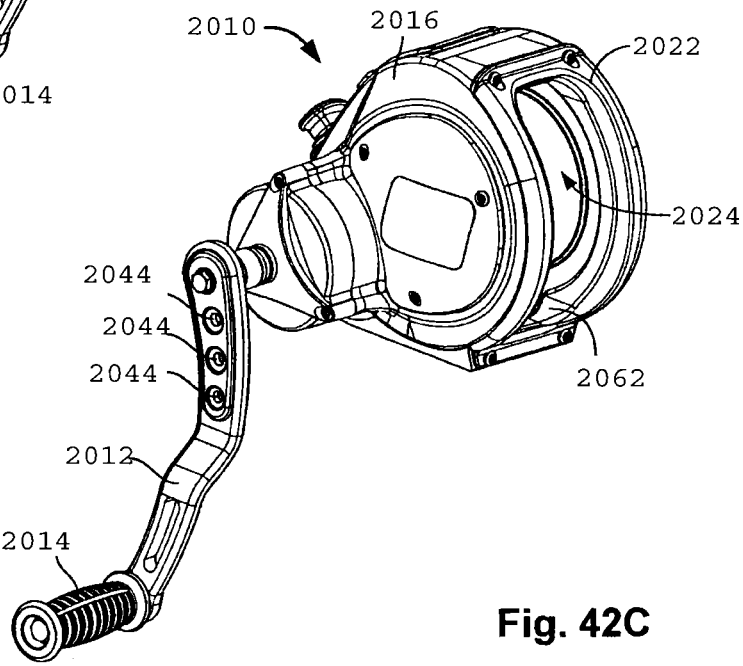

The handle 2012 may be mounted on an end of the drive shaft 2028 to permit left hand manual rotation of the handle 2012 in a variety of length positions (FIGS. 42A-42C). For example, the handle 2012 may be fitted with a series of mounting locations or apertures 2044 located along the handle 2012 (FIGS. 42A-42C and 45). The handle 2012 may be adjustable from approximately 6-9 inches based on which aperture 2044 the handle 2012 is secured to.

The handle 2012 may thereby be positioned at a number of different positions via the adjustment apertures 2044 to either shorten or lengthen the lever arm portion of the handle 2012. The handle 2012 may be assembled in a variety of positions depending on need and circumstances. Cap screws, washers, etc., as shown in the figures, may secure the handle 2012 and retaining cap 2042 to the winch assembly 2010. All components may be assembled with a toleranced slip fit and may be universal right to left for assembly purposes.

The two speed gearbox 2076 may be of any appropriate shape, size, type or configuration, such as a planetary gearbox (FIGS. 36 and 39-40C). The gearbox 2076 may include an internal ring gear 2078, planetary gears 2080, a planetary gear carrier 2082 and a sun gear 2084 (FIGS. 36 and 39-40C). Epicyclic gearing or planetary gearing is a gear system that consists of one or more outer gears, or planet gears 2080, which revolve about a central, or sun gear 2084. Typically, the planetary gears 2080 may be mounted on a movable arm or gear carrier 2082 that itself may rotate relative to the sun gear 2084 (FIGS. 36 and 39-40C). Epicyclic gearing systems may also incorporate the use of an annulus or outer ring gear 2078, which may mesh with the planet gears 2080.

Epicyclic gearing may be used to increase output speed. For example, the two speed planetary gearbox may increase the capacity of the winch assembly 2010 up to 3200 lbs. and may also provide a neutral for reeling out the strap. The planetary gearbox body 2074 may be cast into the side of the winch frame 2016. The planetary gearbox 2076 may reduce from 5:1 in high gear to 15:1 in low gear, thereby reducing the handle 2012 effort required.

The planetary gear carrier 2082 may be driven by an input torque. The sun gear 2084 may provide the output torque, while the ring gear 2078 may be fixed. It is to be understood that the gears 2078, 2080, 2082, 2084 may be of any appropriate shape, size, type or configuration and should not be limited to that shown or described herein. For example, the sun gear 2084 may be a pinion gear.

Figure 40B:
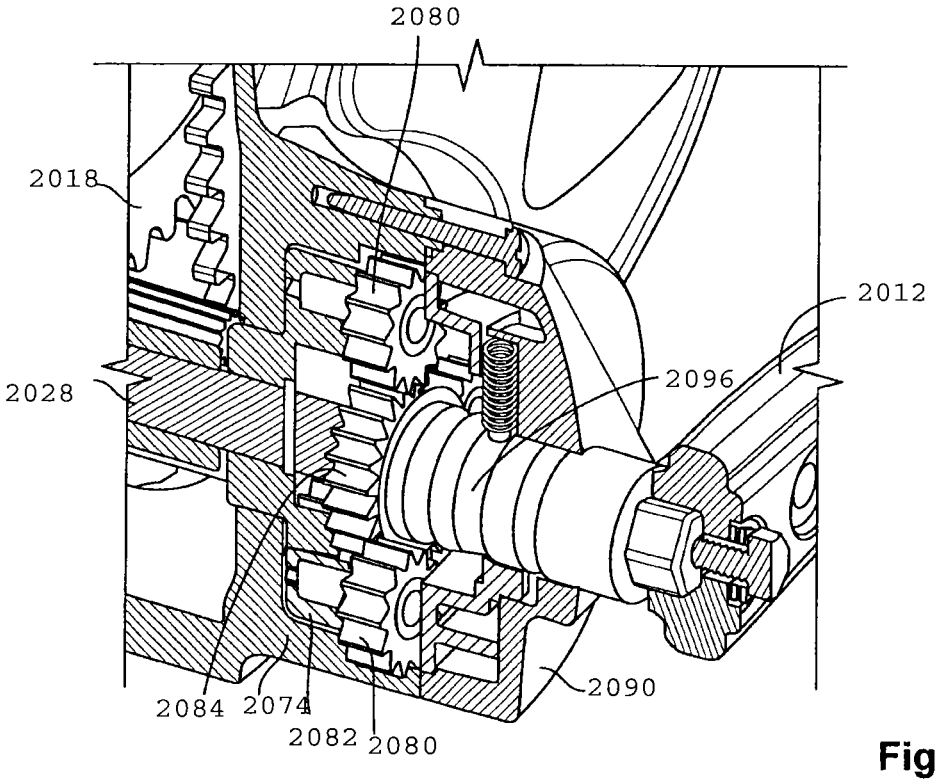
Figure 40C:
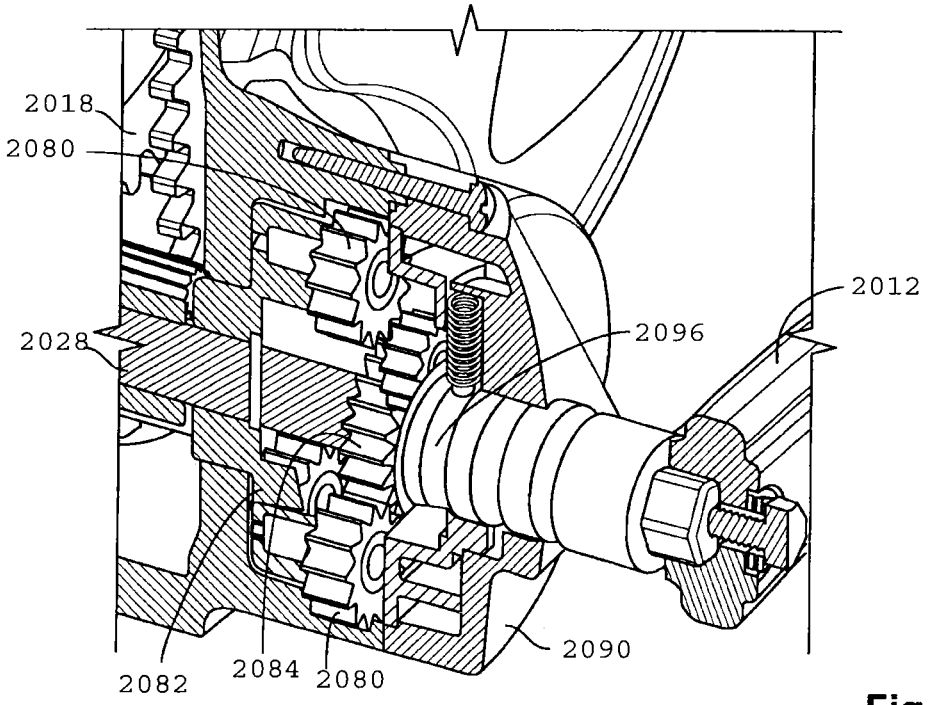
Figure 41:
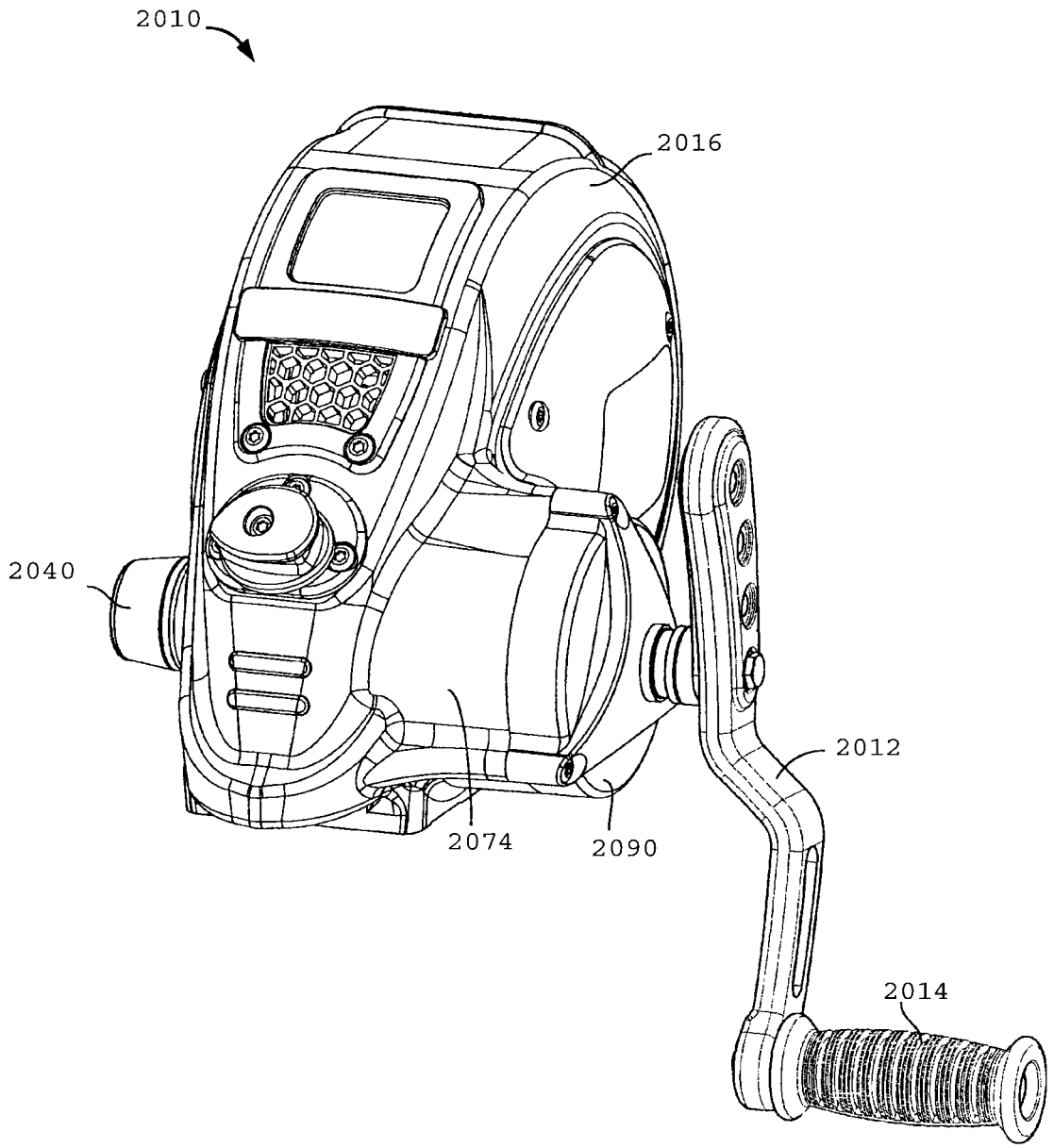
FIG. 41 illustrates a perspective view of the two speed winch assembly.

The sun gear 2084 may include an extended portion that may include detents or grooves 2096 (FIGS. 39-40C). The sun gear 2084 may move from the left to the right to change the gearing of the gearbox 2076. The grooves 2096 may be of any appropriate shape or size and be located at any appropriate position on the sun gear 2084. The grooves 2096 may aid in maintaining the winch assembly 2010 in the desired position, high, low or neutral. The sun gear 2084 may provide the low gear, whereby the planetary gear carrier 2082 is not engaged at all.

The gearbox 2076 may be housed within a gearbox mounting area 2074 that may be located within the frame 2016 (FIGS. 31, 36, 39-40C, 46 and 48). The gearbox mounting area 2074 may include the internal ring gear 2078. The internal ring gear 2078 may be integrally formed within the mounting area 2074 and frame 2016 of the winch assembly 2010 (FIG. 39). For example, the internal ring gear 2078 and its associated teeth may be integrally cast into the frame 2016 of the winch assembly 2010. As an alternative, the ring gear 2078 may be machined into the frame 2016.

The winch assembly 2010 may conform to the SAE J1853 standard for marine trailer winches. For example, twice the rated tension load may be applied through a first layer of wire rope on the marine winch assembly 2010, whereby the winch assembly 2010 must not release the load and still be able to operate after this overload test. In addition, three times the rated tension load may be applied through the first layer of wire rope on the marine winch assembly 2010, whereby the winch assembly 2010 must not release the load.

The winch assembly 2010 may be mounted by bolting or welding in such a manner that three times the rated straight line pull of the winch assembly 2010 can be applied without failure of the winch assembly 2010 attachment. In a non-limiting example, the winch assembly 2010 may be rated up to 3,200 lbs., whereby 9,600 lbs. may be achieved three times without releasing the load. Moreover, the winch assembly 2010 may have a capacity of up to 3200 lbs. in low gear and a capacity of up to 2000 lbs. in high gear.

The gearbox 2076 may also utilize a gearbox cover 2090 (FIGS. 31, 36, 38-41, 44A, 44B and 46-48). The gearbox cover 2090 may be of any appropriate shape or size, such as a generally cylindrical shape that may only be open on one end. The cover 2090 may be secured to the gearbox mounting area 2074 of the frame 2016 by any appropriate means, such as by fasteners (FIG. 39). The fasteners may be of any appropriate shape, size or type, such as nuts, bolts, and washers.

Figure 31:
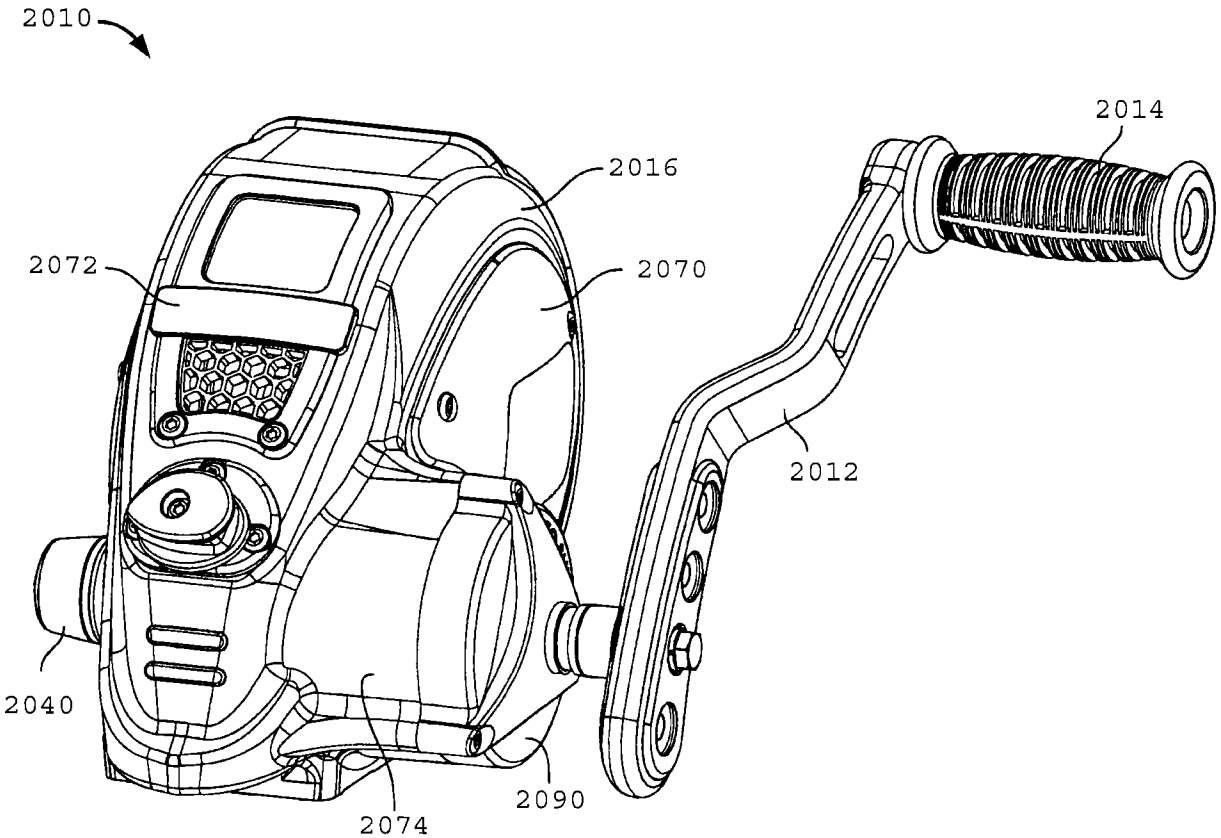
FIG. 31 illustrates a perspective view of a two speed winch assembly.
Figure 33:
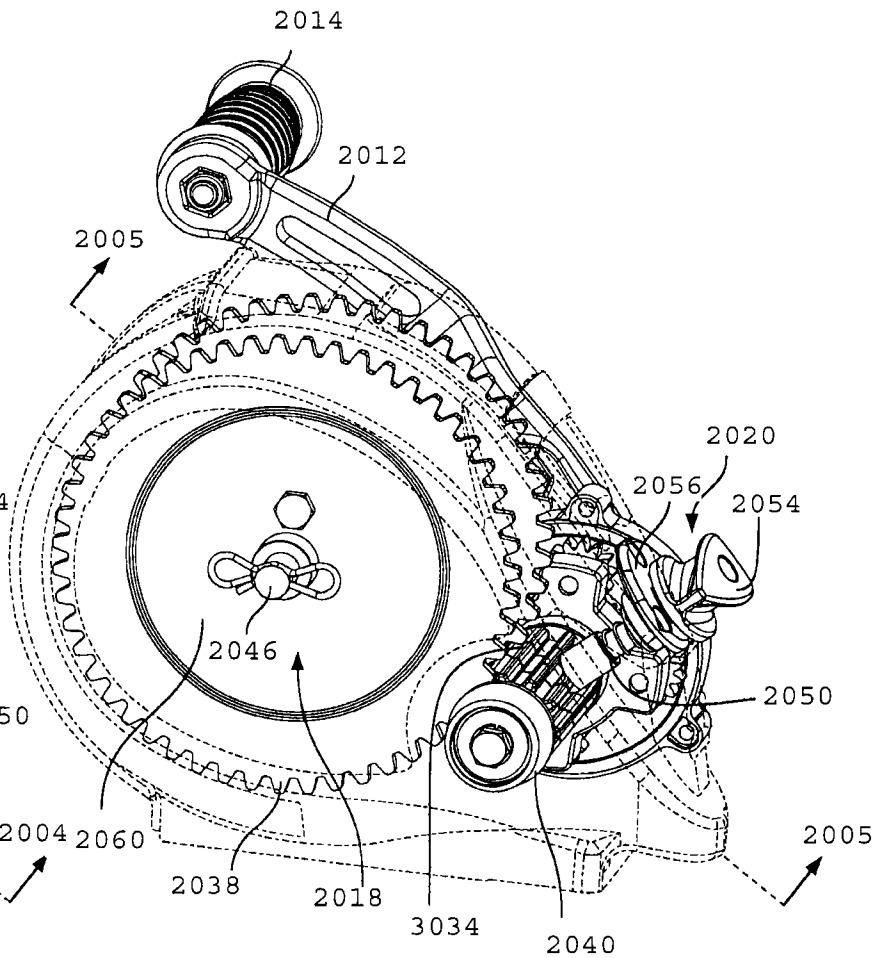
FIG. 33 illustrates a perspective view of internal mechanisms of the winch assembly of FIG. 31 where a ratchet and pawl system is engaged.

Typical ratchet pawl systems may only be located on one side or the other of a winch, thereby limiting access if the operator is on the opposite side. Moreover, most ratchet pawl systems are made of several loose components that may be cumbersome to assemble and replace if needed. The ratchet and pawl system 2020 of the winch assembly 2010 may be located in the middle of the winch assembly 2010, thereby making it easily accessible from either side (FIGS. 31, 36 and 39).

Figure 43A:
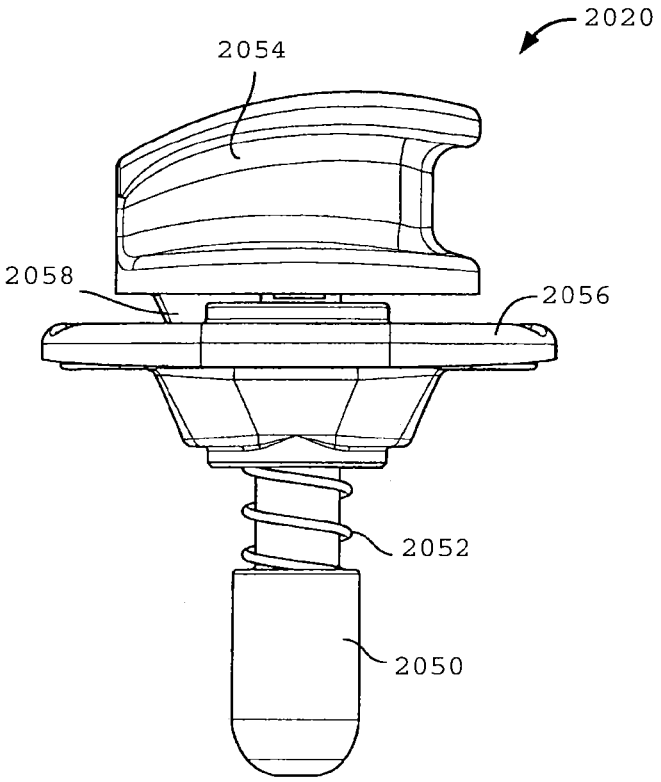
FIGS. 43A-43C illustrate views of a ratchet system for a two speed winch assembly.
Figure 43B:
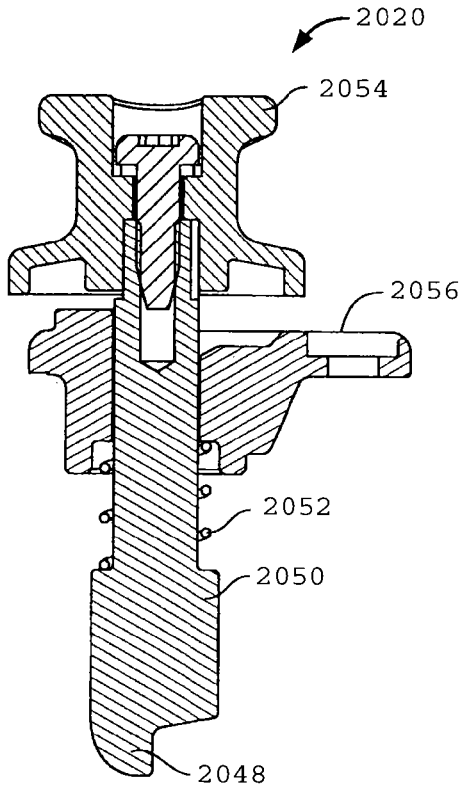
Figure 43C:
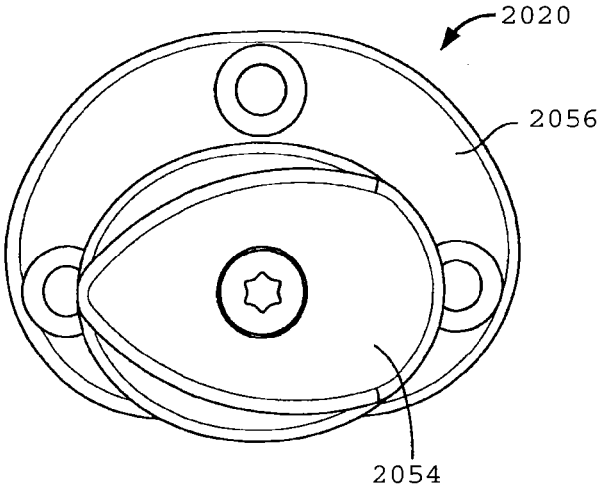

The ratchet and pawl system 2020 may be mounted in the center of a symmetrical winch frame 2016 as a separate and self-contained one piece assembly (FIGS. 43A-43C). Such positioning makes the ratchet and pawl system 2020 accessible from either side of the winch assembly 2010. For example, the ratchet and pawl system 2020 may be positioned generally through the centerline of a symmetrical winch assembly 2010 and may be a separate, self-contained assembly.

The winch frame 2016 may be arranged such that the ratchet and pawl system 2020 may be housed within the frame 2016 to prevent unnecessary damage to components (FIGS. 32-35). Such positioning also allows for a shorter pin 2050 because of its proximity to the ratchet 34*b*. Such an arrangement places less bending forces on the pin 2050 and increases the service life of the pin 2050.

Figure 32:
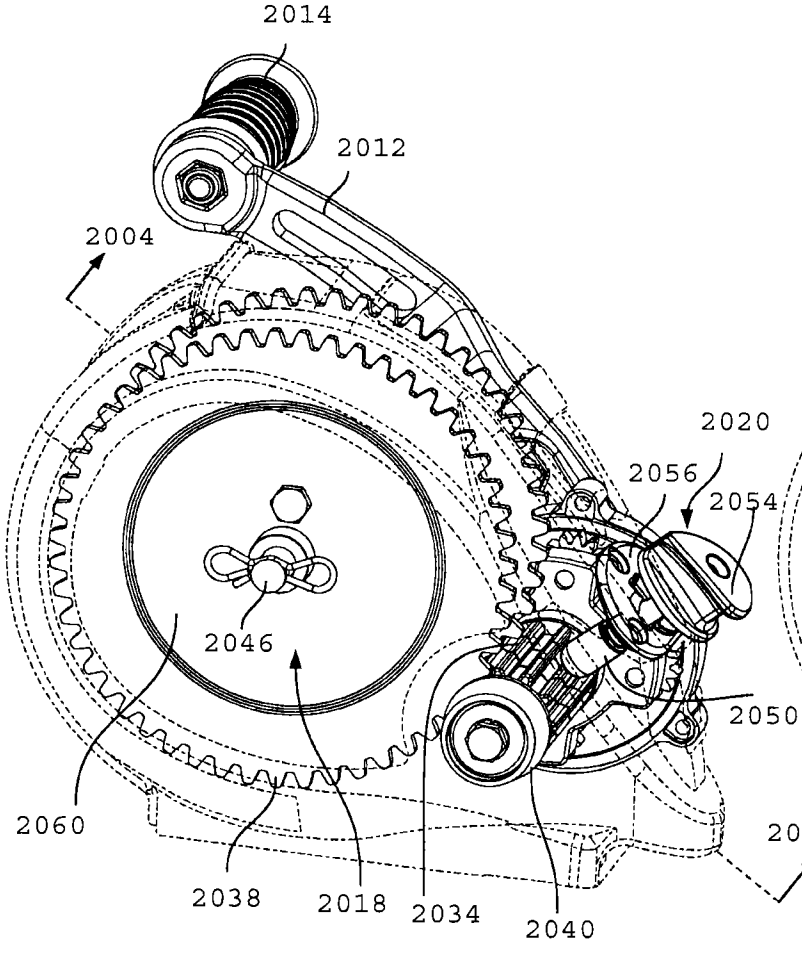
FIG. 32 illustrates a perspective view of internal mechanisms of the winch assembly of FIG. 31 where a ratchet and pawl system is disengaged.
Figure 34:
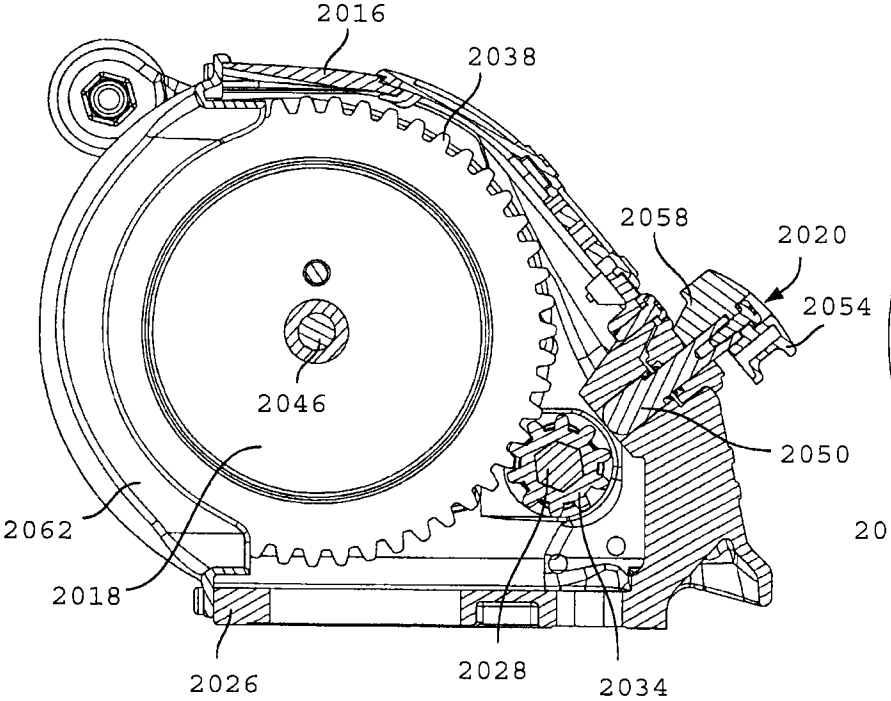
FIG. 34 illustrates a cross-sectional view of the winch assembly taken along line 4-4 of FIG. 32 where the ratchet and pawl system is disengaged.

The ratchet and pawl system 2020 may also include a knob 2054 and a bushing 2056 (FIGS. 32, 33, 36 and 43A-43C). The knob 2054 may be a simple pull and turn knob that may easily engage or disengage the ratchet and pawl system 2020. The bushing 2056 and knob 2054 may be arranged such that features on the bushing 2056 and knob 2054 may provide for the knob 2054 to be selectively positioned to engage a pin 2050 with the middle drive gear or ratchet 34*b* (FIGS. 33 and 35) or be selectively positioned to disengage the pin 2050 from the ratchet 34*b* (FIGS. 32 and 34).

The knob 2054 may include a protrusion 2058. The protrusion 2058 may work with the mating insert bushing 2056 that may seat the knob 2054 in the neutral position, i.e., a position where the pin 2050 is disengaged from the ratchet 2034*b*. A partial turn of the knob 2054 will ramp down into the desired engaged or disengaged position, and would allow the spring 2052 to bias the pawl 2050 into contact and engagement with the ratchet 2034*b*. The knob 2054 may also self align itself into place easily from the neutral position or if only turned partially (FIGS. 34 and 43A).

The pin 2050 may be in contact with a spring 2052 and the knob 2054. The pin 2050 may pass through the bushing 2056 such that the knob 2054 may be accessible from the outside of the housing 2016; however, the pin 2050 may be located within the housing 2016. The spring 2052 may bias the pin 2050 into engagement with the ratchet 2034*b*. The system 2020 may also be arranged to self align for easy placement of the pin 2050 in contact with the middle drive gear or ratchet 2034*b* when the knob 2054 is only partially turned.

Figure 35:
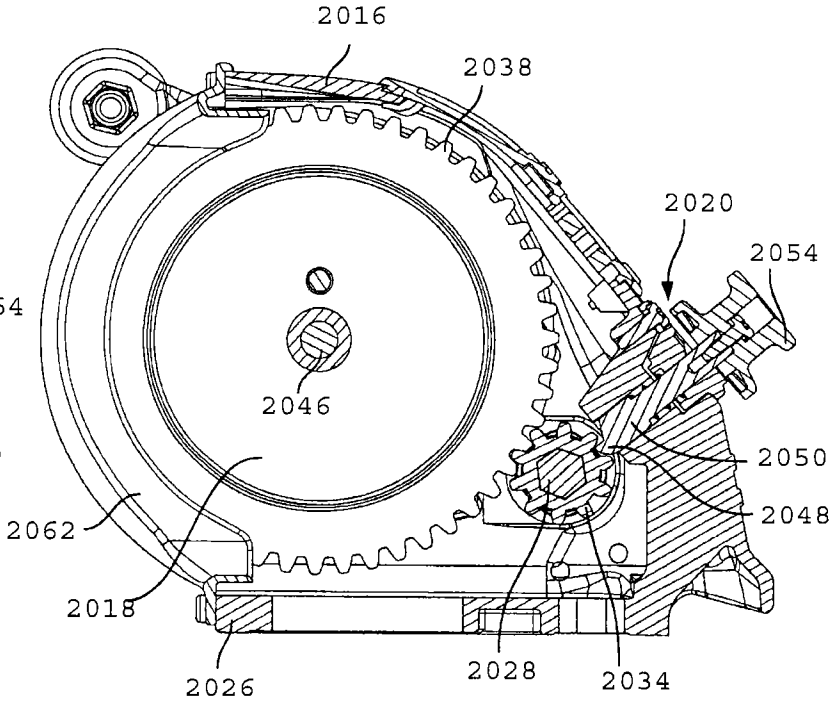
FIG. 35 illustrates a cross-sectional view of the winch assembly taken along line 5-5 of FIG. 33 where the ratchet and pawl system is engaged.

The pin 2050 may include a lip 2048 located at one end (FIGS. 35 and 43B). The lip 2048 of the pin 2050 may contact the middle drive gear or ratchet 2034*b* and not the outer drive gears 2034*a*, 2034*c*, thereby reducing wear by spreading the contact points over several gears. The frame 2016 enclosure of the ratchet and pawl system 2020 may also enable strength characteristics allowing the pin 2050 of the ratchet and pawl system 2020 to be captured as close to the gear 2034*b* as possible.

The winch assembly 2010 may also include a rear cover 2022 with an opening 2024. The opening 2024 may accommodate the winding and unwinding of a strap or cable from the winch drum 2018, as the opening 2024 may allow movement of the strap into and out of the winch assembly 2010 (FIGS. 36, 39, 42A-42C and 48). The rear opening 2024 may include material that is wrapped around the opening towards the drive gears 2038 that may form a strap guide 2062 (FIGS. 34-36, 39, 42A-42C, 44A and 48).

The strap guide 2062 may extend into the housing 2016 sufficiently to protect the strap against contact with the drum gears 2038, specifically protection against contact with the teeth of the drum gears 2038. Thus, further protecting the strap from damage, wear, grease and contaminants. As will be understood, the strap guide 2062 may provide the strap with a smooth, clean port for entry and exit from the winch assembly 2010.

The strap guide 2062 may include mounts or protrusions 2064 to protect the strap guide 2062 from contacting the teeth of the drum gears 2038. The protrusions 2064 may run on the smooth portion of the drum gears 2038 and avoid contact with the gear teeth. In addition, the strap guides 2062 may enclose the potentially sharp edges of the winch frame 2016, further protecting the strap and uses of the winch assembly 2010 from potential damage and injury.

The winch assembly 2010 may be arranged so that it may be secured to a towing trailer or a winch stand without accessing the inside of the winch housing 2016. Such an arrangement provides for easy and quick installation of a winch assembly 2010 without concern for opening or accessing the housing 2016, unwinding the strap, etc. The winch assembly 2010 may be installed using fasteners, such as nuts, bolts and washers, from the bottom of the winch assembly 2010.

Figure 37:
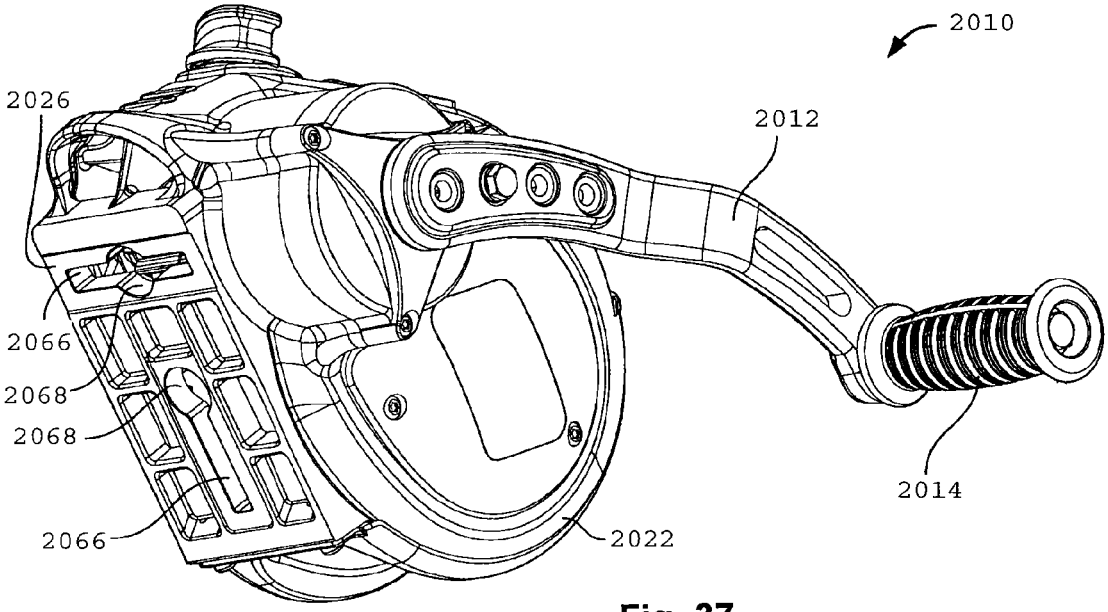
FIG. 37 illustrates an underside perspective view of a two speed winch assembly.
Figure 44B:
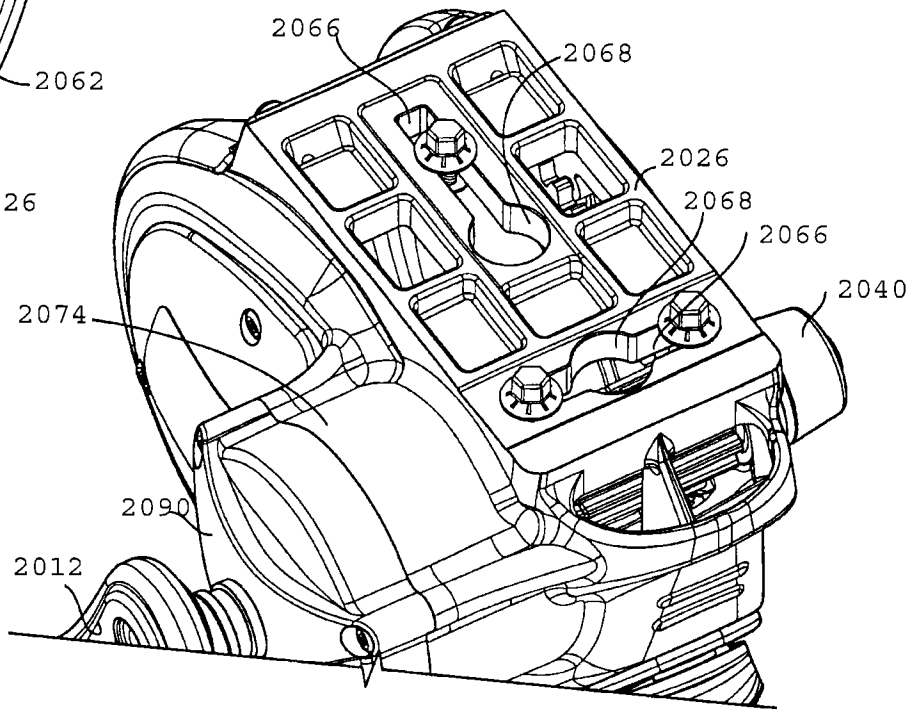
FIGS. 44A and 44B illustrate perspective views of a bottom plate of a two speed winch assembly.
Figure 44A:
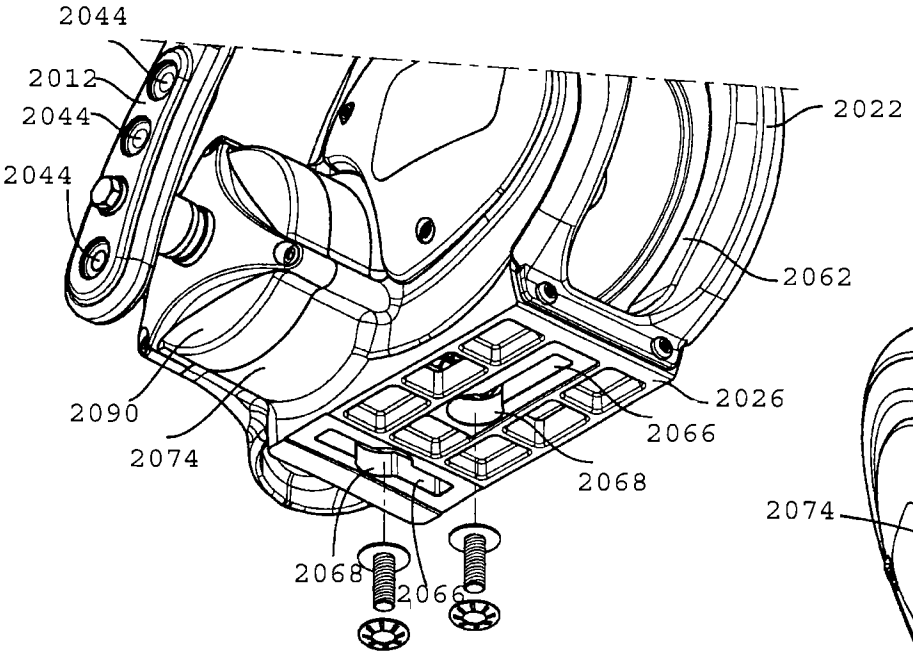
Figure 45:
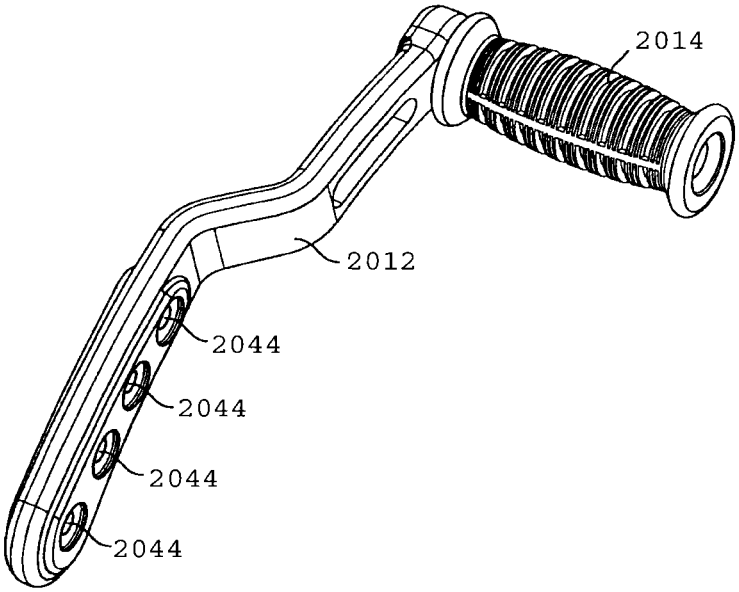
FIG. 45 illustrates a perspective view of an adjustable handle for a two speed winch assembly.
Figure 46:
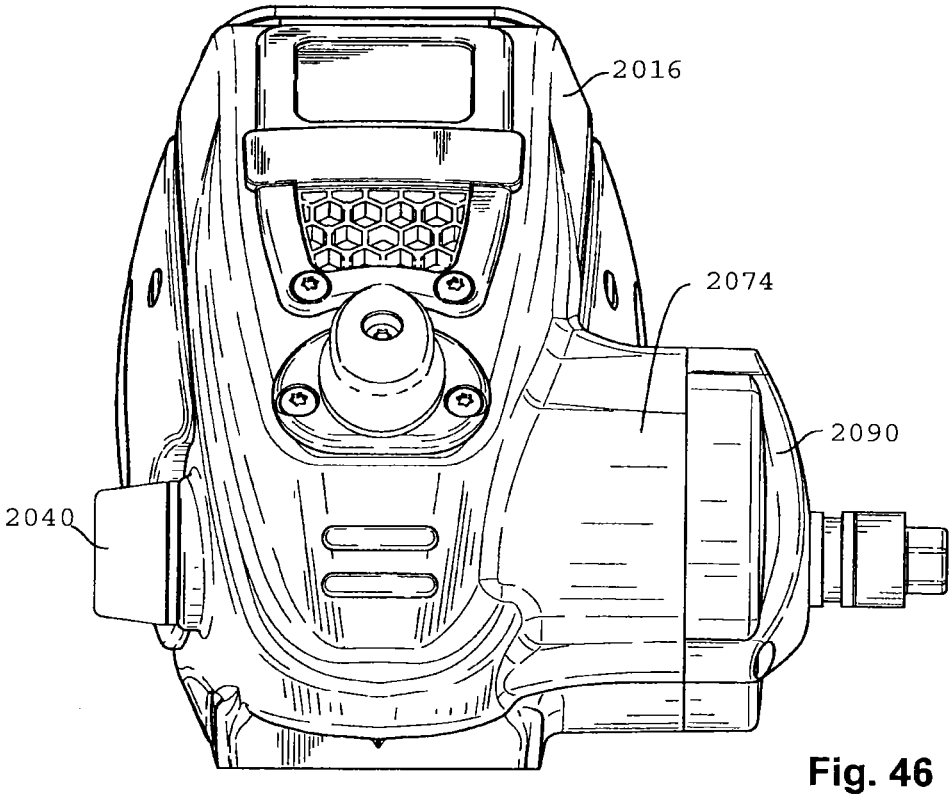
FIG. 46 illustrates a front view of a partial two speed winch assembly.
Figure 47:
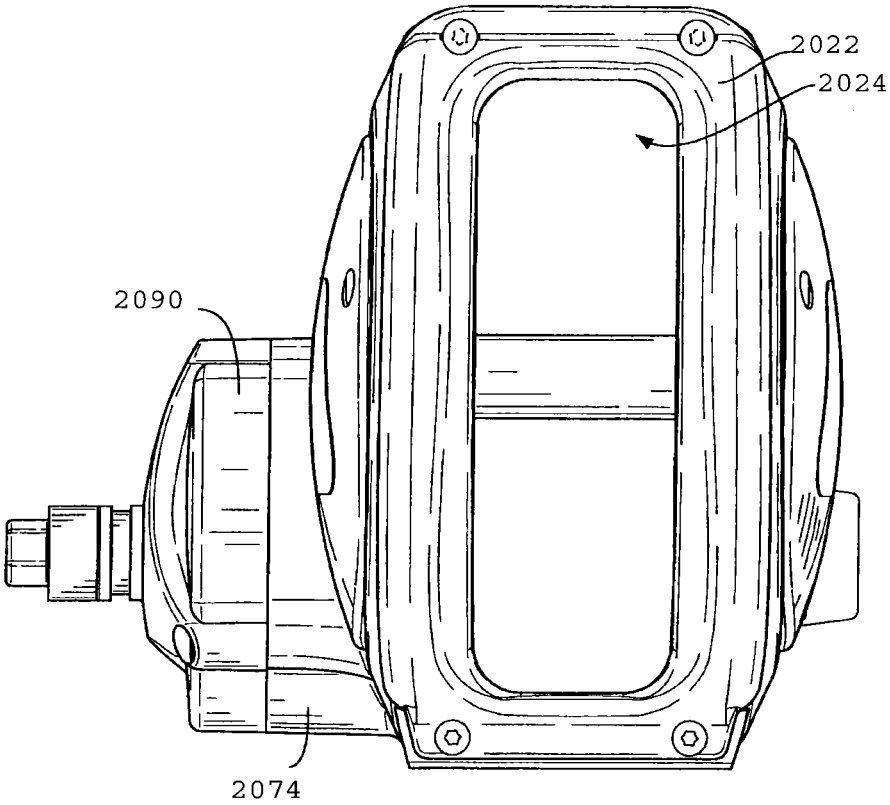
FIG. 47 illustrates a rear view of the partial winch assembly of FIG. 46.
Figure 48:
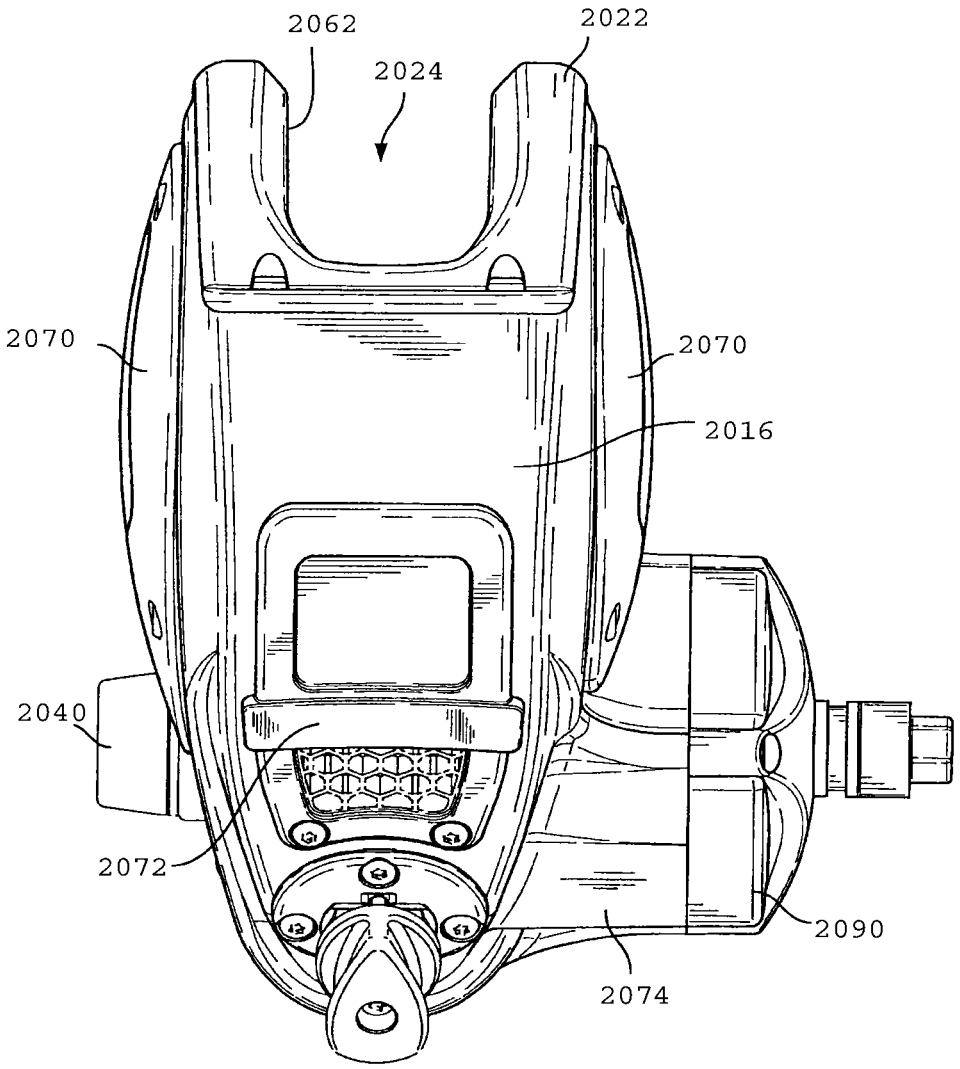
FIG. 48 illustrates a top view of the partial winch assembly of FIG. 46.

The winch assembly 2010 may include an easy installation system (FIGS. 37, 44A and 44B). In a traditional mounting application, fasteners have to be installed in through the inside of the winch. This may be cumbersome due to several components being located on the inside of the winch. Making matters more difficult to access the mounting holes may be when a winch line is fully wound onto the drum. With this limited inside access, being able to hold down the head of the bolts is sometimes a problem when trying to tighten the nuts from the bottom side. Occasionally, parts of the winch may need to be disassembled to complete the installation.

The easy installation system may include cast in features on the base 2026 of the winch assembly 2010. These cast in features may be used with carriage bolts and keeper washers. The bottom plate 2026 of the frame 2016 may include a series of grooves 2066 and apertures 2068 (FIGS. 37, 44A and 44B). Die casting the winch assembly 2010 allows for the grooves 2066 and apertures 2068 of the base plate 2026 to be incorporated into the frame 2016. A consumer may insert bolts from the bottom of the winch assembly 2010, place the winch assembly 2010 onto a winch or mounting stand, attach and tighten nuts from the bottom side of the winch assembly 2010. This arrangement may only require a single wrench to tighten the winch assembly 2010 down.

The series of grooves 2066 and apertures 2068 may allow the bolts to be held in place until the nuts can be threaded onto the bolts (FIGS. 37, 44A and 44B). This is accomplished by the heads of bolts fitting through apertures 2068 and allowing for the shaft of the bolt to slide along the grooves 2066. The grooves 2066 along with the square necks of fasteners, such as carriage bolts, may prevent these bolts from spinning while tightening. Thus, simplifying installation and requiring fewer tools.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The claims as follows are intended to include all modifications and alterations insofar as they come within the scope of the claims or the equivalent thereof.

Having thus described the invention, the following is claimed:

1. A winch assembly comprising:
a winch housing having a bottom portion; and
an installation system attached to the bottom portion of the winch housing, the installation system comprising:
at least one aperture;
at least one slot extending from the at least one aperture; and
at least one fastener having a head, wherein the head of the fastener is capable of passing through the at least one aperture and wherein the fastener is selectively positionable along the slot while the head of the fastener is generally held within the slot.

2. The winch assembly of claim 1, wherein the installation system is integrally formed with the bottom portion of the winch housing.

3. The winch assembly of claim 1, wherein the installation system is attached to the winch housing by a method selected from the group consisting of fastening, welding, or using adhesives.

4. The winch assembly of claim 1, wherein the at least one slot includes a longitudinal slot and a transverse slot.

5. The winch assembly of claim 1, wherein the fastener is capable of being secured to at least one of a winch or a stand.

6. The winch assembly of claim 1, wherein the winch housing includes a first housing member and a second housing member connected with the first housing member, wherein the first and second housing members include housing bottoms from which the installation system extends.

7. The winch assembly of claim 6, wherein at least a portion of the installation system is integrally formed with at least one of the first and second housing members.

8. A winch assembly comprising:
a winch frame having a bottom portion; and
an installation system formed with the bottom portion of the winch frame, the installation system comprising:
at least one aperture;
a slot spaced from the at least one aperture; and
first and second fasteners each having a head, wherein the first fastener is inserted into the at least one aperture until the head engages the at least one aperture and the second fastener is inserted into the slot until the head engages the slot, wherein the second fastener is selectively positionable along the slot.

9. The winch assembly of claim 8, wherein the installation system is integrally formed with the bottom portion of the winch frame.

10. The winch assembly of claim 8, wherein the at least one aperture includes a plurality of apertures transversely spaced along the bottom portion of the winch frame.

11. The winch assembly of claim 10, wherein the slot includes a longitudinal slot.

12. The winch assembly of claim 10, wherein the slot includes a transverse slot.

13. The winch assembly of claim 8, wherein the at least one aperture includes a transverse slot.

14. The winch assembly of claim 8, wherein the first and second fasteners are capable of being secured to at least one of a winch or a stand.

15. The winch assembly of claim 8, wherein the first fastener includes a square neck portion, the square neck portion engaging the at least one aperture preventing rotation of the first fastener during installation and wherein the second fastener includes a square neck portion, the square neck portion engaging the slot preventing rotation of the second fastener during installation.

16. The winch assembly of claim 8, further comprising a sheeting adhesively engaged with bottom of the frame, the sheeting maintaining the pair of fasteners in an operative position.

17. The winch assembly of claim 16, wherein the sheeting frictionally engages the first and second fasteners.

18. The winch assembly of claim 8, wherein the at least one aperture includes a plurality of apertures positioned through the winch frame spaced along an underside of the winch frame, whereby one of the slot and the plurality of apertures extends transversely along the winch frame and the other of the slot and plurality of apertures extends longitudinally along the winch frame.

19. The winch assembly of claim 8, wherein the at least one aperture and the at least one slot extending from the at least one aperture includes a generally raised portion.

20. A winch assembly comprising:

a winch body;

at least one aperture positioned through the winch body;

a slot spaced from the at least one aperture and positioned on the winch body;

a second slot extending from the at least one aperture; and first and second fasteners each including a head, wherein the first fastener is inserted into the at least one aperture with the head preventing further insertion through the aperture, the first fastener is selectively positionable along the second slot while the head of the first fastener is generally held within the second slot and the second fastener is inserted into the slot, the head preventing further insertion through the slot, wherein the second fastener is selectively positionable along the slot while the head of the fastener is engaged with the slot.

* * * * *